US007634959B2

(12) United States Patent
Frickey

(10) Patent No.: US 7,634,959 B2
(45) Date of Patent: Dec. 22, 2009

(54) FORWARDLY-PLACED FIREARM FIRE CONTROL ASSEMBLY

(75) Inventor: Steven J. Frickey, Rigby, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 366 days.

(21) Appl. No.: 10/937,219

(22) Filed: Sep. 8, 2004

(65) Prior Publication Data

US 2006/0048425 A1 Mar. 9, 2006

(51) Int. Cl.
*F41A 19/07* (2006.01)
*F41A 19/08* (2006.01)

(52) U.S. Cl. ..... 89/136; 89/149; 89/150; 42/69.03; 42/71.01

(58) Field of Classification Search ..... 89/136, 89/149, 150; 42/71, 71.01, 69.03
See application file for complete search history.

(56) References Cited

U.S. PATENT DOCUMENTS

| | | | | |
|---|---|---|---|---|
| 486,273 | A | 11/1892 | Browning | |
| 487,659 | A | 12/1892 | Browning | |
| 822,851 | A | 6/1906 | Burgess | |
| 1,429,370 | A | 9/1922 | Putnam | |
| 1,710,638 | A | 4/1929 | Henry et al. | |
| 2,383,471 | A * | 8/1945 | Colby | 89/136 |
| 2,832,165 | A | 4/1958 | Ivy | |
| 2,865,255 | A | 12/1958 | Marsh | |
| 2,883,911 | A | 4/1959 | Musgrave | |
| 2,919,513 | A | 1/1960 | Palos | |
| 2,967,367 | A * | 1/1961 | Ivy | 42/69.03 |
| 3,020,662 | A | 2/1962 | Merkel | |
| 3,353,447 | A | 11/1967 | Piskator | |
| 3,507,067 | A | 4/1970 | Into | |
| 3,548,709 | A | 12/1970 | Prince | |
| 3,736,839 | A | 6/1973 | Childers | |
| 4,010,566 | A | 3/1977 | Edwards | |
| 4,017,996 | A | 4/1977 | Liedke | |
| 4,028,994 | A | 6/1977 | Ferluga | |
| 4,061,075 | A | 12/1977 | Smith | |

(Continued)

FOREIGN PATENT DOCUMENTS

FR 2 636 418 * 3/1990

OTHER PUBLICATIONS

U.S. Appl. No. 10/939,016, Crandall.*

*Primary Examiner*—Stephen M Johnson
(74) *Attorney, Agent, or Firm*—TraskBritt PC

(57) ABSTRACT

A firearm fire control assembly for disposition in a forwardly placed support-hand operative relationship within a firearm having a combination of a firing pin and a firearm hammer adapted to engage and fire a cartridge, a sear assembly to alternately engage and disengage the combination of the firearm hammer and firing pin, and a trigger assembly including a movable trigger mechanism that is operable to engage the sear assembly to cause the firearm hammer firing pin combination to fire the firearm, a fire control assembly including a fire control depression member and a fire control rod operably connected to the depression member, and being positioned in a forward disposition disposed within a forestock of the firearm, and the depression member adapted to be operably engaged and depressed by the user's conventional forwardly placed support hand to maneuver the fire control rod to provide firing control of the firing of the firearm.

31 Claims, 37 Drawing Sheets

U.S. PATENT DOCUMENTS

| | | | | |
|---|---|---|---|---|
| 4,070,783 | A | | 1/1978 | Edwards |
| 4,463,654 | A | | 8/1984 | Barnes et al. |
| 4,475,437 | A | | 10/1984 | Sullivan |
| 4,527,459 | A | | 7/1985 | Childers |
| 4,562,659 | A | | 1/1986 | Neta |
| 4,601,123 | A | * | 7/1986 | Swearengen et al. ..... 42/72 |
| 4,689,911 | A | | 9/1987 | White |
| 4,719,713 | A | | 1/1988 | Hagle |
| 4,856,217 | A | | 8/1989 | Benelli |
| 4,869,008 | A | * | 9/1989 | Rasmussen ..... 42/71.01 |
| 4,926,575 | A | | 5/1990 | Pastor |
| 5,018,292 | A | | 5/1991 | West |
| 5,123,329 | A | | 6/1992 | Irwin |
| 5,235,769 | A | | 8/1993 | Stead et al. |
| 5,317,951 | A | | 6/1994 | Reynolds |
| 5,827,991 | A | | 10/1998 | Predazzer |
| 5,834,678 | A | | 11/1998 | Kalb |
| 5,939,659 | A | | 8/1999 | Dobbins |
| 6,055,760 | A | | 5/2000 | Cuson et al. |
| 6,250,194 | B1 | | 6/2001 | Brandl et al. |
| 6,401,377 | B1 | | 6/2002 | Vendetti et al. |
| 6,508,158 | B2 | | 1/2003 | Murello |
| 6,705,036 | B2 | | 3/2004 | Orr |
| 7,225,574 | B2 | | 6/2007 | Crandall et al. |
| 7,337,574 | B2 | | 3/2008 | Crandall |
| 2006/0048425 | A1 | | 3/2006 | Frickey |
| 2006/0048426 | A1 | | 3/2006 | Crandall |

* cited by examiner

FORWARDLY-PLACED FIREARM FIRE CONTROL ASSEMBLY

GOVERNMENT RIGHTS

This invention was made with Government support under Contract No. DE-AC07-99ID13727 awarded by the U.S. Department of Energy. The Government has certain rights in the invention.

CROSS-REFERENCE TO RELATED APPLICATIONS

This application is related to U.S. application Ser. No. 10/937,221, filed Sep. 8, 2004, entitled "SEPARATING FIREARM SEAR," pending, U.S. application Ser. No. 10/939,016, filed Sep. 9, 2004, entitled "FIREARM TRIGGER ASSEMBLY," pending, U.S. application Ser. No. 10/938,921, filed Sep. 9, 2004, entitled "FORWARDLY MOVABLE ASSEMBLY FOR A FIREARM," now U.S. Pat. No. 7,225,574 B2, issued Jun. 5, 2007, U.S. application Ser. No. 10/938,683, filed Sep. 9, 2005, entitled "FRAME FOR A FIREARM," now U.S. Pat. No. 7,337,574 B2, issued Mar. 4, 2008, and U.S. application Ser. No. 11/460,274, filed Jul. 27, 2006, pending.

BACKGROUND OF THE INVENTION

In the area of firearms generally, and/or more particularly in the extensive area of long-arm and/or shoulder-fired firearms, such as those which may be operated while being supported by both hands, improvements may be found desirable in the shortening of the overall length of such a firearm, yet retaining as long a barrel as possible.

Firearms typically have external structural parts, each including a barrel, a support (e.g., handle and/or stock, or the like), a receiver, magazine and an externally activatable triggering device. Usually, the firearm receiver is the part of the firearm that houses the internal operating parts of the gun. In most, if not all prior firearms, the receiver is stationary and the operating parts are moving parts which reciprocate and/or cycle within the receiver during the loading and unloading of cartridges therein. Such moving parts have often included the firing mechanisms such as a typical bolt, firing pin, hammer or striker, sear and/or a trigger member, any one or more of which are operative with any other firing mechanisms, and the loading and unloading apparatus. The firing pin is often located in or adjacent the bolt, and usually also adjacent the hammer and sear and/or the internal triggering mechanism (s).

Conventional firearms often load and unload, e.g., cycle cartridges by moving the bolt and/or associated firing mechanisms to the rear and then forward again. Prior firearms have thus generally had to have receivers which are large enough, particularly long enough for the back and forth movement of the bolt and/or various of the adjacent or included elements or mechanisms during loading and unloading. This receiver length has generally been at least twice as long as the longer of the cartridges used, and/or the bolt or other mechanisms reciprocating therein. However, this extended, usually rearward length in these prior firearms also represents length and corresponding internal area/volume used only during the loading and unloading processes, and is otherwise substantially unused, relatively empty space during any other period.

In many firearm situations, this empty space has not provided any hindrance in operation or effect. However, it has been found that there are circumstances in which conservation of space in firearm length may be desirable. An example of such a situation is in the use of a rifle and shotgun connected together, and more particularly when a multiple-shot shotgun may be desired to be attached or mounted onto a primary weapon such as a rifle, inter alia. Such a connection may be desired in the execution of forced entries through doors by law enforcement or military personnel. A traditional entry method requires a shotgun to breach doors. In an exemplary conventional process without a connected rifle and shotgun, the shooter first fires a shotgun at the door to destroy the hinges or the lock and then either has to switch from the shotgun to a parent rifle or other such primary weapon or remove himself from the line of fire to allow others to proceed through the door. Either way, repositioning or switching weapons wastes a great deal of time in breaching situations and the loss of precious seconds could result in undesirable consequences. A better design would allow improved entry times in life-threatening situations and thereby lower the risks to the enforcement agents.

Moreover, the connection of an otherwise conventional shotgun onto a parent weapon such as a rifle provides a very cumbersome and awkward weapon system. At the least, a conventional shotgun, with the stock removed and mounted under the barrel of a rifle will yield a combined weapon having two relatively different length barrels. The shotgun will generally extend much further forward than the rifle barrel. Sawing off the shotgun barrel is one way to shorten the barrel and reduce the difference; however, keeping the barrel longer is preferred because it provides more time for the gun powder to burn and thereby provides for more energy to be applied to the projectile(s), thereby making the shotgun more effective. Moreover, such an over/under or underslung connection of a rifle and conventional shotgun necessitates the undesirable altering of the normal placement of the firing and/or support hands in operation, as the user would need to either move the triggering finger(s) from one to the other trigger of the shotgun to the rifle, or otherwise unconventionally maneuver the support hand during use. A better design would allow firing of either the primary or secondary weapon with minimal or no change of the positioning of either one or the other or both of the operator's hands.

In conventional two-handed firearms, the fire controls group, including the trigger and safety, inter alia, are normally located adjacent the rear of the stationary receiver for operation by the rear, generally non-support hand and the magazine is usually located adjacent the forward end of the receiver and is also usually stationary. As such, and in some instances so as not to move the normal trigger finger from the primary weapon (e.g., rifle) trigger, the forward, support hand may have been used as a secondary operating hand for the secondary weapon (e.g., shotgun); however, with conventional firearms, the support hand would have to be moved rearward to be disposed in place next to the rearwardly disposed fire controls group, trigger and safety. Moreover, the user would have to move the normally supporting, now secondary operating hand rearward past the magazine which could pose an obstacle, and place the hand in an unsupport-like position to maneuver the safety and trigger mechanism for the secondary weapon. And, then, the operator might desire to move that usual support hand back to a support position for primary weapon use, but must do so quickly and with obstacles and potential misplacement.

As a consequence, there exist needs for a compact, manually operated firearm that is optimally configured to operate in a shorter manifestation either alone or as a secondary firearm while being attached to a primary firearm. One preferred configuration for such a firearm may be to attach the secondary firearm forward of the receiver of a shoulder-fired primary weapon, and underneath the barrel of the primary weapon. The nature of the location and its use suggest some specific ergonomic desires with regard to weapon length and firing ease. Preferred desiderata include a shorter overall length, yet without altering or interfering with normal operation of either weapon, and/or allowing firing of either the primary or secondary weapon with minimal or no change of the positioning of either one or the other or both of the operator's hands.

SUMMARY OF THE INVENTION

A firearm fire control assembly is adapted to be disposed in a forwardly placed, support-hand operative relationship within a firearm. The firearm has, in operative connected relationship one with another, a barrel and a receiver in a forward assembly, either or both of which is connected to a forestock. The firearm also has, in operative disposition therewithin, the following firing mechanisms: a combination of a firing pin and a firearm hammer adapted to engage and fire a cartridge within the firearm, a sear assembly to alternately engage and disengage the combination of the firearm hammer and firing pin, and a trigger assembly including a movable trigger mechanism that is operable to engage the sear assembly and thereby cause the firing of the firearm hammer-firing pin combination and thereby fire the firearm. The fire control assembly includes a fire control depression member and a fire control rod operably connected to the depression member, the fire control assembly being positioned in a forward disposition disposed within the forestock of the firearm, and the fire control depression member being adapted to be operably engaged by the user's forwardly placed support hand when the support hand is in a substantially conventional forwardly placed support hand position, and being operably depressible to maneuver the fire control rod to a fire control position to thereby provide firing control of the firing of the firearm.

BRIEF DESCRIPTION OF THE DRAWINGS

Presently preferred exemplary embodiments of the present invention are illustrated in the drawings, in which.

DETAILED DESCRIPTION

Disclosed herein are compact weapons usable alone and/or as secondary weapons integrated with an operator's primary weapon. More particularly, the weapons herein described are typically shoulder-fired and/or two-handed firearms, having their respective receivers reduced in size, especially in length, to reduce the overall length of each firearm. This may be achieved in part by making the bolt or other breech closure or blocking surface or device of each such firearm relatively stationary and making the corresponding barrel forwardly movable relative thereto for loading and unloading. Also described herein are embodiments where the receiver, magazine and barrel of a firearm are joined together and all of these components being movable with/as the loading and unloading pump apparatus. Also described herein are alternative parts of the movable pump elements being movable to a forward position on the firearm. In some embodiments, the trigger and/or other fire controls, such as the trigger safety, prove desirable to have the user's normal forward support hand provide more assistance in the overall operation by, for example, being made able to fire the secondary weapon from the forward support position. However, in a pump action firearm where the fire control group is part of the pump or forearm, a separable link between the trigger in the fire control group and the hammer may be desired or even required. In most conventional firearms, that link is fixed because the fire control group does not move with respect to the hammer or firing pin. Here however, the feature of a forwardly moving barrel firearm may include forwardly positioned controls with a separating link between the trigger and the hammer, e.g., in the sear connection therebetween. A separating sear link would/could thus allow the trigger to move relative to the hammer retaining portion of the sear, as well as relative to the hammer and firing pin every time that the forwardly moving parts of the firearm are moved or cycled forward.

Figure 1A:
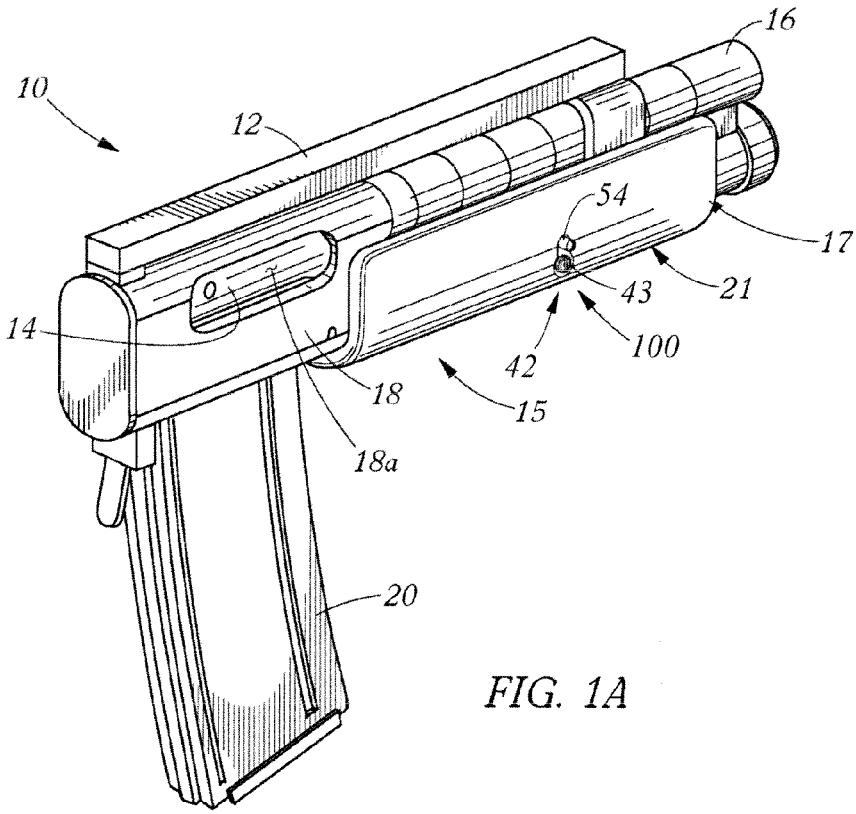
FIGS. 1A and 1B depict respective closed and open isometric views of a moving barrel firearm hereof.
Figure 1B:
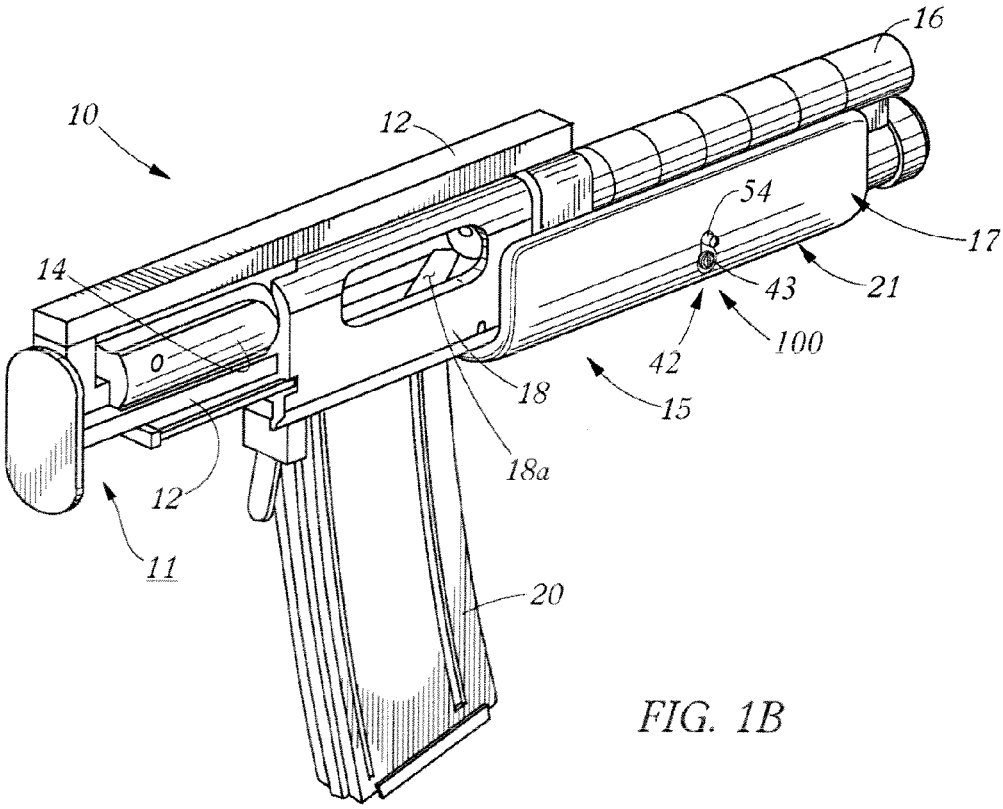

With reference to the drawings, there is first shown in FIGS. 1A and 1B a forwardly moving barrel firearm 10 hereof depicted in both closed and open positions in respective FIGS. 1A and 1B. Firearm 10 is also shown in respective exploded views in FIGS. 2, 3A and 3B. As depicted in these FIGS. 1A-3B, such a firearm 10 hereof may generally include a stationary assembly 11 and movably attached thereto a forwardly movable assembly 15. Such a stationary assembly 11 is shown isolated and exploded in FIG. 3A and a forwardly movable assembly 15 is similarly isolated and exploded in FIG. 3B.

In the primary embodiments of a firearm 10 of the present invention, the stationary assembly 11 (see the isolation thereof in FIG. 3A) may generally include a frame 12 (see also more specifically, a first embodiment hereof in FIG. 4) which may have a bolt 14 or other breech closing or blocking surface or device (see below) disposed therein/affixed thereto in substantial fixed relationship therewith. And, also in the primary embodiments hereof, the forwardly movable assembly 15 (FIG. 3B) may generally include at least a barrel assembly 16, and here frequently also a receiver or receiver structure 18 and magazine 20. The forwardly movable assembly 15 includes or is co-extant with a pump action identified generally by the reference numeral 21 in FIG. 1. The pump action 21 refers to the combination of operating mechanism parts providing for movement, as well as referring to the parts which are moved thereby. As such, this firearm 10 may be considered an alternative of and/or over a conventional pump shotgun which is structurally and operatively different in various ways including a structuring of the conventional pump action here joined together at least with the barrel assembly 16, but often also with the receiver structure 18 and/or the magazine 20 (in various combinations) such that each and/or all of these elements move with/as the pump action 21. These elements would then also be in or adjacent or otherwise connected to or be integral parts of the forearm or forestock 17 of the firearm 10. The forwardly movable assembly 15 may alternatively be considered separate from either or both the pump action 21 and/or the forearm 17, or more preferably will herein be considered as coextant therewith and/or as including those elements therein.

Figure 2:
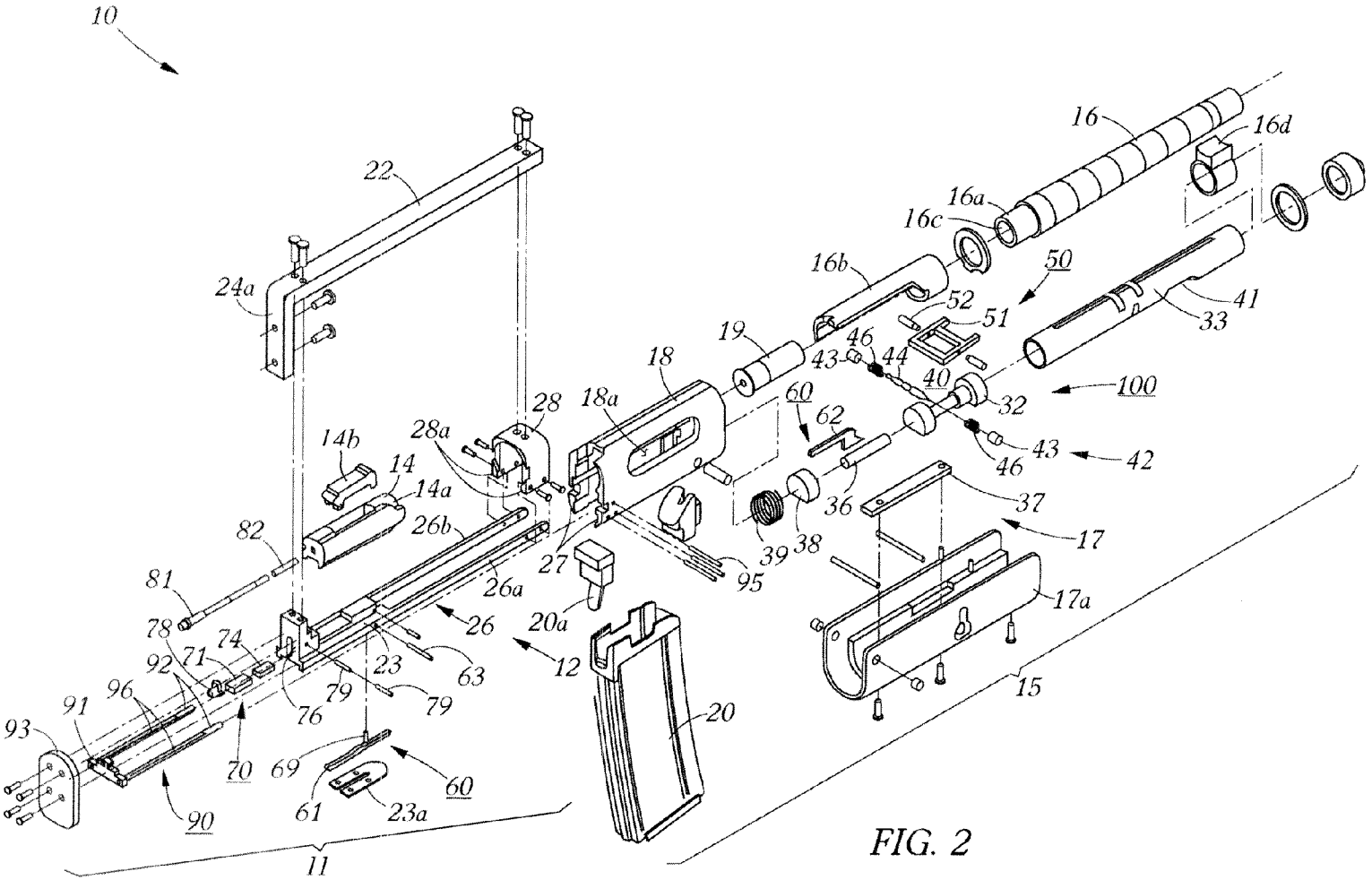
FIG. 2 is an exploded isometric view of a moving barrel firearm similar to that shown in FIGS. 1A and 1B.
Figure 3A:
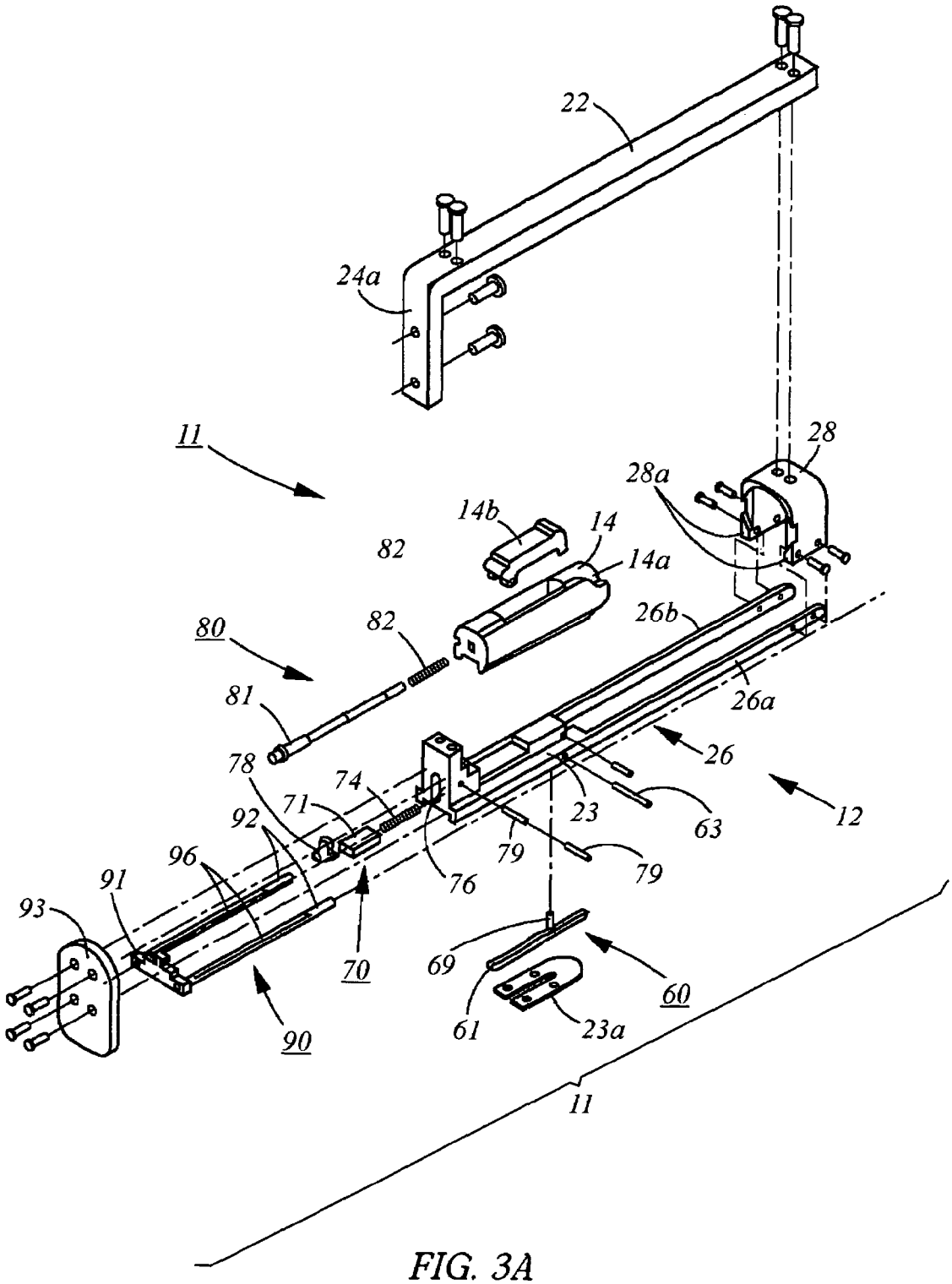
FIGS. 3A and 3B provide enlargements of portions of an exploded isometric view of a firearm such as that shown in FIG. 2.
Figure 3B:
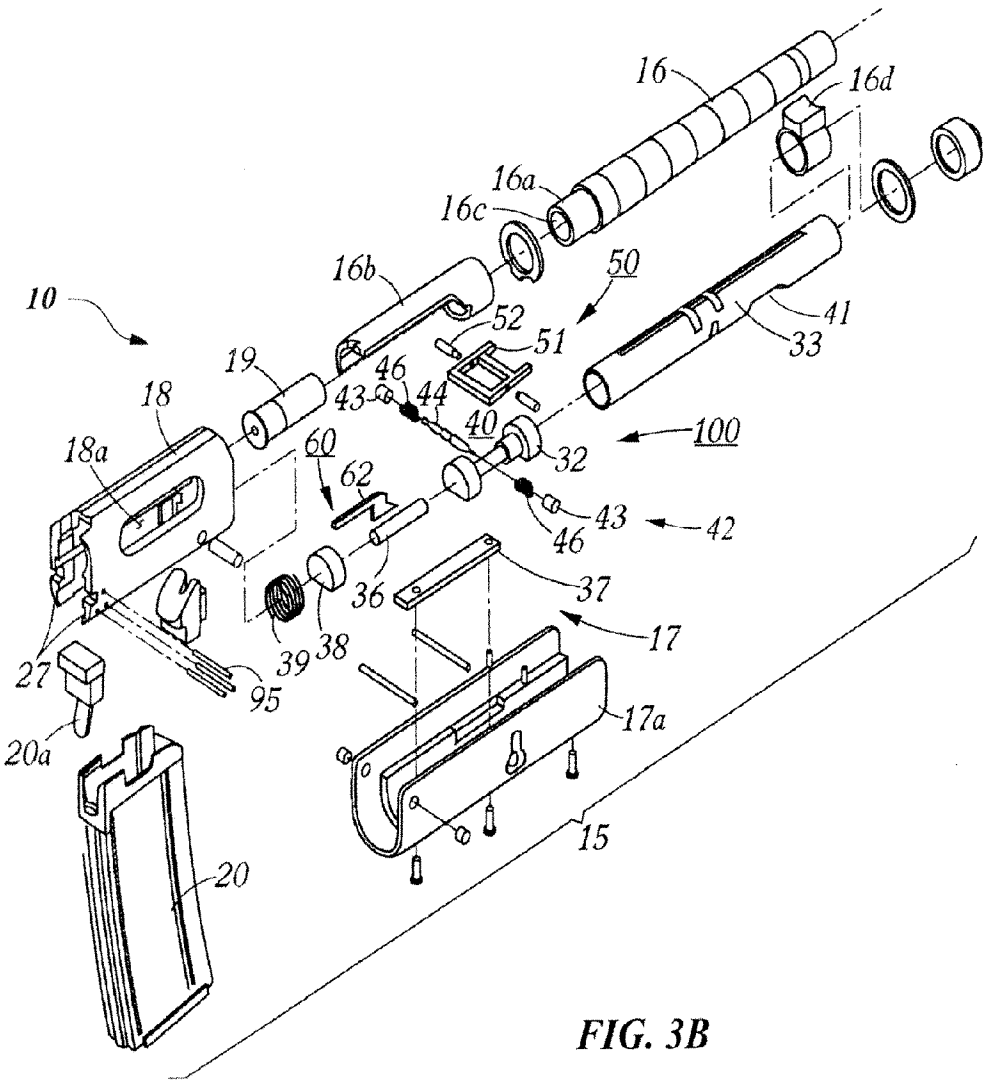
Figure 5:
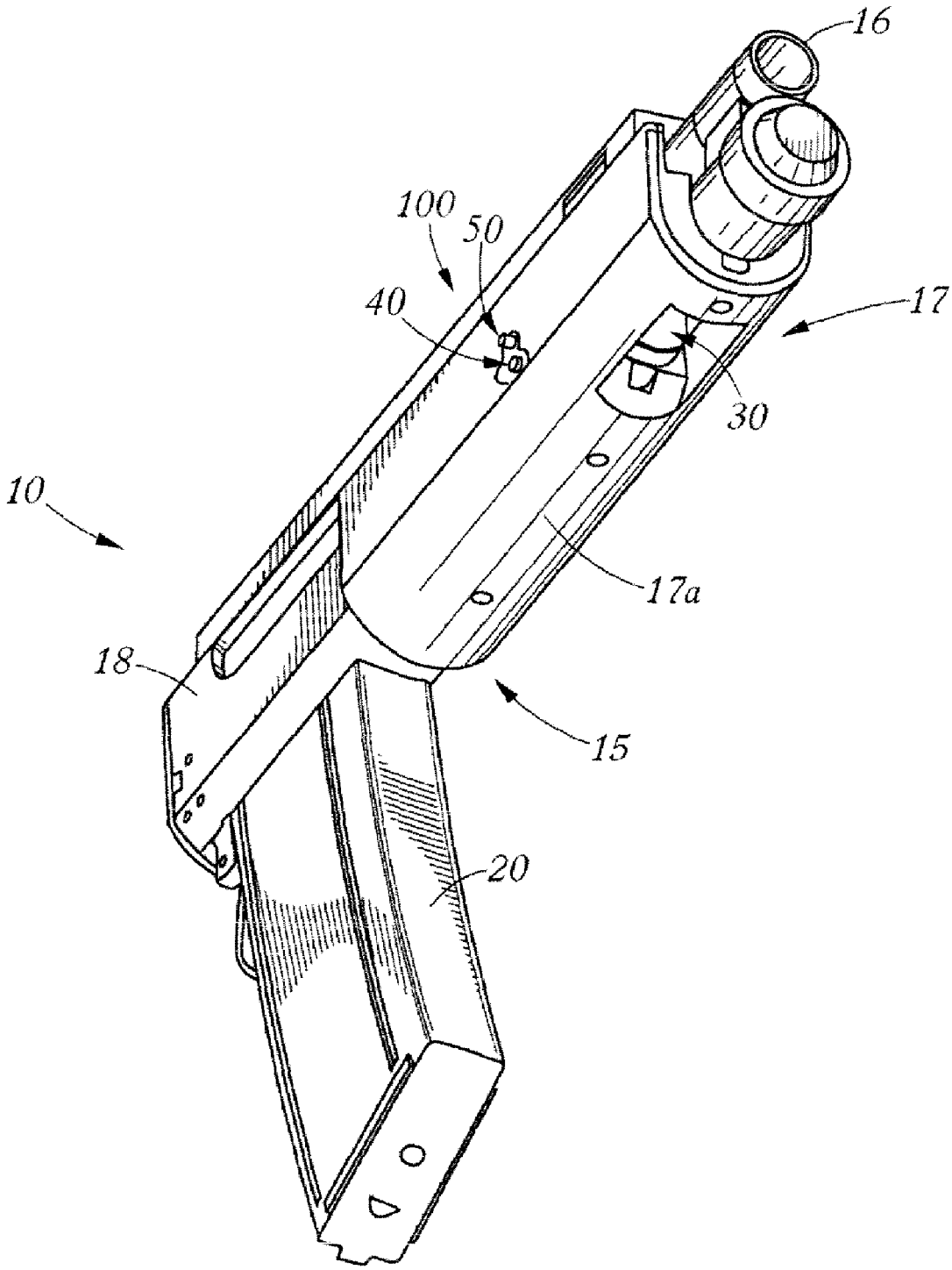
FIG. 5 is another isometric view of a firearm such as that in FIGS. 1A and 1B, shown from the underside and front.

In many embodiments, also made part of the movable pump elements or forwardly movable assembly 15 may be a group of forwardly placed firearm control group 100 (see FIGS. 3B and 5, inter alia) typically incorporated and/or at least partially shrouded within a hand support structure or hand guard portion 17*a* of the forearm 17 (see FIGS. 2, 3B and 5). Note the depiction in the drawings of a generally preferred, substantially conventional longitudinal or lengthwise disposition of the forearm or forestock 17, as along the length of the barrel assembly 16, which allows for a substantially conventional grip thereof by the operator in use. Such forwardly placed firearm control group 100 may include a trigger assembly 30 and/or a fire safety assembly 40 including a trigger safety 42, and/or a pump action lock and release assembly 50. In such embodiments, an optional separating sear assembly 60 (FIGS. 2 and 3, inter alia) may also be used. Note, the exploded views of FIGS. 2, 3A and 3B include these general assemblies and the parts thereof, each identified by respective reference numerals; however, detailed descriptions of the various component parts and the interactions thereof will be set forth in greater detail throughout the progression of the following description, and in reference to the following drawing figures.

The presently described reducing of the length of the receiver 18 may generally include at least limiting if not completely eliminating the distance that the bolt 14 or other breech closing surface or device moves rearward in the receiver 18 in order for the firearm 10 to unload and reload shells, cartridges, or rounds 19. As presently understood, some space has to be opened between a barrel breech 16*a* and a bolt or breech closure face 14*a* (see FIGS. 6A and 6B, described further below) to provide room for removing a spent cartridge or shell 19*a* from the chamber 16*c* via the breech 16*a*, ejecting it out of the gun through an ejection aperture 18*a* defined in the receiver 18, picking up another new cartridge or shell 19*b* into the empty space 18*b* between the bolt face 14*a* and the breech 16*a*, and then eliminating the empty space 18*b* between the breech 16*a* and the bolt face 14*a* by moving them back into battery engagement including moving and locking the new cartridge or shell 19*b* into the chamber 16*c*. This may be accomplished by forming the receiver 18 so that the rear end of the bolt 14 or other breech closure device is disposed at or substantially very close to the rear end of the receiver 18 when the receiver 18 is closed over and around the bolt 14 and the bolt 14 is locked in battery, closing the breech 16*a* of the barrel assembly 16 (see FIGS. 2, 3B and 6A). However, here instead of moving the bolt 14 or other closure device rearwards, as has previously been typical, the bolt 14 may now be held in substantially one position, though in some embodiments allowing for minimal bolt travel, as for example to allow the bolt lug 14*b* to disengage from the barrel assembly 16 (particularly from the barrel extension 16*b*, see FIGS. 2 and 3B). Meanwhile, the substantial remainder of the firearm 10, e.g., the forwardly movable assembly 15, may be moved forward from the primary/firing position (FIGS. 1A and 6A), to the forward loading/unloading position (FIGS. 1B and 6B) to accomplish the ejection of the spent cartridge 19*a* and the loading of a new cartridge 19*b* into the barrel chamber 16*c* (see FIG. 6B), and in many embodiments, the relative motion of the stationary and moving parts will be such as to have the breech closure device, e.g., bolt 14 completely disengage from any or all parts of the forwardly movable assembly 15, e.g., the receiver 18, the barrel assembly 16 and/or the magazine 20. Such movements can also accomplish cocking a hammer/striker 71, inter alia (see below). This provides a desirable new form of a repeating firearm, particularly compared to previous firearms which may have had forwardly moving barrels; excepting however, that it does not appear that any previously known firearms have had the simplicity, efficiency and/or conservation of space shown and described herein.

As introduced above, the bolt 14 or other breech closure device or surface may be made substantially stationary in the primary embodiments hereof which therefore allows for reduction of the size of the receiver 18 to reduce the overall length of the firearm. The bolt 14 or other breech closure device may be made substantially stationary by being affixed to the internal part of the frame 12, see FIG. 1B, the frame 12 being shown separately in FIG. 4A and with a bolt 14 and a receiver structure 18 in FIG. 4B, and the substantial remainder of the presently disclosed firearm 10, including one or more of the external receiver structure 18, magazine 20 and/or barrel assembly 16 may, in this embodiment, be joined together and all move with and/or as the pump action 21. Thus, the frame 12 is discrete from the barrel assembly 16, receiver 18, and magazine 20, and may, in this embodiment, be considered the substantially stationary component or a part of the substantially stationary assembly 11 of the overall firearm structure. Note, the terms "stationary" and "movable" or "to move" or other tenses thereof, are intended herein to denote relative states during the cycling or loading/unloading phase(s) of operation, such that, e.g., the frame 12 and bolt 14 or other breech closure are substantially stationary relative to the other parts, namely, the forwardly movable assembly 15 and the component parts thereof. Likewise, the forwardly movable assembly 15 and parts thereof (e.g., receiver 18, magazine 20 and barrel assembly 16, inter alia) are movable relative to the parts of the stationary assembly 11, e.g., the frame 12 and the bolt 14 or other breech closure surface. Indeed, in contrast to this primary convention, it may in some embodiments appear to be oppositely considered that the parts of the stationary assembly 11 are actually the movable parts and vice versa, such that the bolt 14 and frame 12 could be seen as movable relative to the then stationary forwardly movable assembly 15 of the receiver 18, magazine 20 and barrel assembly 16. Moreover, the entire firearm 10 will generally be movable as a whole or may be made relatively stationary, e.g., fixed in place, as may be desired in one or more particular operations. These terms are thus relied on only for convention and simplicity in description, not for limitation.

Figure 6A:
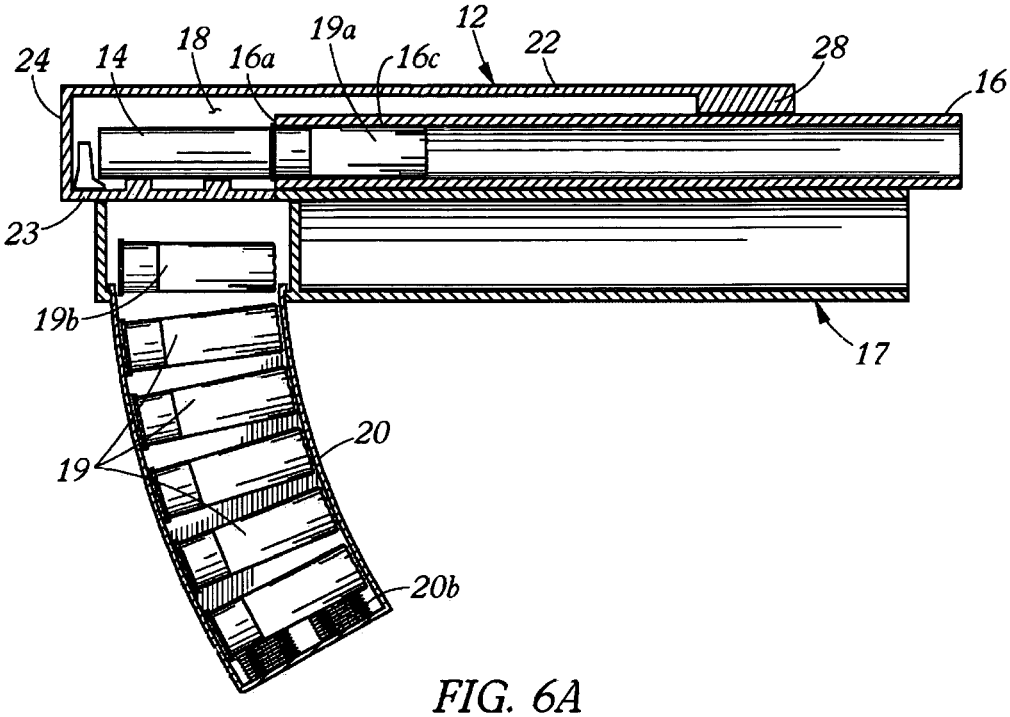
FIGS. 6A and 6B provide respective closed and open schematic cross-sectional views of a firearm such as that shown in FIGS. 1-5 revealing a frame in relation to some other firearm components.

The frame 12 may thus provide a structure for retaining or holding the firearm bolt 14 or other breech closure surface or other firing mechanism (see below) in a substantially rearward position relative to the positions of substantially all of the other parts of the firearm 10 and particularly relative to the forwardly movable assembly 15 while the forwardly movable assembly 15 is cycled forward, see FIG. 1B. The frame 12 may also be considered as set or disposed to directly support the forwardly movable assembly 15 during all phases of operation, e.g., when not moving (either fully open or fully closed), as well as during its transition phases, e.g., during the forward and return sliding movements, as for example when the receiver 18 is moved backward to, over and ultimately around and encloses the bolt 14 therewithin, see FIG. 1A as an example. These relative movements and/or dispositions are also shown in the schematic sub-part FIGS. 6A and 6B as described further below. Moreover, note that when the forwardly movable assembly 15 including the receiver 18 is in the retracted, closed position, see FIG. 1A, the receiver structure 18 encloses and contains substantially the bolt 14 and/or some or all other operating component parts within the receiver chamber 18*b* thereof and has substantially no remaining empty space therein (FIG. 6A) as there has been in prior art receiver embodiments. In this closed position, the frame 12 and/or the bolt 14 are suitably disposed for the locking of the movable pump elements or forwardly movable assembly 15 in closed firing position so that the spent shell 19*a* is locked in battery in the chamber 16*c* of the barrel assembly 16 and against the face of the bolt 14 or other breech closure surface thereby closing the breech 16*a* of the barrel assembly 16 (FIG. 6A). The firearm 10 is then in battery. The frame 12 continues to support the forwardly movable assembly 15 while the firearm 10 is in battery. Reversing the typically standard movable bolt 14 concept to this approach of holding the bolt and bolt carrier system essentially stationary while moving the remainder of the firearm 10 provides not only the reduction in receiver length but also the consequent result of a relatively compact firearm 10 having a short overall length, yet having or at least providing the option of maintaining a relatively long and/or standard barrel length.

Note, the concept of reducing the overall firearm length as a result of reducing the relative receiver size may also involve appreciating that a receiver hereof may not merely be a housing for the bolt and/or other firing mechanisms. In prior designs, the bolt and other firing mechanisms were substantially always disposed in the receiver. However, in this embodiment, the structure of the receiver 18 may be moved substantially away from and at least temporarily leave the bolt 14 or other closure substantially exposed outside the structure of the receiver 18, as well as outside the receiver chamber 18*b* as shown in FIGS. 1B and 4B, before the housing-type structure of the receiver 18 may return on the rearward stroke to engulf and enclose the bolt 14 or other closure or firing mechanism(s) once again, FIG. 1A. Contrarily, where it may be non-conventionally viewed that the bolt 14 and frame 12 move relative to the receiver 18, it would appear as though the bolt 14 leaves the receiver 18, at least temporarily during the cycling process. Another different view, if the receiver 18 is thought of generally as always including the bolt 14 and other firing mechanisms therein, even if they are not always enclosed within an enclosing structure, is that the receiver 18, at least the receiver chamber 18*b* thereof, may temporarily increase in size from that of the reduced, in-battery size, to a cycling size larger than the reduced size, and back to the reduced size after the cycling is completed. Alternatively, the receiver may include a primary receiver structure which is the part which is movable, and the receiver may include an expandable receiver portion which may be an expandable portion or area or inner receiver structure surrounding the bolt and at least a portion of the firing mechanisms.

Figure 6B:
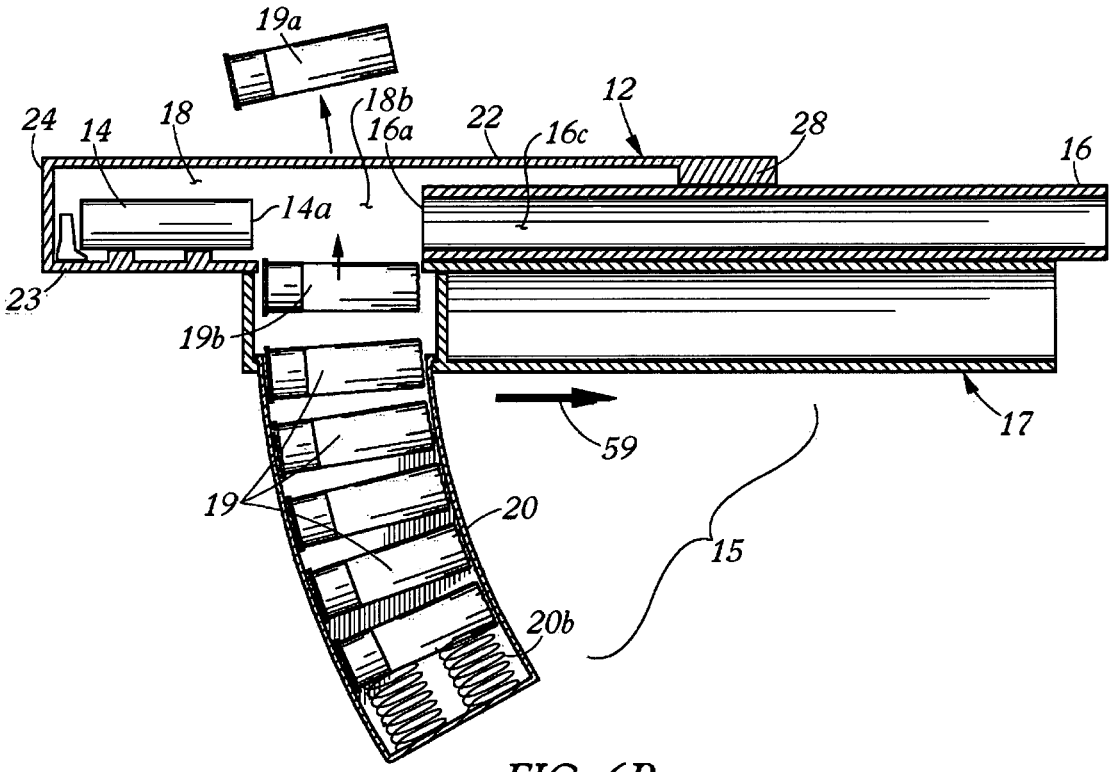
Figure 7A:
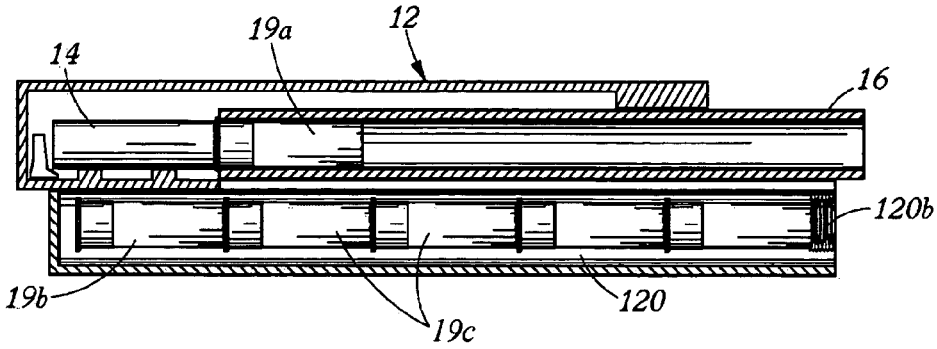
FIGS. 7A and 7B provide respective closed and open schematic cross-sectional views of an alternative firearm hereof showing a frame in relation to some other movable firearm components.
Figure 7B:
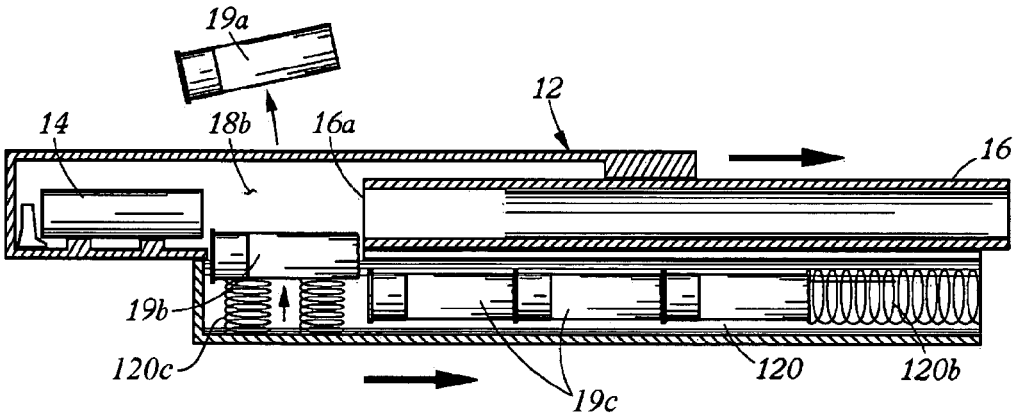

Note, the receiver 18 as described in this embodiment is substantially the housing structure of the receiver 18 shown in FIGS. 1A, 1B, 2, 3B, 4B and 5, inter alia. However, it may alternatively refer to the space, e.g., volume, that is or would be defined therein as the receiver chamber 18*b* of FIG. 4B, or as the empty space 18*b* between parts as shown in FIG. 6B. Thus, the receiver 18 may be either structure or volume as the embodiment may allow, and such may be of a fixed size and volume which moves, or of a variable size and volume which expands and contracts during cycling forward and back. In either case, the receiver 18 may then house one or more of the operating elements and/or firing mechanisms of the firearm 10, and may do so always (when a variable size and volume is allowed) or only when in closed and/or battery position (when during forward cycling the bolt 14 and/or various other mechanisms may effectively be removed therefrom). As described in much further detail below, the firing mechanisms which the receiver 18 may house, conventionally, and as may herein include: the as noted bolt 14 or other closure (a bolt or other breech closure or blocking device will be referred to herein as a firing mechanism due to its operability during the firing process), the striker or hammer 71, a corresponding hammer spring or springs 74, a hammer cocking bar 91, hammer transfer link 78, a rotating sear level 61, a breech bolt spring 84 and/or a firing pin 82 (see detailed descriptions of alternative embodiments hereof relative to FIGS. 19A-21D, below). Note also that the class of firing mechanisms may thus include one or more members of several groups described in much more detail below, but in addition to those listed hereinabove may include one or more members of the sear assembly 60, the hammer assembly 70, and/or the firing pin assembly 80; and in some embodiments, may even include one or more members of the trigger assembly 30, the fire safety assembly 40, and/or the pump action lock and release assembly 50 (see details below). A bolt lug 14*b* may also be disposed herein as it may be used to lock the bolt 14 in relation to, or into the receiver 18 or more usually into the barrel breech 16*a* when in battery. Note, the receiver 18 hereof is intended to retain the function of receiving and containing the cartridges 19 during the transitional loading and unloading processes as shown and described herein, even in most embodiments during the cycling/moving process. This may be enhanced in some embodiments by having the magazine 20 fixed in relation to the receiver 18 at all relevant times there. Note, an alternative magazine 120 connection is shown in FIGS. 7A and 7B and will be described further below.

Moreover, an alternative feature resulting from the shortening of the receiver length is that this may optionally allow for that length saved on the receiver 18 to be added to the barrel assembly 16. This means that for a firearm, e.g., a shotgun, of the same overall length, the barrel assembly 16 of a firearm 10 hereof can have approximately twice the length of the receiver 18 added thereto over and above that of the barrel of the conventional pump shotgun. Longer barrel length may translate directly into greater power applied to the projectile or projectiles leaving the weapon, as the longer barrel allows more time for the gunpowder to burn and thus a longer time for the building of a higher pressure behind the projectile(s), resulting in more time and distance for the projectile(s).

As introduced above, a way of viewing the ultimate result of this structure is that it may present a firearm with a forwardly moveable assembly 15 which includes at least the barrel assembly 16, but may also include the receiver 18, among other optional elements; and, that the frame 12 provides or acts as a substantially stable platform and/or guide to keep the barrel assembly 16 and other moving/movable components of the forwardly movable assembly 15 aligned with the bolt 14 or other firing mechanism(s) as the action, e.g., the forwardly movable assembly 15, is cycled. The forwardly movable assembly 15 may thus be adapted to be directly supported by and directly slide on the frame 12 with respect to the bolt 14. Alternatively, from the opposite view, the frame 12 may be adapted to have the forwardly movable assembly 15 move or slide thereon, or both of these elements may be adapted to work together. The frame 12 may thus provide the support structure or guide rails 26 (FIGS. 3A, 4A, and 4B; and see rails 26*a*, 26*b* described below) on which one or more of these moving components of the firearm may directly ride, keeping the movable components of the forwardly movable assembly 15 aligned with the bolt 14 and/or other firing mechanism(s) on the return stroke. Such a frame 12 held stationary in this manner, provides for the implementation of a forward direction pump motion or cycling of the forwardly movable assembly 15 of at least the barrel assembly 16, and as shown in the primary embodiments herein, also the receiver 18 and sometimes also the magazine 20 inter alia.

Figure 4A:
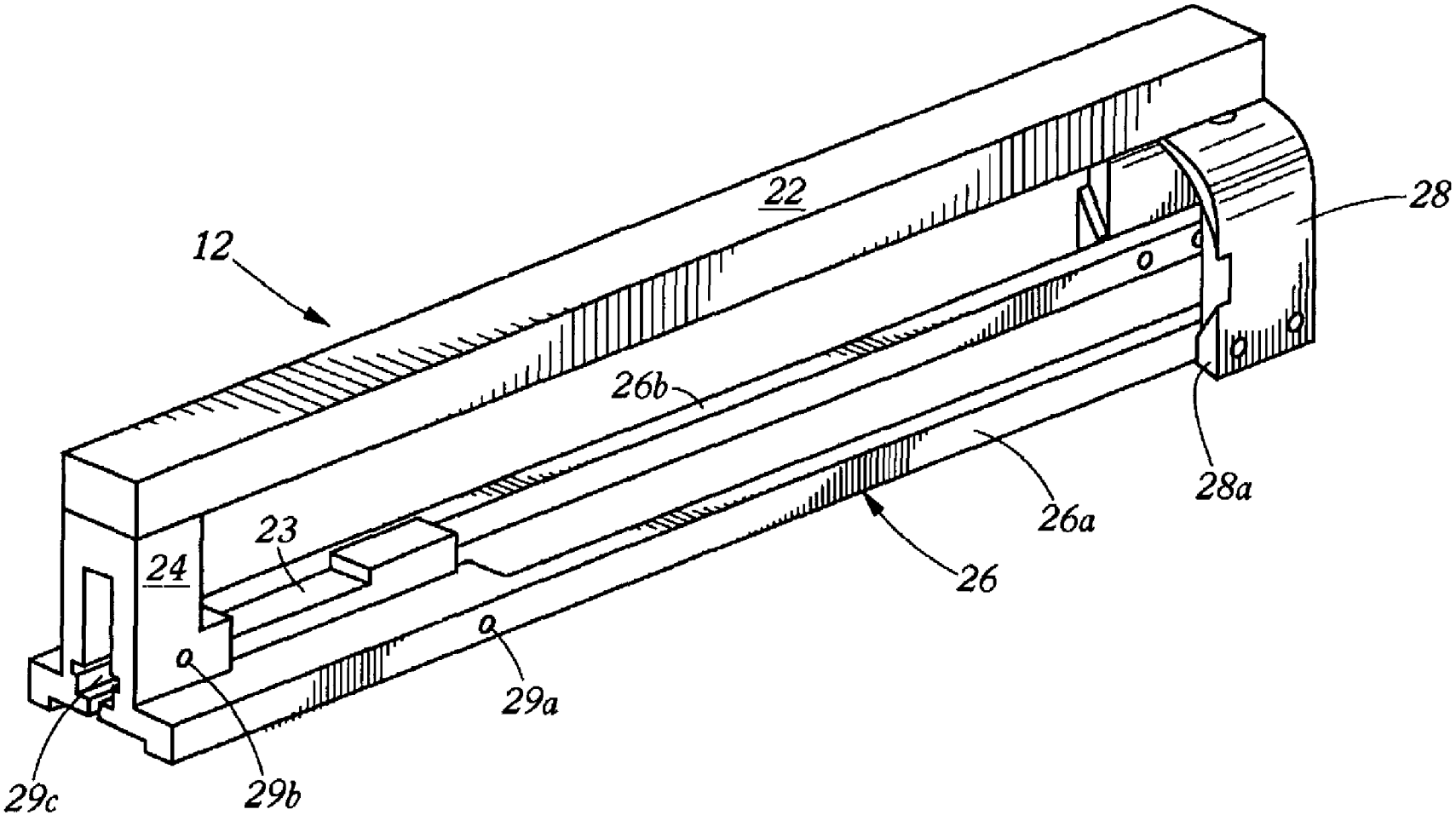
FIGS. 4A and 4B provide isometric views of a frame of a firearm such as that shown in FIGS. 1-3.
Figure 4B:
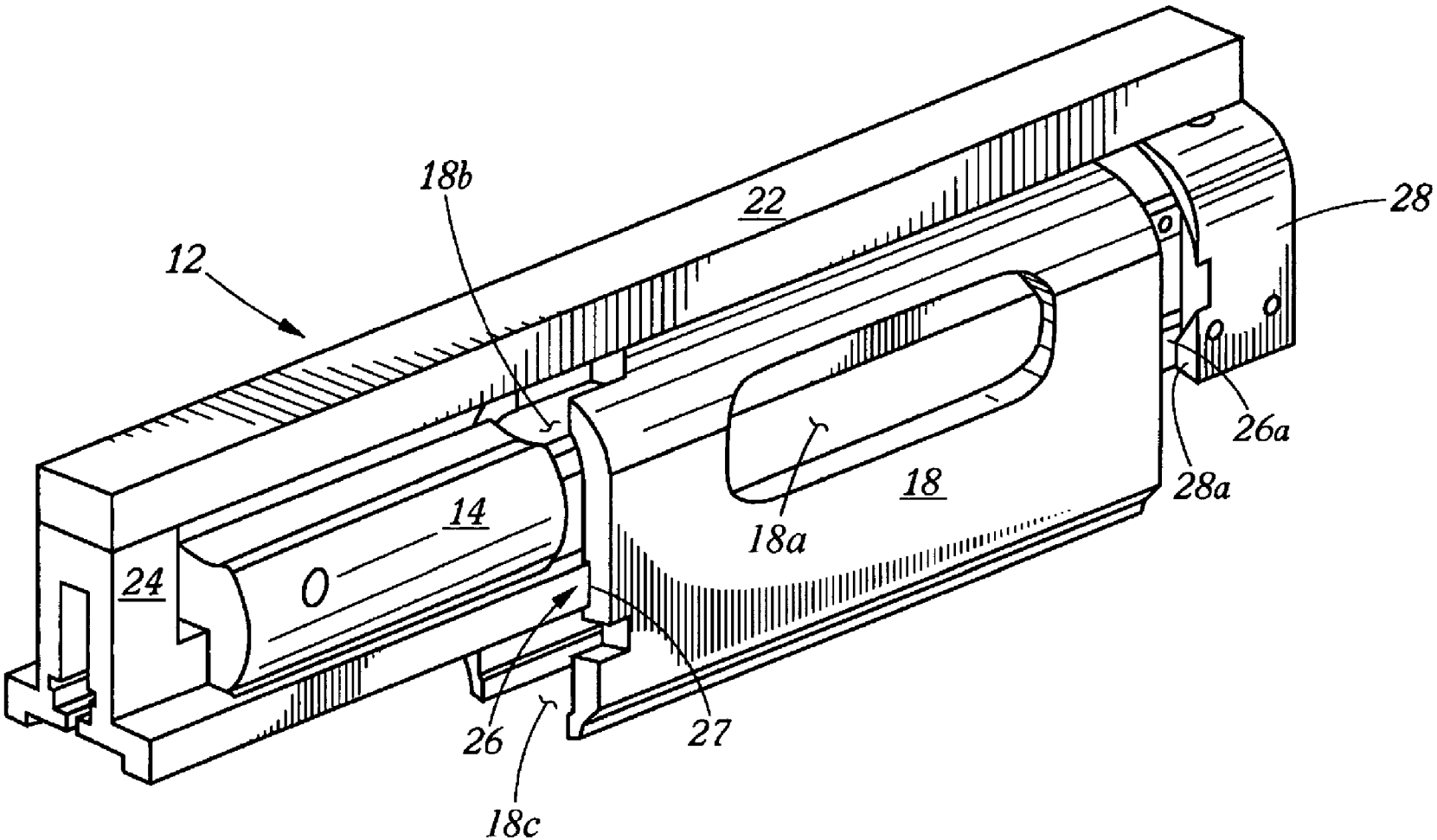

The frame 12 may more specifically be formed such that it has separately identifiable parts such as those shown for example in FIGS. 2 and 3A, and most particularly in FIG. 4 (FIGS. 4A and 4B; some of which parts are also shown in FIGS. 1A and 6), where for example, the frame 12 includes a top bar 22, a back bar or support 24, a support structure or guide rails 26 shown including two side support members, bars or rails 26*a*, 26*b* and a frame member 28 which may, as shown, have an inverted U or like shape. The support structure 26 may directly support and/or guide movement of the forwardly movable assembly 15 and may do so by having at least one of the barrel 16, magazine 20 and/or receiver 18 in direct contact with and directly movable on the elongated support structure thereof. Moreover the support rails 26*a*, 26*b* may preferably be spaced apart to allow for movement of operative parts therebetween, see e.g., the separating sear description below, and/or to allow for movement of cartridges 19 up therebetween for loading in the receiver 18 and barrel 16 as described further below. Even so, there may also be a supporting base or floor 23 disposed therebetween at the rear of the frame 12 for connection of the bolt 14 and/or other firing mechanism(s) thereto, and/or for use in the cartridge loading process wherein the supporting base or floor 23 may also retain the shells 19 in the magazines 20, 120 (see FIGS. 6A and 7A) until the magazines 20, 120 are moved forward with forwardly movable assembly 15 thereby allowing for a cartridge 19 to be fed upward through the opening between the rails 26*a*, 26*b* to the barrel assembly 16. As shown here, a sear lever protector plate 23*a* (FIGS. 2 and 3) may be included as part of or attached to the floor 23. Other points and/or specifics of connection may also be provided in/on the frame 12 (see below), as for example of the respective pivotal linkage points/axes 29*a*, 29*b* for the rotating sear lever 61 and/or the rotating firing pin striking link 78, and/or the slide groove 29*c* for the cooperating hammer 71, see operative descriptions below. Similarly, sliding grooves 27 in the receiver structure 18, for receiving and cooperating with the guide rails 26*a*, 26*b*, are also connection parts or mechanisms, the operations of which being described further below.

As described further relative to the forwardly placed firearm control group 100 (e.g., assemblies 30, 40 and 50, inter alia), and particularly the pump action lock and release assembly 50, see below (particularly relative to FIGS. 15, 16, 17 and 18), the frame 12 may also provide limits for the forward and/or rearward travel of the forwardly movable assembly 15. Similarly, the frame 12 may also provide or be a part of providing a means of mechanically locking the movable pump action or forwardly movable assembly 15 in the closed position (though generally separately from the locking action of the bolt lug 14*b*). Examples hereof will be described in greater detail relative to the embodiments of FIGS. 15, 16, 17 and 18, below.

Figure 8A:
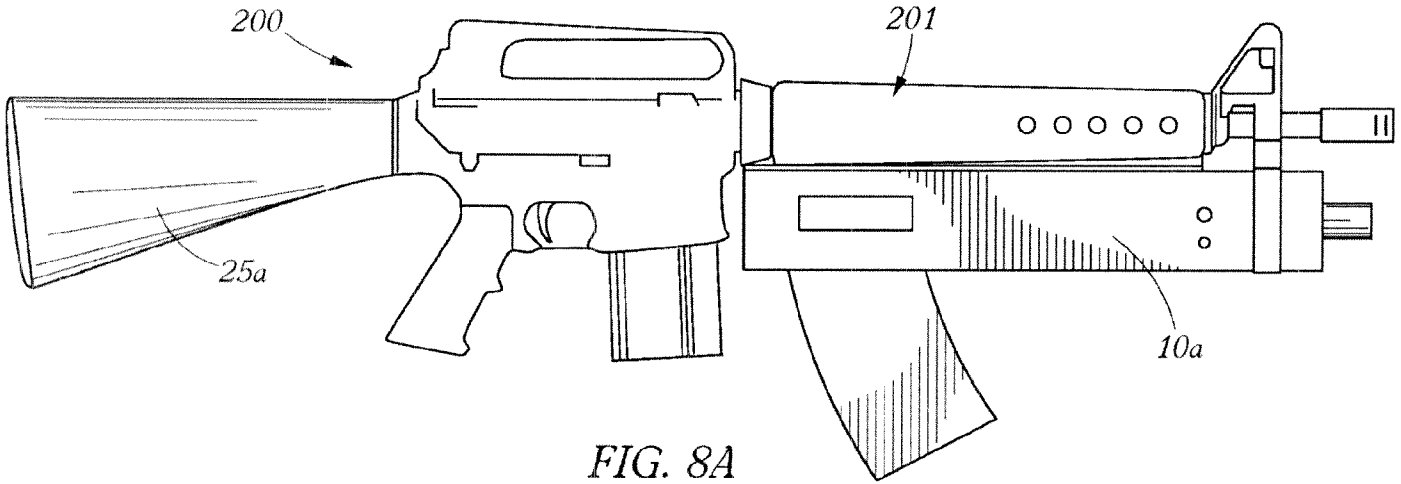
FIGS. 8A and 8B provide respective attached and stand-alone elevational views of a firearm hereof.
Figure 8B:
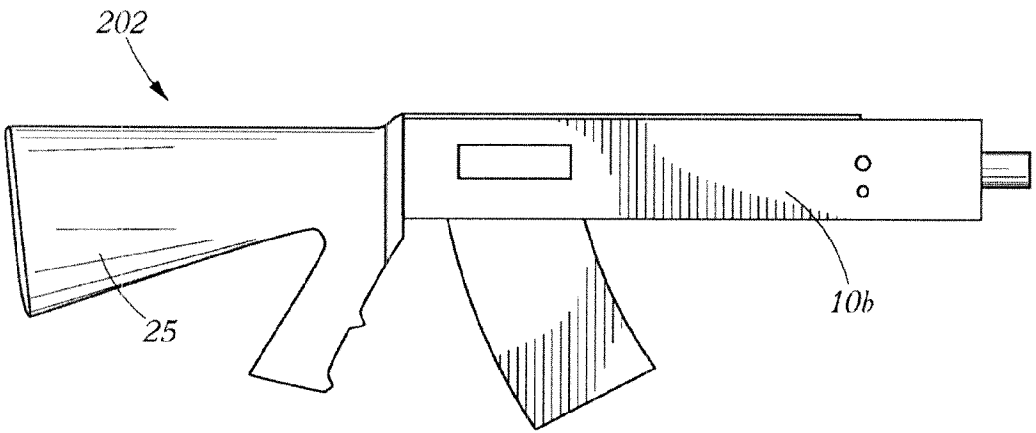

Still further, the frame 12 may also provide a structure, means and/or method for mounting the firearm 10 described herein (see e.g., FIGS. 1A-7B) to either a buttstock 25 or another weapon 201 (see description relative to FIGS. 8A and 8B). In such embodiments, where the frame 12 may provide an attachment point or points to a primary firearm, if used, this can thus provide that firearm 10 may be adapted to be attached as a secondary firearm 10*a* to a primary weapon 201 in a combined weapons system 200, see FIG. 8A. As such, the bolt 14 in the secondary firearm 10*a* may be held relatively stationary with respect to the primary weapon 201 through the fixed connection of the frame 12 thereto, while the underslung secondary weapon 10*a* is cycled for loading and unloading, etc. This would generally also allow for the force of the discharge to be distributed to and through the primary weapon 201 in such a configuration. As such the force is first transferred to the bolt 14 and from there to the frame 12 to which it is connected and from the frame 12 thence to the primary weapon 201 via the top bar or rail 22 connection thereto, and ultimately to the buttstock 25*a*. Alternatively, as shown in FIG. 8B, the firearm 10 as a stand-alone firearm 10*b* may be connected directly to a buttstock or stock 25 for use as stand-alone weapon 202. In either case the force of the discharge may ultimately be distributed to and through the shoulder stock 25 here, as it was in/to the buttstock or stock 25*a* of the integrated embodiment of FIG. 8A. The steady point or even line (or surface or rail) for attachment of the frame 12, and thereby the entire firearm 10, to a primary weapon 201, may, for example, be on and/or along the top bar or rail 22. In such a connection, the top bar 22 may be adapted for bolting or other secure connections, or more preferably to incorporate or accommodate a particular mounting rail or like apparatus, as for example, what is sometimes known as a "picatinny" rail (a US military specification connection device developed at the Picatinny Arsenal, New Jersey, USA) which could cooperate with a mating receiving groove in/on the primary weapon 201. Alternatively, the top rail 22 or the back bar 24 or an extra depending back bar 24*a* (see FIGS. 2 and 3A), or the like, could be used as a steady point or surface or rail for attachment to a shoulder stock 25, see FIG. 8B, or a pistol grip (alone or together with a shoulder stock) or other support member or stand (e.g., tripod) for stand-alone use if desired. The frame 12 may not only provide attachment positions or sites for mounting to another weapon, stock assembly, or the like, but may also be used for mounting other elements to the firearm 10 such as sights, optics, lights, laser pointers, thermal sights, night vision devices, supports, stands or slings, for various, non-exclusively listed examples.

In a forward sliding implementation as described thus far, the forward sliding portions of the forwardly movable assembly 15 of the firearm 10 should perform or allow for the performance of numerous functions, among these being: moving forward and back, locking with and unlocking from the bolt 14, cocking the striker/hammer 71, extracting the expended case, stripping a new round of shells 19 from the magazine 20 and loading it in the barrel assembly 16, and engaging and again locking with or relative to the bolt 14. This is in comparison with, and contrast to, the standard conventional pump action shotgun wherein the pump action is cycled by "pumping" the forearm after a shot is fired. The conventional pump forearm is connected to the breech bolt by rods called "action bars." These action bars cause the former bolt to move with the forearm, performing the seven steps of operation (see below) during the two motions to pumping a conventional shotgun. First, the prior forearm is pulled rearwardly, e.g., straight to the rear. This initially unlocks the bolt, then extracts and ejects the fired shell, and cocks the hammer as the bolt moves rearward. Then, when the conventional forearm reaches the end of its rearward stroke, it is pushed in the opposite direction, straight forward. It pulls the bolt with it, until the bolt once again locks in the fully forward position. During its return forward motion the bolt picks up a fresh shell from the magazine, pushes it into the chamber and locks it into place in battery. The conventional pump shotgun is then ready for another shot.

Sometimes conventionally referred to as the "seven steps" of operation, these are summarized herein: 1. FIRING—Pulling the trigger releases the hammer or striker and fires the shell in the chamber. Note, the breech is securely locked closed during firing. 2. UNLOCKING & PRIMARY EXTRACTION—After firing, the first operation is to unlock the breech. Autoloaders do this by means of gas pressure and an operating rod; other actions do this by manual movement of a bolt handle, slide handle, etc. In addition, the empty case left behind must be loosened from the chamber walls—this is called primary extraction, and it is accomplished mechanically as the action is unlocked. 3. EXTRACTION—The case or cartridge casing is partially or fully removed from the chamber. 4. EJECTION—After extraction the casing is removed from the gun; it is either lifted out by hand or thrown out by an ejector. 5. COCKING—The hammer or striker spring is compressed as the hammer/striker is drawn back, and then held back by the sear; which then establishes that the hammer/striker is cocked. 6. FEEDING—A fresh cartridge is chambered, either by hand, or by the forward travel of the breech-block (bolt). 7. LOCKING—The breech-block is locked closed, and the gun is ready to fire again.

The firearm 10 hereof also allows for the performance of all of these seven steps, but does so in a different manner than the conventional shotgun. Many of these are shown at least schematically in FIGS. 6A-6B. Here, the pump action is cycled by "pumping" the forwardly movable assembly 15 (also sometimes referred to as the "action") forwardly after a shot is fired (see movement from FIGS. 6A to 6B and see the arrow(s) 59 of forward movement in FIG. 6B). The conventional shotgun was first cycled rearwardly. The breech bolt 14 of the present firearm 10 is retained to the rear by the firearm frame 12, e.g., the bolt 14 remains relatively stationary (FIGS. 1B and 6B). The conventional shotgun bolt moves backward with the pump action. The relative motion between the breech bolt 14 and the forwardly movable assembly 15 of the present firearm 10 perform the seven steps of operation (except for the actual firing of the gun). Though there may be some similarities to a standard pump shotgun, there are two opposing motions to pumping the firearm 10 hereof. First, the forearm 17 and the forwardly movable assembly 15 of the present invention are pushed or slid straight forward. This initially unlocks the bolt 14, then extracts and ejects the spent shell 19*a* (FIG. 6B), and cocks the striker (see further below) as the forwardly movable assembly 15 moves forward. This action also pulls forward the other parts of the main firearm 10 of the forwardly movable assembly 15 consisting of the external receiver structure 18, magazine 20, barrel assembly 16 (FIG. 6B), and the forwardly placed firearm control group 100 (see description below). When the forwardly movable assembly 15 reaches the end of the forward stroke, it is pulled by the operator back in the opposite direction, so that the receiver 18 moves straight back over and/or around the bolt 14. During the rearward travel of the forwardly movable assembly 15, the bolt 14 or another mechanism or tang picks up, e.g., strips a new shell 19*b* from the moving magazine 20, allows for movement thereof from the magazine 20 through the opening 18*c* in the receiver structure 18 and is maintained substantially stationary therewith as the chamber 16*c* engulfs the new shell 19*b*, and finally locks into place in the receiver 18. The bolt 14 is locked into and/or against the breech 16*a* and the firearm 10 is then ready to fire another shot. The movement forward and back will generally be in the opposite direction relative to most standard pump actions. Note, the alternative structure of the magazine 120 of FIGS. 7A and 7B would provide the same effects and may operate otherwise as a conventional tubular magazine might; however, alternative triggering mechanisms may be desired as described further below.

In many preferred embodiments, a substantially conventional and uninterrupted placement of the operator's firing and/or support hands may be provided for in use of a forward sliding arrangement of firearm 10 as shown and described herein. However, to accomplish this, a forwardly placed firearm control group 100 may be disposed in a forward location on the firearm 10 so as to be operated by, or be operable from, the forward supporting hand, be it the right or left hand (see FIGS. 1A, 1B, 5 and 9A, inter alia). The primary benefits of time-saving and reduced error operation are likely results of maintaining the hand placement substantially as conventional for the entire firearm package during all phases of use, and from a consequent ambidextrous operability of the firearm 10 from the forearm support hand.

Figure 9A:
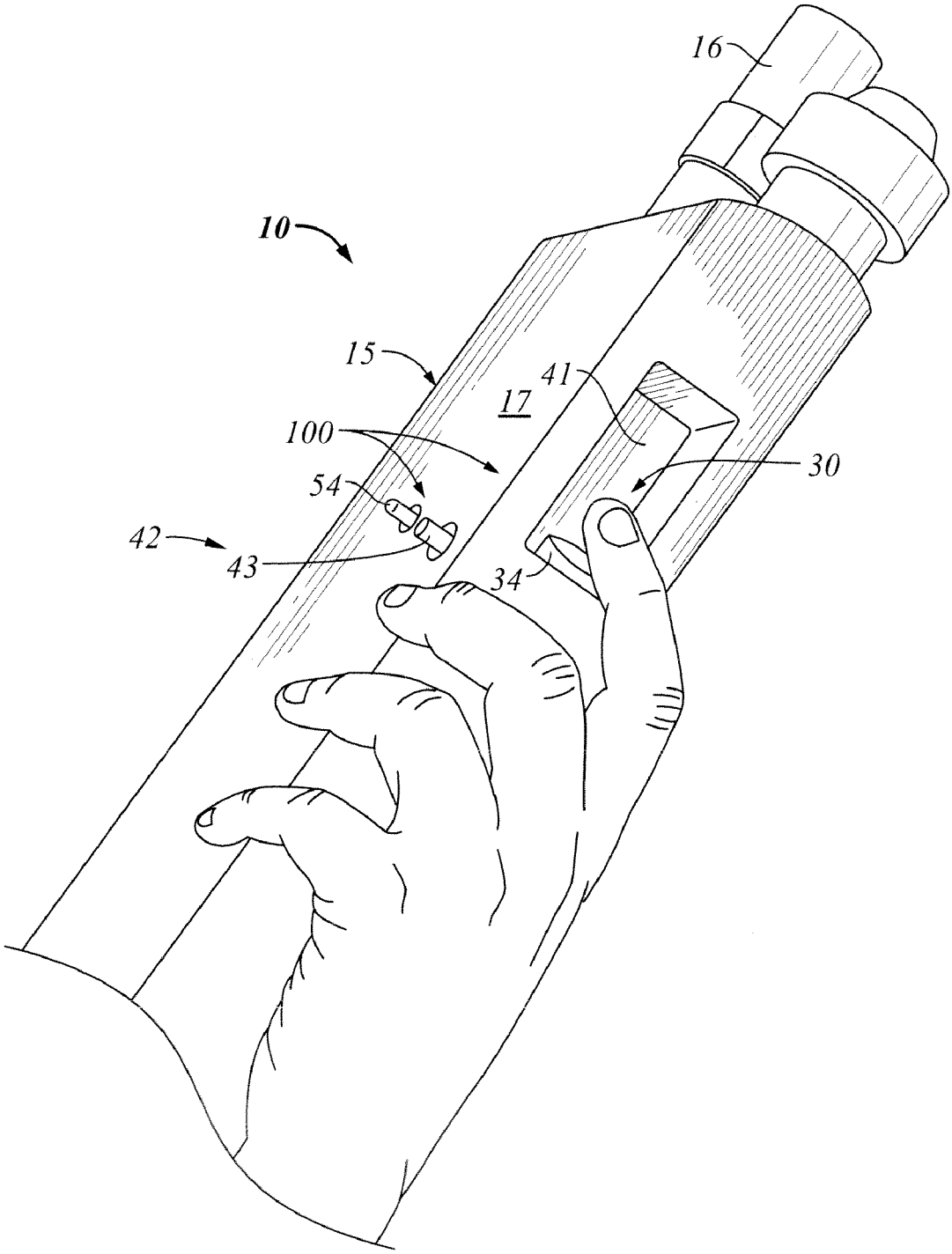
FIGS. 9A, 9B, 9C, 9D and 9E, provide respective isometric and elevational views of a firearm and a trigger assembly hereof being engaged by an operator's support hand.
Figure 9B:
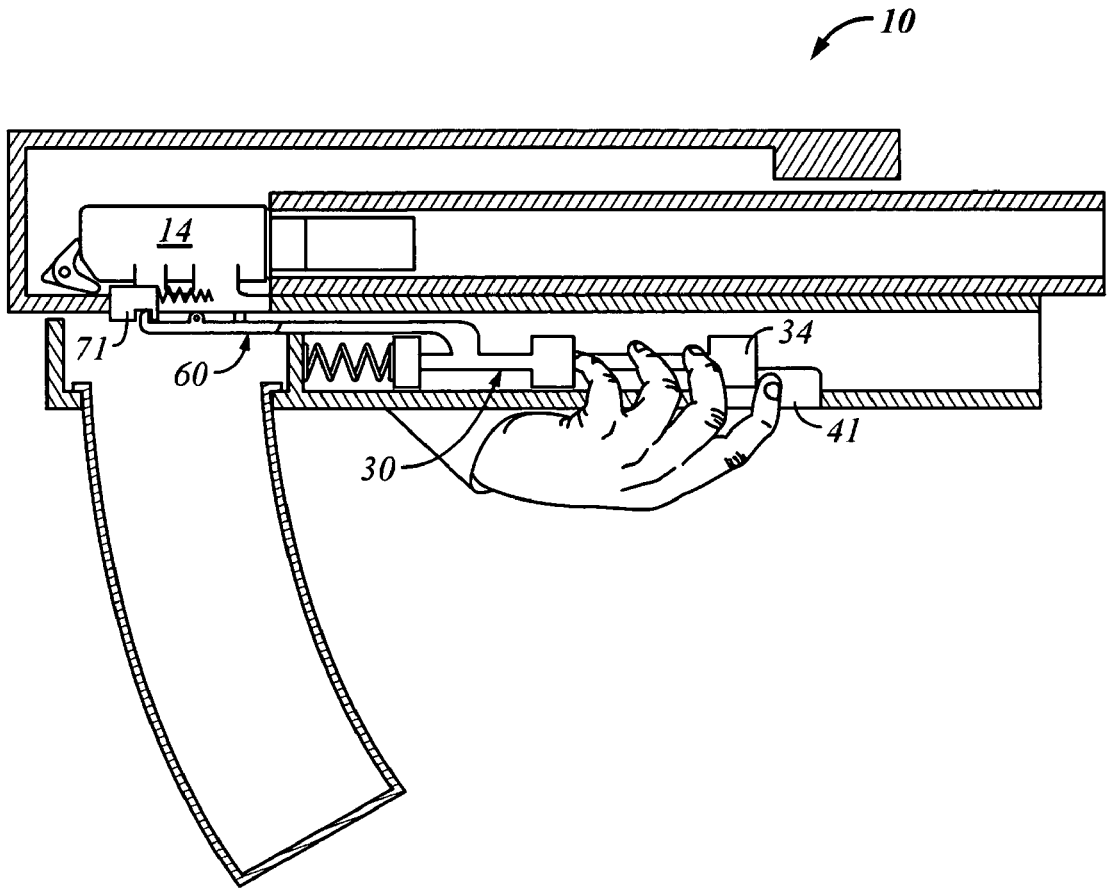
Figure 9C:
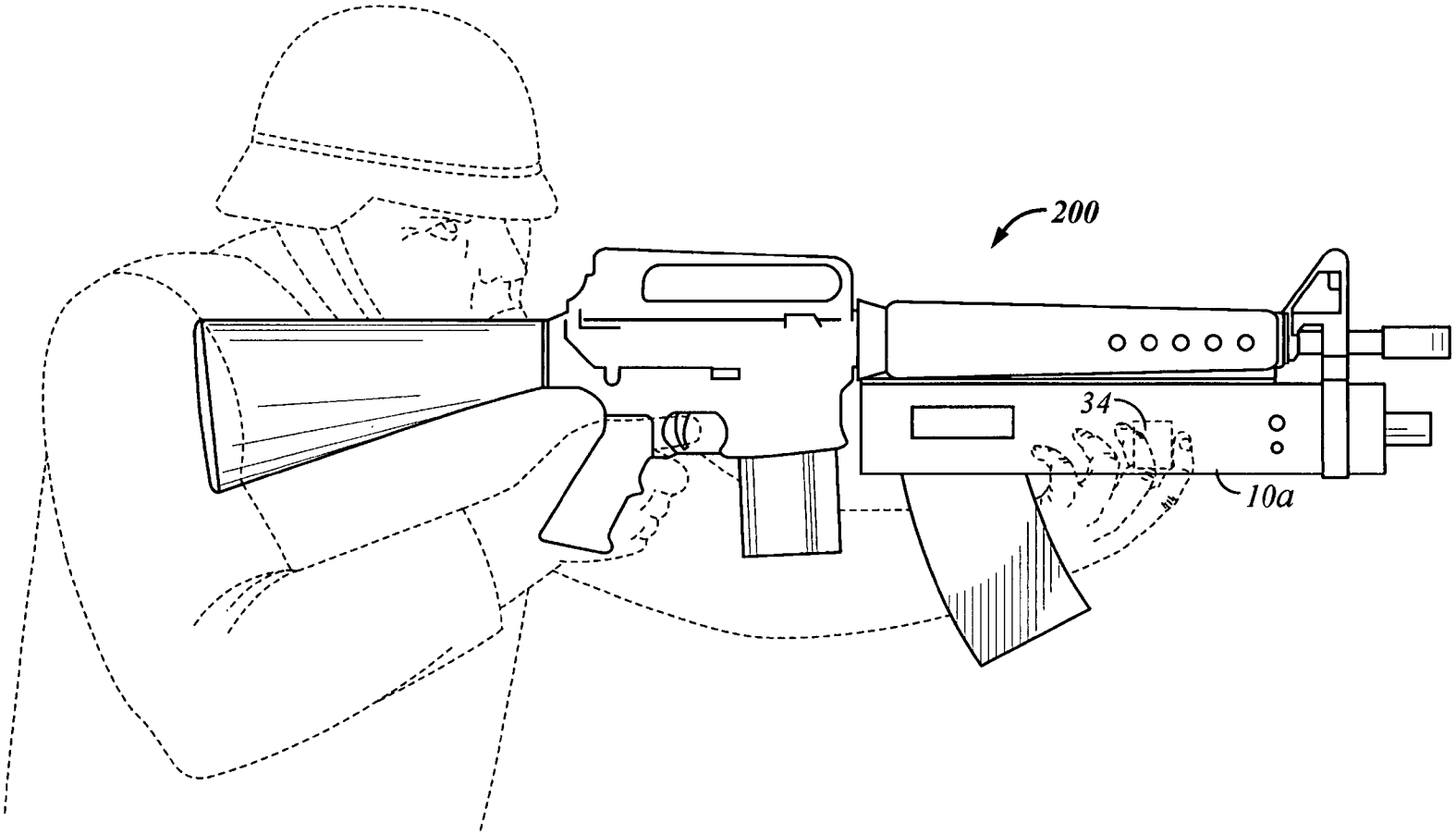
Figure 9D:
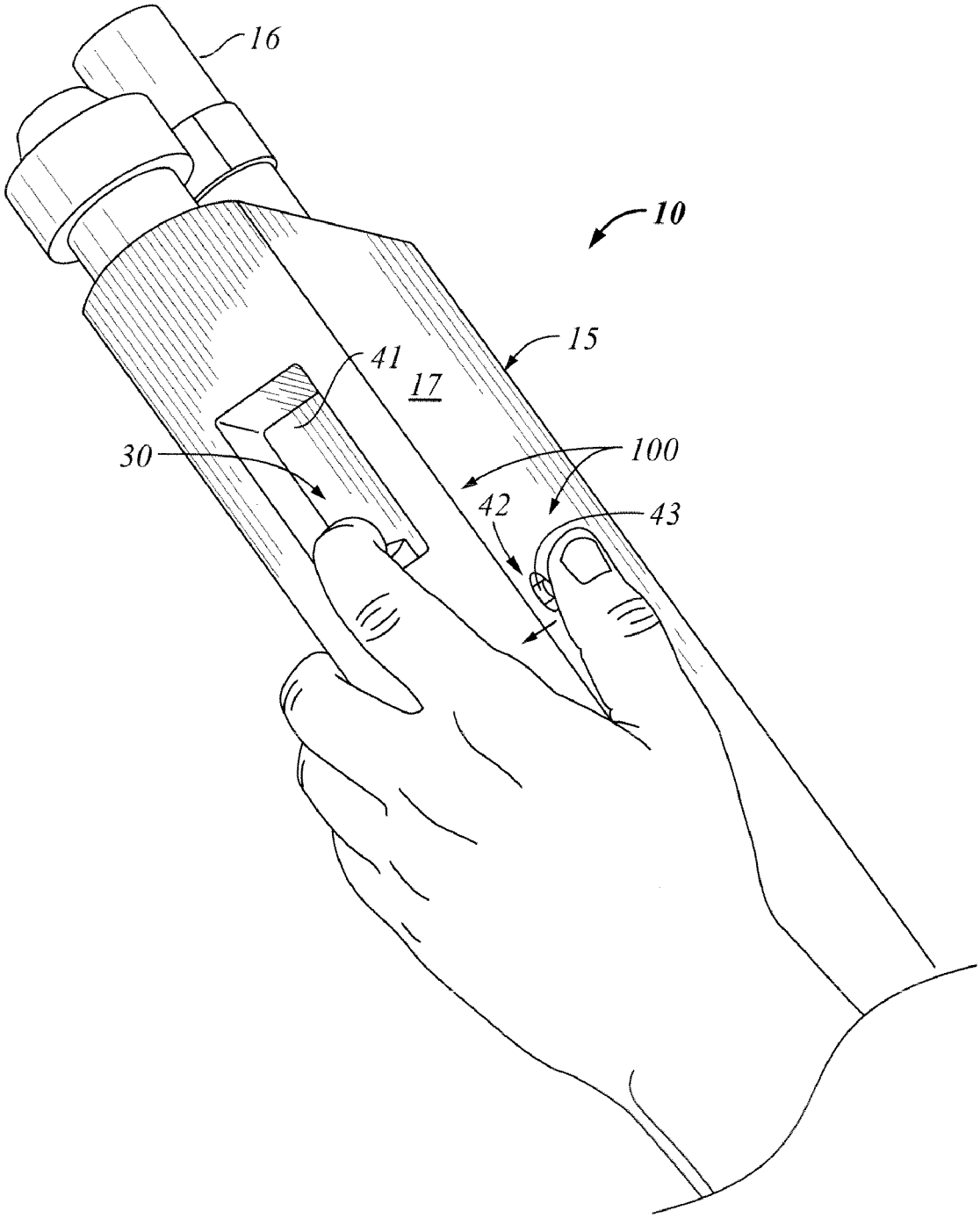
Figure 9E:
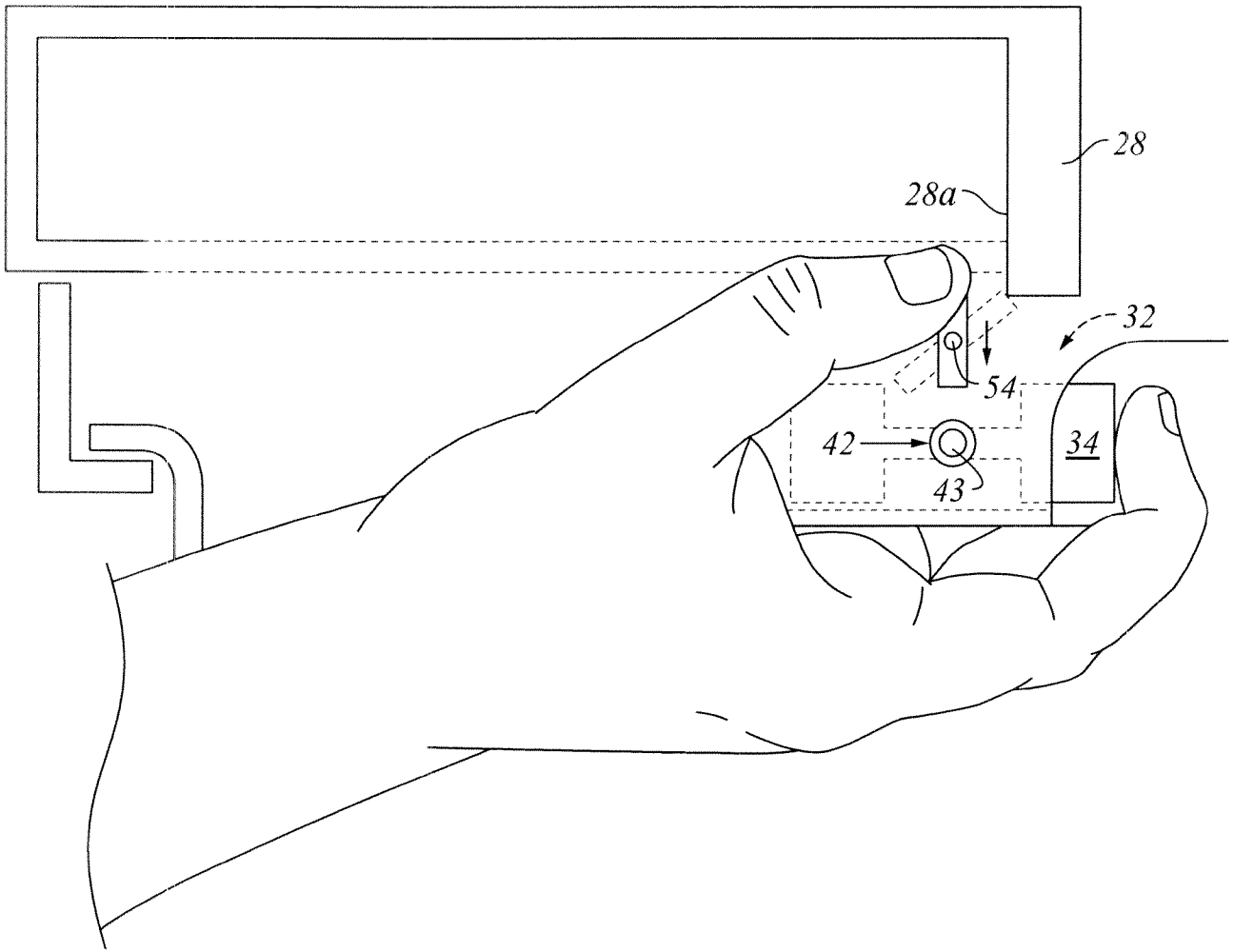

In moving the forwardly placed firearm control group 100 to a forward location on the firearm 10, the trigger assembly 30 which would generally be a part hereof, may, as introduced above (see FIG. 5), be shrouded or at least partially shrouded into or within the underside of the hand guard portion 17*a* and/or the forearm 17 of the firearm 10 (see also FIG. 9A). As such, the trigger assembly 30 may in some embodiments be located inside the forearm 17 where or near where the tube magazine may often have been on a conventional pump shotgun. This is in contrast to many conventional firearm triggers which typically have included an external lever, mounted on the stationary firearm receiver most often, with a sort of exception for those of the "bullpup" design, behind the barrel breech, all of which apparently are still intended to be operated by the shooter's master hand. Current FIGS. 9A, 9B and 9C show how an operator's fingers might be used to engage the shrouded trigger assembly 30 hereof, gripping the longitudinal forestock 17 with the support hand, not the master hand, in a substantially conventional support hand position.

Figure 10:
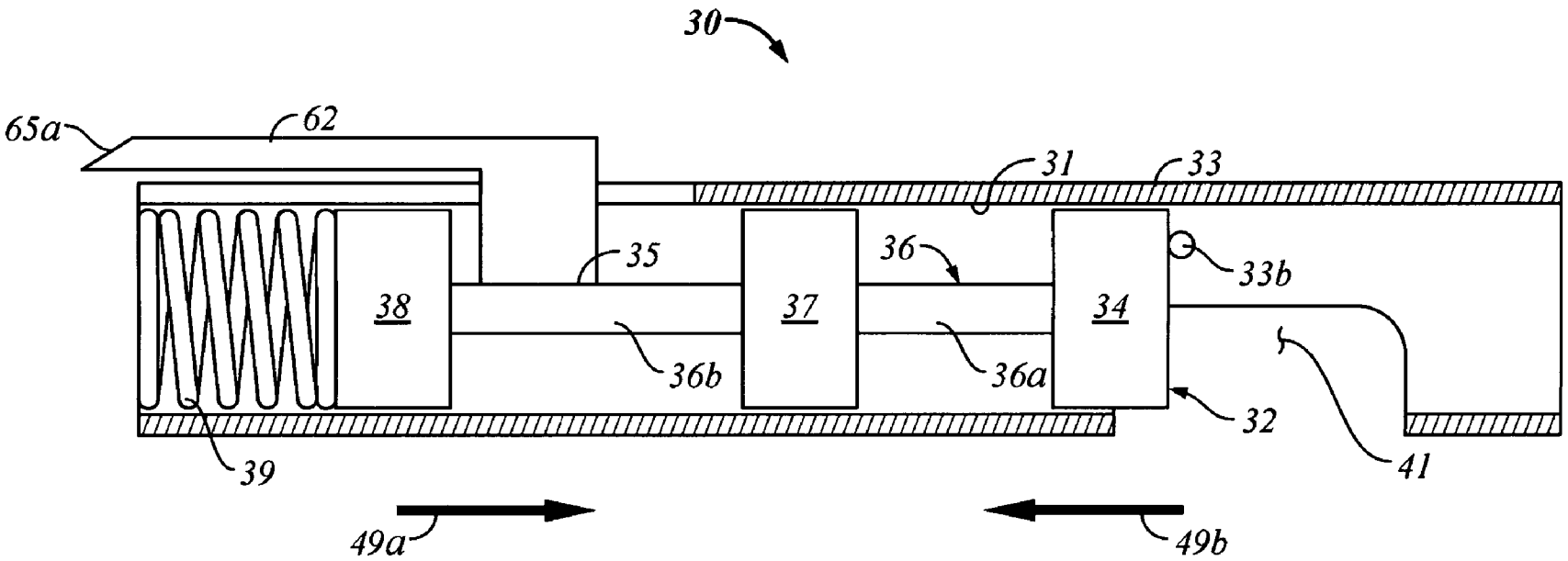
FIG. 10 shows a cross-sectional view of a trigger assembly of the present invention.
Figure 12:
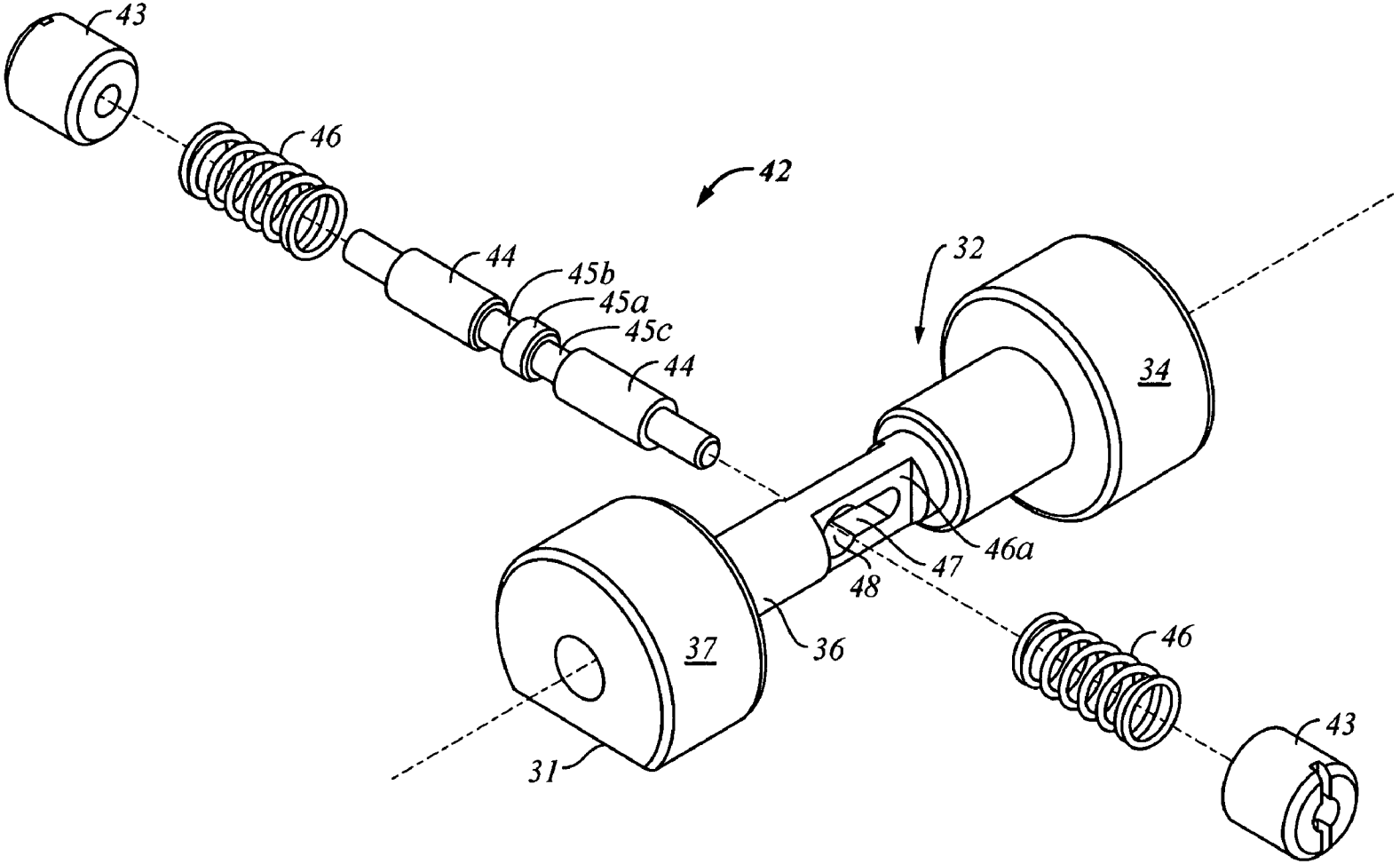
FIG. 12 is an enlarged isometric, exploded view of a trigger and safety assembly as shown, for example, in FIGS. 9, 10 and/or 11.

Shown next in FIG. 10 is an illustration of one representative trigger assembly 30 in some preferred embodiments including a translationally movable trigger mechanism 32 longitudinally disposed within or at least partially within the forestock 17 to provide for operation while gripping the firearm in a substantially conventional support hand fashion. Trigger mechanism 32 may include a trigger depression member or button 34 and an elongated trigger member or connector or as it may also be referred to herein as a trigger rod or shaft 36 which may be unitary or may come in plural parts, see, e.g., the rod portions 36*a* and 36*b* as shown, the latter being connected with a sear link 62 (see the further detailed description of an exemplary sear assembly 60, below). Further connected to and/or otherwise defined as parts of the trigger mechanism 32 may be an optional trigger guide member 37, an extended sear connection portion 35 and/or a spring follower 38 which may be disposed to engage and/or interact with a trigger spring 39. The connection portion 35 may be a part of, or formed in or attached to the secondary rod portion 36*b*. The trigger assembly 30 further includes and/or is defined as disposed within a trigger frame 33, which may be in the form of a cylinder or tube. Note, in cross-section (see, e.g., description relative to FIG. 13), the trigger elements including the trigger frame 33 may take any of numerous shapes such as circular (see FIGS. 2, 3, 12 and/or 13) or rectangular or otherwise. The button 34, trigger guide member 37 and/or follower 38 may each and/or all be considered in some embodiments as a piston or pistons connected by a piston rod 36 moving within the trigger frame or tube 33. The trigger mechanism 32 and assembly 30 may have what may thus be referred to as a piston in a tube configuration.

The trigger frame or tube 33 includes a substantially bottom or underside finger recess or opening 41 defined therein which is designed or adapted to accommodate or receive the user's finger or fingers. The trigger mechanism 32 and assembly 30 may thus be adapted to have an ambidextrous capability for activation by virtue of such a bottom access for the trigger or firing finger or fingers of the user's support hand as shown for example in FIG. 9A. A slot, or as shown herein, a shaped guide surface 31 (see the isometric of FIG. 12 and/or the cross-section(s) of FIG. 13) may be formed in at least a portion of the trigger mechanism 32, through which it may coact with a cooperatively shaped formation 33*a* in/on the trigger frame 33 to ensure the smooth sliding, non-rotational operation of the trigger mechanism 32, as will be briefly described relative to FIGS. 11-13, below. Surface 31 is shown flat in FIG. 12 and triangular in FIG. 13. A triangular cooperative formation 33*a* is also shown in FIG. 13.

Figure 11:
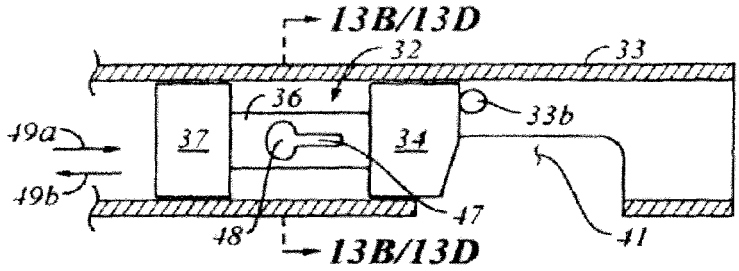
FIG. 11 shows a cross-sectional view of a portion of another trigger assembly with a safety cutout.

The trigger mechanism 32 is adapted for or is capable of sliding translationally or linearly in a piston-like fashion within the trigger frame 33 forwardly to its rest position shown in FIGS. 10 and 11 of the drawings, and backwardly to an activation/triggering position. The forward direction is identified by an arrow having a reference numeral 49*a*, and the counter direction moved through and to during triggering is identified by an arrow having the designation 49*b*. In normal, pre-activation conditions, the trigger mechanism 32 is under spring pressure from spring 39 and is thus urged or biased forwardly (arrow 49*a*) to rest and/or be maintained in the forward position shown in FIGS. 10 and 11 of the drawings. A stop member 33*b* or the like may be used to halt or prevent any further forward motion of the trigger mechanism 32 when the trigger button 34 comes into abutting contact therewith. The spring 39 and the stop member 33*b* thereby cooperate to define the at-rest or resting position of the movable trigger mechanism 32. When the user is ready to activate the gun, the user's finger is placed in the finger recess or opening 41 on the trigger button 34 (see FIG. 9), and the trigger mechanism 32 is pulled back from the at-rest position in the direction of arrow 49*b*. As the trigger mechanism 32 moves back, the sear link 62 comes into contact with and/or moves from resting contact with sear lever 61 to activate the sear assembly 60 to actuate the hammer assembly 70 and the operational parts of the firing pin assembly 80 as described in more detail below (see FIGS. 19 and 20).

As suggested above, the trigger assembly 30 may further be a solitary member of or a component part of a larger group of forwardly placed firearm control group 100. According hereto, the forwardly placed firearm control group 100, including the trigger assembly 30, may be incorporated into the forearm or forestock 17 of a weapon, such that the trigger mechanism 32 is a shrouded piston, placed such that it can be depressed by the triggering finger or other digit of the hand supporting the forestock 17 of the firearm 10, with that hand in a substantially and relatively normal forestock supporting position (see again, FIGS. 9A, 9B and 9E). The trigger mechanism 32 would preferably be placed in a position allowing operation of the secondary firearm 10*a* by the operator's support hand, preferably also being capable of ambidextrous operation.

In having the trigger mechanism 32 alternatively working further with and/or as a part of the forwardly placed firearm control group 100, the forwardly placed firearm control group 100 in many preferred embodiments includes a fire safety assembly 40 with a safety 42 and/or in some embodiments also or alternatively a pump action lock and release assembly 50. The forwardly placed firearm control group 100, which hereafter will be described as including the trigger assembly 30 and either a fire safety assembly 40 or a pump action lock and release assembly 50 or both, is, in the primary embodiments, placed forwardly in firearm 10 to or at about the location which would also normally receive the user's support hand. The forwardly placed firearm control group 100 places the elements necessary to fire the firearm 10, minimally the trigger mechanism 32, and optionally the safety 42, or the pump action lock and release assembly 50, if used, in a more forward location than would be the case on a conventional shotgun or rifle. In the presently described and shown embodiments of this adaptation, the forwardly placed firearm control group 100 is placed forward of the breech 16*a*, as opposed to what in many other firearms (except bullpups, for example), would be the disposition of the fire control groups normally to the rear of the breech. The forwardly placed firearm control group 100 in/on the presently described embodiments may then be actuated by the operator's forward hand, including the safety 42 and/or the pump action lock and release assembly 50. This would then be true regardless whether the firearm 10 would be attached as a secondary firearm 10*a* to a primary weapon 201 (FIG. 8A), or to a buttstock 25 as a substantially stand-alone firearm 10*b* in a stand-alone weapon 202 (FIG. 8B) or otherwise. Nonetheless, when used in either a stand-alone weapon 202, or a combined weapons system 200, the operator would then be able to fire any of the weapons without having to reposition either of his/her hands to do so; as for example, when using the combined weapons system 200, he/she could fire either the primary weapon 201 and/or secondary firearm 10*a* without repositioning either of his/her hands. In embodiments of such a combined weapons system 200, alternatives such as are described herein may allow for an operator to, if he/she were to so desire, fire both the primary and the secondary weapons 201, 202, respectively at the same time.

As shown for example in FIG. 5 (see also FIGS. 1A, 1B, 2, 3B and 9A), the safety 42 in the primary embodiments includes one or more exposed button(s) 43 that (is/are) disposed above and often slightly behind the trigger piston face. Such a safety button 43 is preferably exposed on either or both sides of the firearm 10 for ambidextrous operation. As shown also and in more detail in FIGS. 12 and 13A-13D, the safety button or buttons 43 may be interlinked or connected to an actuating cross-bar or rod 44 (FIG. 13A) which is interactive with and operably and substantially orthogonally disposed or received within and passed through an elongated aperture 48 defined in the trigger actuating rod 36 of the trigger mechanism 32 (see FIGS. 11 and 12). A flattened portion or surface 46*a* may be formed on the rod 36 on and around the aperture 48 to provide a spring surface for interaction with spring(s) 46 and prevent fouling thereof.

Figure 13A:
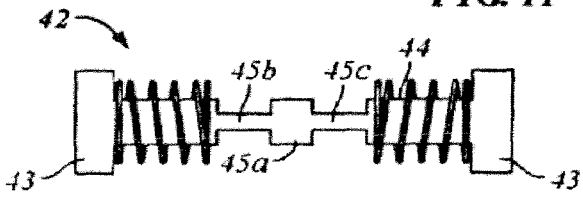
FIGS. 13A, 13B, 13C, 13D and 13E depict a set of elevational views, the latter four of which are partly in cross-section, of portions of a trigger assembly and a safety assembly, as could be taken along lines 13B/D-13B/D of FIG. 11, and respective lines 13B-13B; 13C-13C, 13D-13D and 13E-13E of corresponding FIGS. 13C, 13B, 13E and 13D.
Figure 13B:
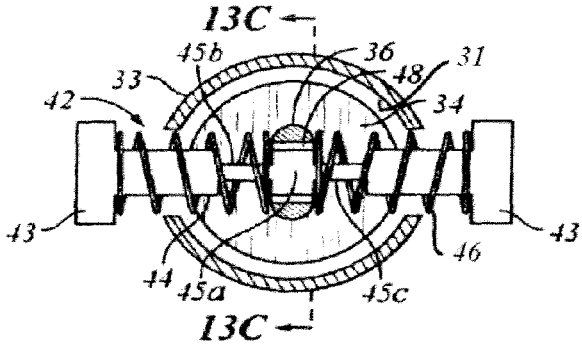
Figure 13C:
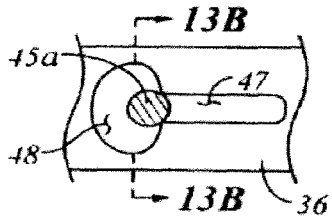

As shown in FIGS. 13B and 13C, the safety actuating cross-bar or rod 44 is received within and is passed through the aperture or keyhole 48. The cross-bar 44 has features 45 which may be viewed as a central obstruction 45*a* and/or as two reduced areas or cutouts 45*b* and 45*c* disposed along the length thereof between the buttons 43 (see FIGS. 13A, 13B and 13D). Similarly, a reduced area or restriction 47 is defined in the keyhole 48 in the piston shaft 36, the obstruction 45*a* being sized so that it is too large to pass into or through the restriction 47 (FIGS. 11, 13C and 13E). And, the cutouts 45*b* and 45*c* in the safety cross-bar 44 are sized such that they may be allowed to line up with and pass into the restriction 47 in the keyhole 48. Movement of the trigger mechanism 32 may thus be restricted by the obstruction 45*a* when it is aligned with the restriction 47 (FIGS. 13B and 13C); and movement of the trigger mechanism 32 may be allowed when either cutout 45*b* or 45*c* is aligned with the restriction 47 (FIGS. 13D and 13E).

Figure 13D:
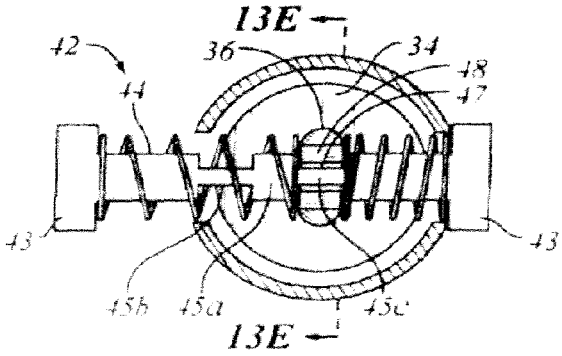
Figure 13E:
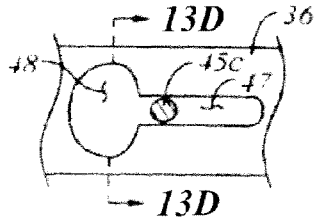

Pressing either one or the other of safety buttons 43 then moves the respective cutout 45*b* or 45*c* in the safety cross-bar 44 to line up with the restriction 47 in the keyhole 48 (FIGS. 13D and 13E). Subsequently pressing/pulling the trigger mechanism 32 will provide for moving the attached sear link 62 (see description below) to engage the sear lever 61 (below) and fire the firearm 10 as described herein.

The cross-bar 44 is preferably spring loaded and/or spring centered about the piston shaft 36 by the inclusion of springs 46 on either side of the obstruction 45*a*. These springs 46 would then bias the trigger safety cross-bar 44 toward the central position where the obstruction 45*a* is disposed to block movement of the trigger mechanism 32 by being aligned with the restriction 47 (see FIG. 13B). As shown and described herein, the operator would need to depress and maintain depressed one or the other of the buttons 43 to align either cutout 45*b* or 45*c* with the restriction 47 and to thereby deactivate the safety 42 and consequently also allow for movement of the trigger mechanism 32 and the consequent firing of the firearm 10. The manipulation of the button(s) 43 can be by the operator using a thumb or finger, e.g., digit, preferably of the support hand without having to move that hand, or preferably at most, a merely slight movement of the thumb or finger thereto, and thereof in the safety release maneuver. An exemplary manipulation according hereto is shown by the user's thumb in FIG. 9D. As shown for example in FIG. 9A, inter alia, the button(s) 43 can be extended out from the interior of the forestock 17 for easing these or like maneuvers. This provides a very secure safety operation, particularly in the forced maintenance of thumb or finger activation of the respective safety button 43, which may also be known as an active safety, in that the safety 42 cannot accidentally be bumped or otherwise temporarily depressed and remain deactivated after release. This may be accomplished using different fingers or the thumb from the same hand which is used to support and finger the trigger. One achievement herein may be in the provision of forced occupation of substantially all fingers in a rearward position relative to the end of the barrel assembly 16 adjacent the trigger depression member or button 34 to prevent stray fingers or thumbs, e.g., digits, being disposed up near the discharge from the barrel assembly 16 (either the primary or secondary weapon barrel). Nevertheless, other mechanisms may be substituted or added hereto which may allow for single depression and substantially automatic maintenance of the depressed active position after release of one or the other of the buttons 43 (push once and it stays pushed), and thereby provide for a consequent maintained deactivation of the safety. This could also be coupled with a mechanism to reactivate the safety after a firing, thus requiring a subsequent depression of the safety button 43.

Figure 14B:
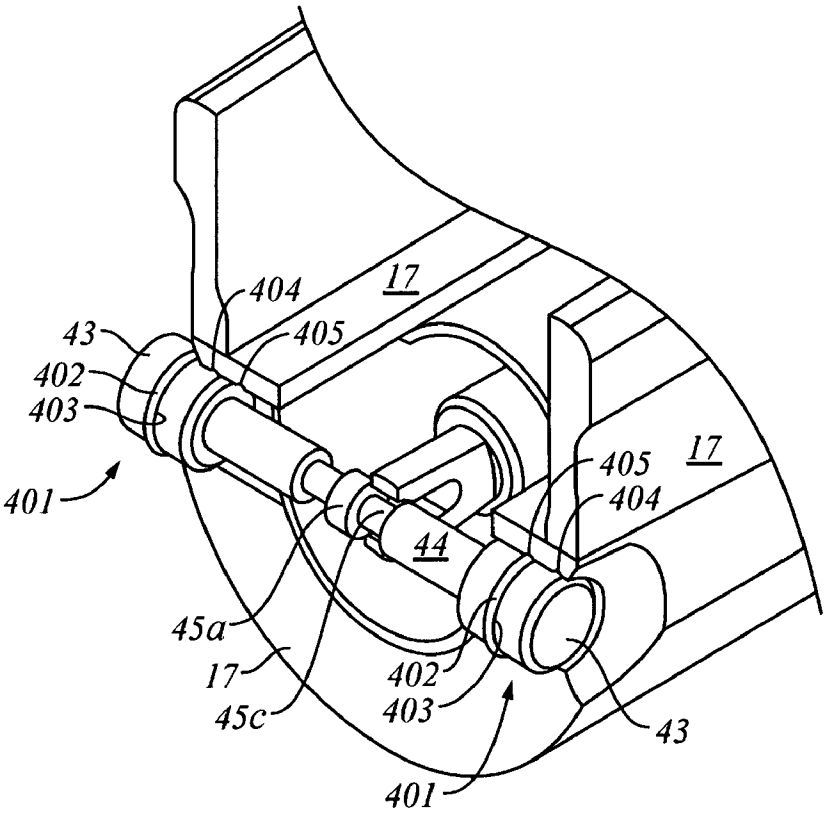
FIGS. 14A and 14B depict a set of partially cut-away isometric views of a safety assembly in respective safe and fire positions.
Figure 14A:
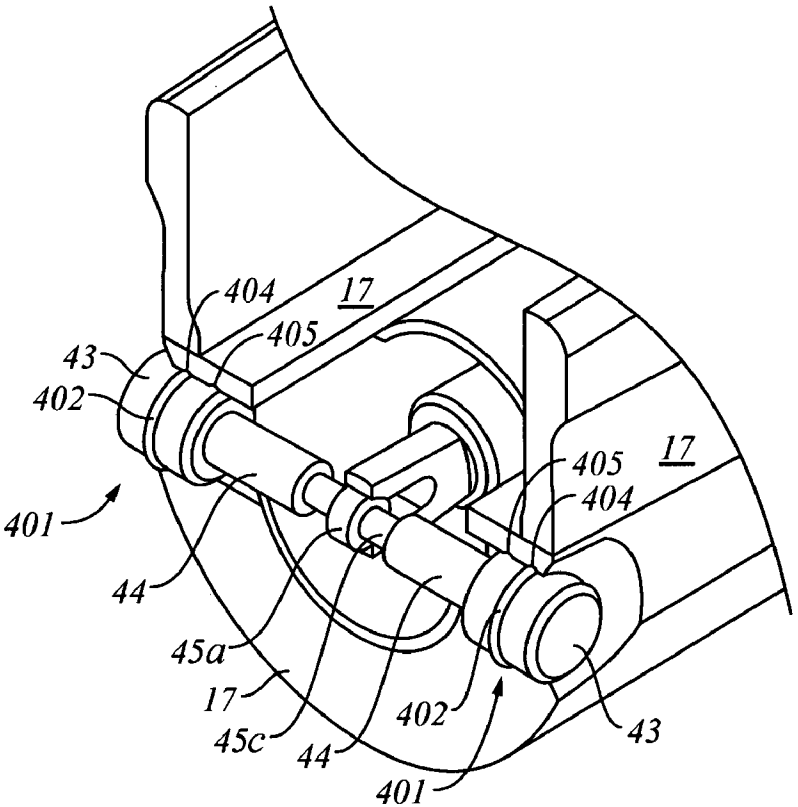

Alternatively, a version of the safety assembly 40 may have a safety detent, generally identified with numeral 401 in FIGS. 14A and 14B, to "temporarily" hold or set the safety either in a "fire" or "safe" position so that an operator would not have to activate the fire safety assembly 40 every time that he/she wants to fire the firearm 10. Such a feature may incorporate elements similar to those in conventional firearms, and/or may be as shown in FIGS. 14A and 14B wherein a spring ring 402 may be installed in/on either one or each of both safety buttons 43, the spring ring(s) 402 being alternately compressible often to a position within a groove or other depression 403 in the button(s) 43 and resiliently expandable to a disposition out of and/or at least somewhat wider than the button(s) 43. The ring(s) 402 would thus, then be expandable into one or more corresponding receiving openings such as either of the grooves 404, 405 shown formed in the forestock 17 in FIGS. 14A and 14B. A first such groove 404 may receive the corresponding expanding spring ring 402 and hold the safety in the "safe" position (obstruction 45*a* positioned in the enlarged portion of the keyhole 48 of the trigger shaft 36; see FIG. 14A), and the second groove 405 may, subsequent to depression of the button 43 receive the spring ring 402 and thereby hold the safety in the "fire" position (cutout 45*c* positioned in and/or aligned with the restriction 47 of the keyhole 48 of the trigger shaft 36; see FIG. 14B). Thus, the button 43 can be manipulated to move the safety cross-bar 44 from "safe" to "fire" and back, and the spring ring(s) 402 can hold the safety cross-bar 44 in the corresponding position(s) without requiring continued depression of the safety button 43 by the operator. The grooves 404, 405, may in some embodiments be formed simply by machining a groove into the safety button or buttons 43 and two grooves 404, 405 in the forestock 17, and installing a spring ring onto the safety button 43; see FIGS. 14A and 14B.

Moreover, a further "safety" may also be incorporated herein where the piston trigger mechanism 32 may be further interlocked with the weapon's pump action lock and release assembly 50 (see detailed description of the pump action lock and release assembly 50 below). As will be described in the following (see FIGS. 16A-17D), this further safety is provided by a tang 58 of the pump action lock and release assembly 50 and is interactive with the trigger mechanism 32 such that first the trigger cannot be depressed/pulled if the forwardly movable assembly 15 is unlocked and movable, and second, the forwardly movable assembly 15 cannot be released if the trigger mechanism 32 is depressed/pulled, and third such that the forwardly movable assembly 15 cannot lock if the trigger mechanism 32 is depressed/pulled. These safety positions are described in further detail below.

As introduced above, another optional feature which may also be a member of the forwardly placed firearm control group 100 is the pump action lock and release assembly 50. A principal function of the pump action lock and release assembly 50 may be in its action to lock and unlock movement of the forwardly movable assembly 15 (herein including the pump action 21 and the forearm 17, see FIG. 1). In a first position, the pump action lock and release assembly 50 locks the forwardly movable assembly 15 so that it cannot move when pump action lock and release assembly system 50 is engaged; making the breech 16*a* of the barrel assembly 16 locked/maintained closed in battery with the bolt 14 (secure locking thereof being provided by the bolt lug 14*b* and a cooperative receiving lug notch, catch or groove defined in the barrel assembly 16 or barrel extension 16*b* or receiver 18), and thus making the firearm 10 locked in a safe position to fire. In an alternate position, the pump action lock and release assembly 50 may be maneuvered to unlock the forwardly movable assembly 15 so that the forwardly movable assembly 15 may then be slid or pumped forward and back to cycle the firearm 10. Pump action lock and release assembly 50 may thus be disengaged.

Figure 15A:
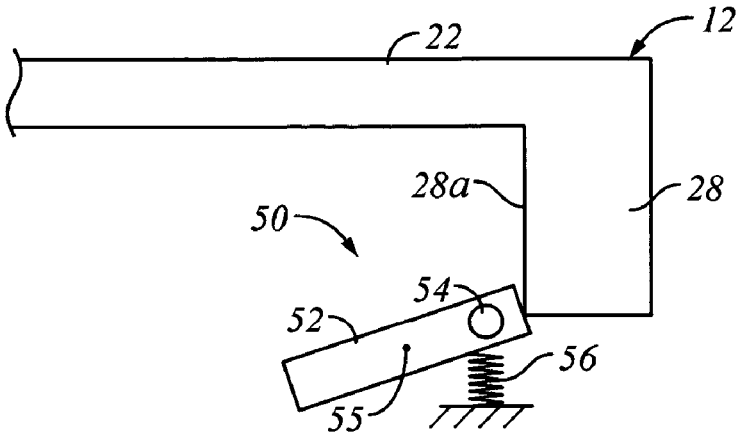
FIGS. 15A, 15B and 15C depict respective elevational and isometric views of an action release portion of a fire control group hereof in engagement with a cut-away portion of a firearm frame hereof.
Figure 15B:
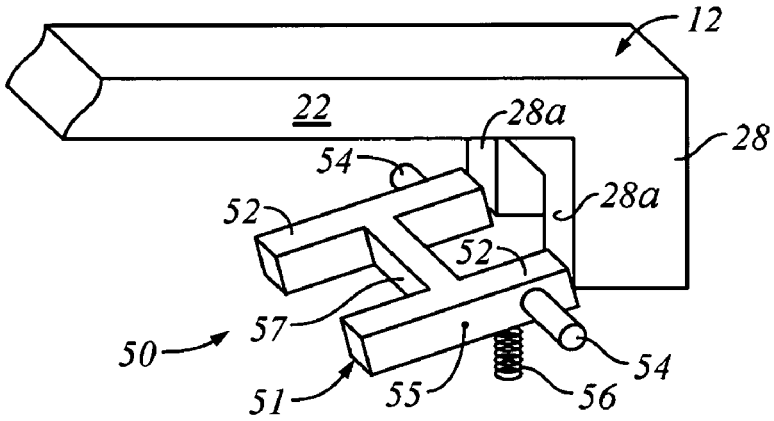
Figure 15C:
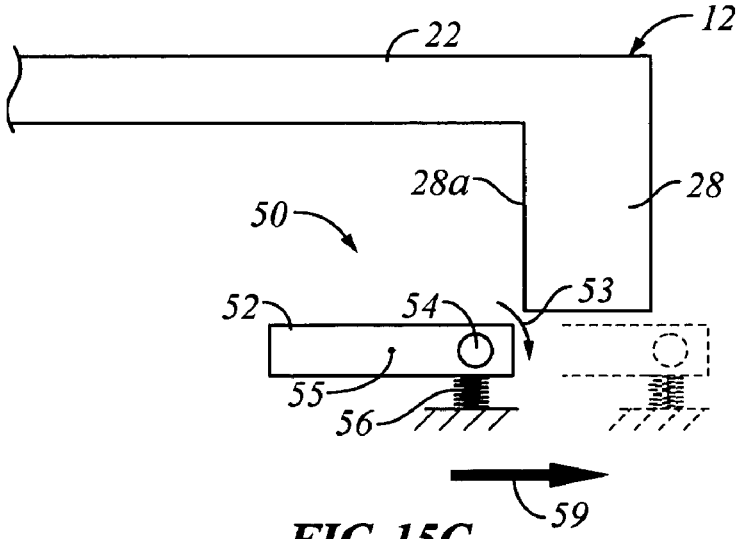

The pump action lock and release assembly 50 may include as shown in FIGS. 15A, 15B and 15C, an action stop and/or release bar 52 and at least one extending knob 54 which can be used to move the action stop and/or release bar 52. The action stop and/or release bar 52 is pivotally connected at pivot point/axis 55 to or adjacent the trigger tube 33 or another member or structure of the forwardly movable assembly 15. The action stop and/or release bar 52 may also be biased, as by spring 56 into an upright, locked position as shown in FIGS. 15A and 15B where the release bar 52 is in engagement with the inner surface 28*a* of the frame member 28 of the frame 12, herein at the bottom of the inner surface 28*a*. When engaged thus, the forwardly movable assembly 15 is locked in closed position and not movable relative to the frame 12 or stationary assembly 11. The release bar 52 may be active as a solo piece or may, as shown better in FIG. 15B, be part of a bail 51 or like structure such that two (or more, or less) release bars 52 may be used to each engage the respective inner surfaces 28*a* of respective legs of the frontal portion of frame member 28 of the frame 12. These action stops 52 may be joined by a cross-bar 57 and each may have corresponding knobs 54 to make the release system activatable from either side of the forearm 17. The disengagement of the action stop(s) 52 are shown in FIG. 15C, wherein the bail 51 is rotated down in the direction of arrow 53 against the bias of the spring 56 by manipulation of the knob(s) 54 until the top of the action stop(s) 52 clear the bottom of the front legs of frame member 28 of the frame 12. Then the forwardly movable assembly 15, of which the pump action lock and release assembly 50, is unlocked and can be moved forwardly, per arrow 59 relative to the frame 12. The manipulation of the knob(s) 54 can be by the operator using a thumb or finger, e.g., a digit, preferably of the support hand without having to move that hand, merely a preferably slight movement of the digit, thumb or finger, thereto, and thereof in the release maneuver. An exemplary manipulation is shown by the user's thumb in FIG. 9E. As shown for example in FIG. 9A, inter alia, the knob(s) 54 can be extended out from the interior of the forestock 17 for easing these or like maneuvers.

Figure 16A:
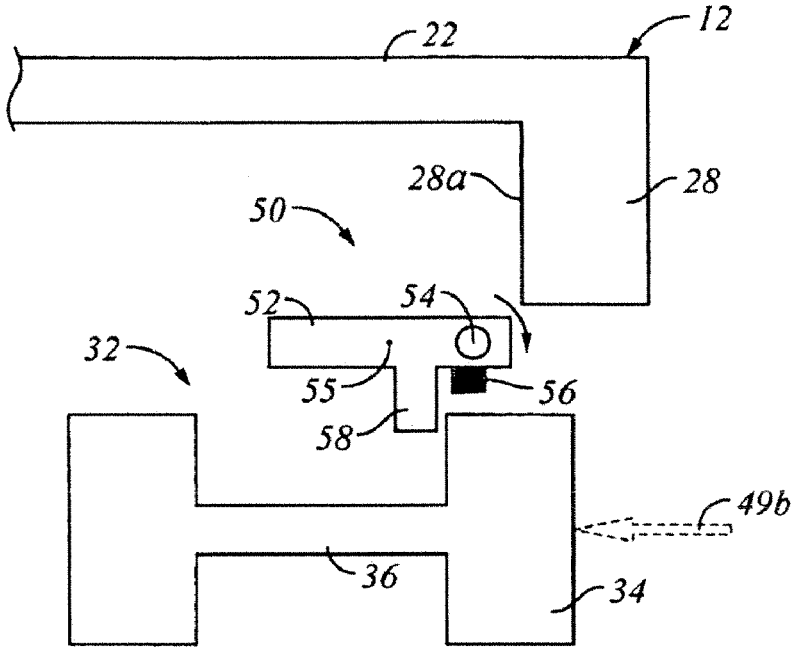
FIGS. 16A and 16B show an action release portion of a fire control group similar to that in FIG. 15, in engagement with a portion of an exemplary trigger assembly hereof.

As introduced above, a tang 58 may be disposed on the lower side of the bail 51 and can be used as shown in FIGS. 16A-17D to provide three locking positions of the trigger mechanism 32 or the forwardly movable assembly 15 relative to each other. First, as will be described relative to the first embodiment of FIG. 16, there is the position of the locking of the trigger mechanism 32 so that it can neither move nor operate, e.g., cannot perform a triggering motion back as along the arrow 49*b* (see the dashed line arrow 49*b* in FIG. 16A indicating lack of ability to move in that direction), while the forwardly movable assembly 15 is held in an unlocked position and thus movable or moving (though in the embodiment shown, the bail 51 would continue to be held down against the bias of spring(s) 56 (either by continued hand manipulation of knob(s) 54, or otherwise) in order to maintain the trigger lock position shown in FIG. 16A). The unlocked action of the forwardly movable assembly 15 is described immediately above, and may result from the manipulation of the action release stop knob(s) 54 downwardly for the action stop(s) 52 to clear the frame member(s) 28. Note, generally there will not be a need or desire to hold the knob(s) 54 in the down position once the bail stops clear the inner surface(s) 28*a* of the frame 12 for the rest of the cycle, e.g., a return movement of the action will engage and push down the top surface of the bail 51 against the bias of the spring(s) 56 until the bail 51 again clears the inner surface 28*a* of the frame 12, when not otherwise manipulated, it will spring back into locking position as shown, for example, in FIG. 15A. And second, as shown in FIG. 16B, there are two locking positions of locking the forwardly movable assembly 15 so that it cannot move when the trigger mechanism 32 is moved back. This second operation may include the two options of locking the forwardly movable assembly 15 closed if it is in closed position before the movement of the trigger mechanism 32, and/or oppositely has the action of locking the forwardly movable assembly 15 in open position (e.g., cannot close) if the forwardly movable assembly 15 is in open position before the trigger mechanism 32 is moved back. With more specific reference to the drawings, shown in FIG. 16A is a relatively generic effectuation of locking the trigger mechanism 32 in open, untriggering position during the preliminary unlocking of the forwardly movable assembly 15 by moving the bail 51 with locking release bar(s) 52 down and out of engagement with inner surface(s) 28*a* of the frame 12. Then, in FIG. 16B, the bail 51 with action stops 52 are shown held in upright locking position by the engagement of the bottom of the tang 58 with the top surface of the trigger button 34. The forwardly movable assembly 15 is thus locked in respective positions forward (solid lines) or back (dashed lines) of the trigger button 34. This locks the action in either closed battery, or open, non-battery position whenever the trigger mechanism 32 is depressed/moved back (as indicated by the arrow 49*b*).

FIGS. 17A, 17B, 17C and 17D show an alternative pump action lock and release assembly 50 and a trigger assembly 30 as may be used in any of the firearm(s) hereof. The embodiment here is substantially similar to the embodiments of FIGS. 15A-16B but for the interactions here between the bottom surface 58*a* of tang 58 and a step surface or edge 34*a* on the trigger rod 36. As before, in the action locking position as shown first in FIG. 17A, the release bar 52 of the bail 51 of the pump action lock and release assembly 50 is in action locking contact with the inner surface 28*a* of the front connector of frame member 28 of the frame 12. In first moving from the action locked position (FIG. 17A) to the unlocked position shown in FIG. 17B, the knob 54 is maneuvered downwardly (see FIG. 9E as described above), pivoting about the pivot pin 55 against the bias of spring 56, and release bar 52 clears away from the inner surface 28*a* of frame member 28 so that the forwardly movable assembly 15 can then be moved forwardly as in FIG. 15C. As was the case in FIG. 16A, the tang 58 is then moved into a trigger-blocking position relative to the trigger mechanism 32; however, in the FIG. 17B embodiment, the tang 58 engages a step surface 34*a* instead of the button 34. This then locks the trigger mechanism 32 so that it cannot move in a triggering fashion rearwardly.

Figure 17C:
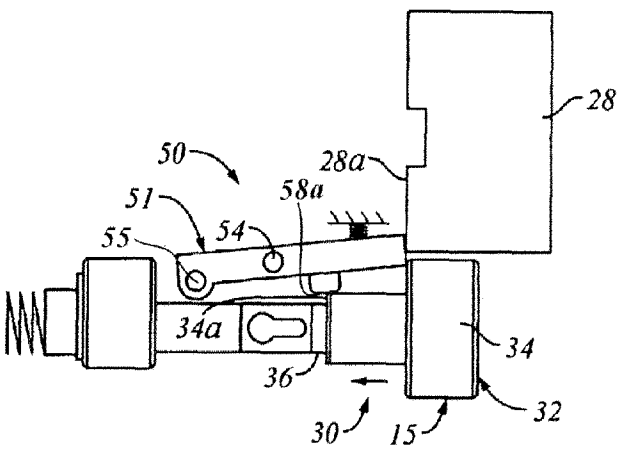
FIGS. 17A, 17B, 17C and 17D provide elevational views of an alternative action release assembly and a trigger assembly as may be used in any of the firearm(s) hereof.
Figure 17D:
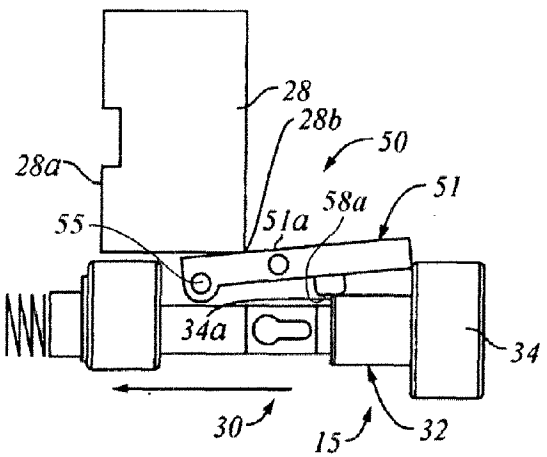
Figure 17A:
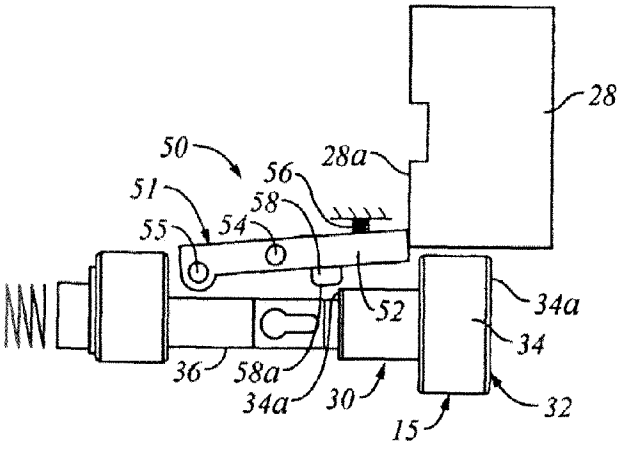

Otherwise, when the action bail 51 is in an at-rest, up position (FIG. 17A), and then when the trigger mechanism 32 is depressed, e.g., moved rearwardly, two effects may occur as shown in FIGS. 17C and 17D. First, in FIG. 17C, when the pump action lock and release assembly 50 is in the at-rest position locking the action in closed position, and when the trigger mechanism 32 is depressed, the step surface 34*a* then comes into contact with and engages the bottom surface 58*a* to lock the bail 51 in the action-locking up position. Similarly, the position shown in FIG. 17D shows the same trigger-depressed, action-locking up position; however, the frame 12 represented by the front connector or frame member 28 thereof, is shown in a rearward position which actually reflects a forwardly moved disposition of the forwardly movable assembly 15, and thus also the forward movement of the trigger mechanism 32 and action bail 51. Then, the trigger-depressed engagement of the step surface 34*a* with the bottom surface 58*a* of tang 58 still locks the action bail 51 in an up orientation, which herein causes engagement of the front corner 28*b* of the front connector of frame member 28 with the top surface 51*a* of the bail 51 which thereby prohibits movement and thus also prohibits closure of the forwardly movable assembly 15.

Figure 16B:
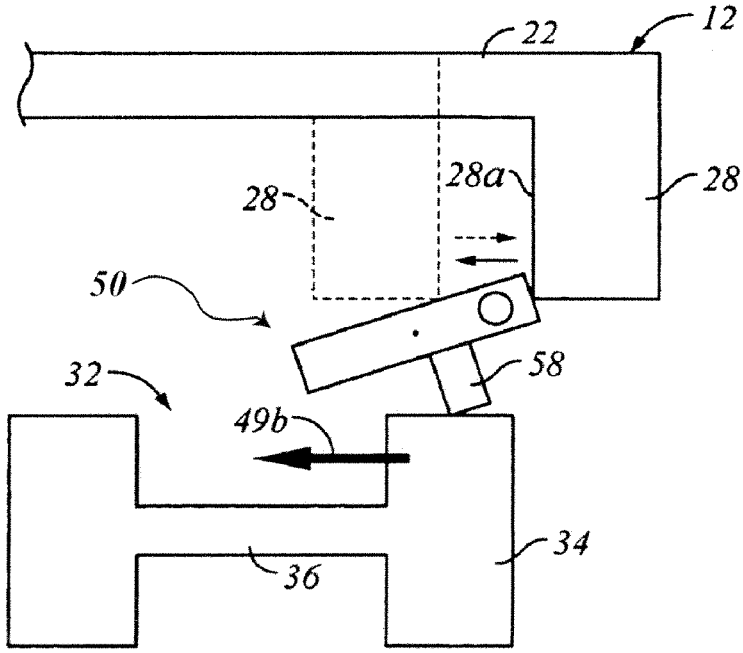
Figure 17B:
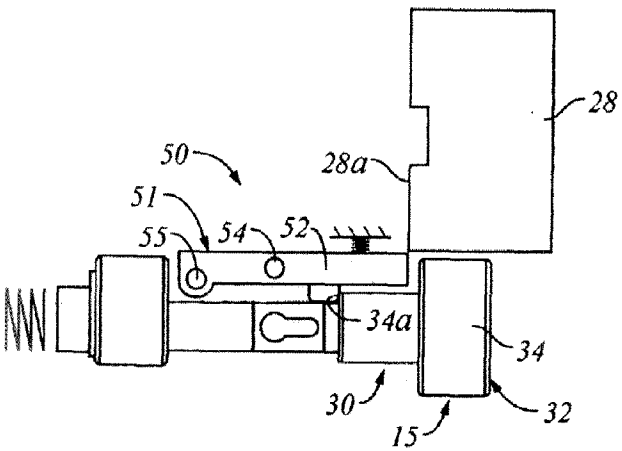

Thus, inadvertent opening or forward movement of the forwardly movable assembly 15 is prevented both when the trigger mechanism 32 is not being moved (FIGS. 15A, 15B and 17A), as well as when the trigger mechanism 32 is moved (FIGS. 16B and 17C). Similarly, closure of forwardly movable assembly 15 is prevented when the trigger mechanism 32 is moved (FIGS. 16B (dashed lines) and 17D) whether inadvertently or otherwise. And, the trigger mechanism 32 is prevented from being pulled when the action release bail 51 is maneuvered into action-opening position (FIGS. 16A and 17B).

Figure 18A:
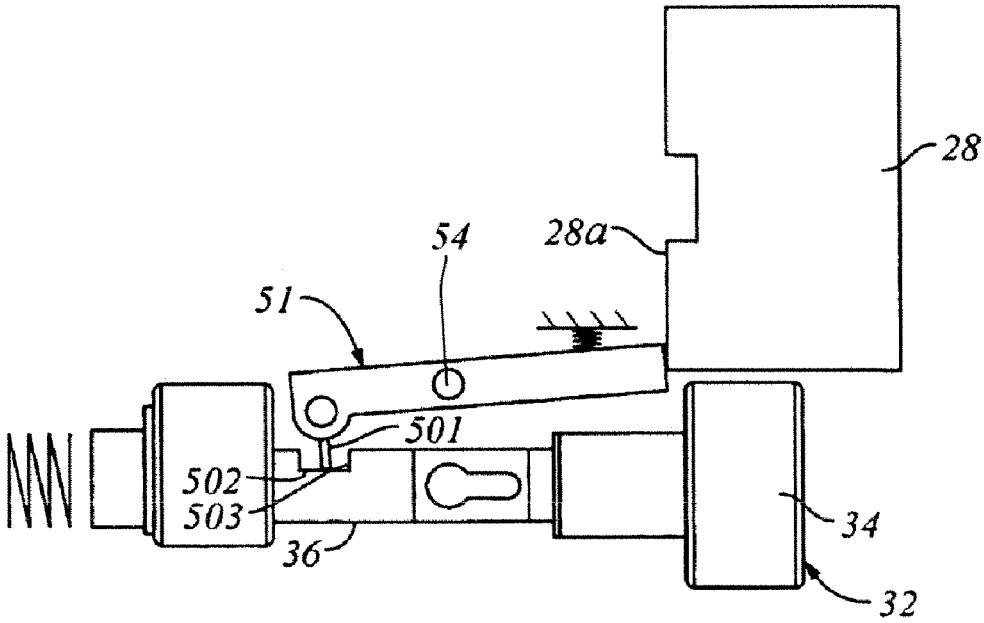
FIGS. 18A and 18B depict elevational views of another alternative action release assembly and trigger assembly as may be used in any of the firearm(s) hereof.
Figure 18B:
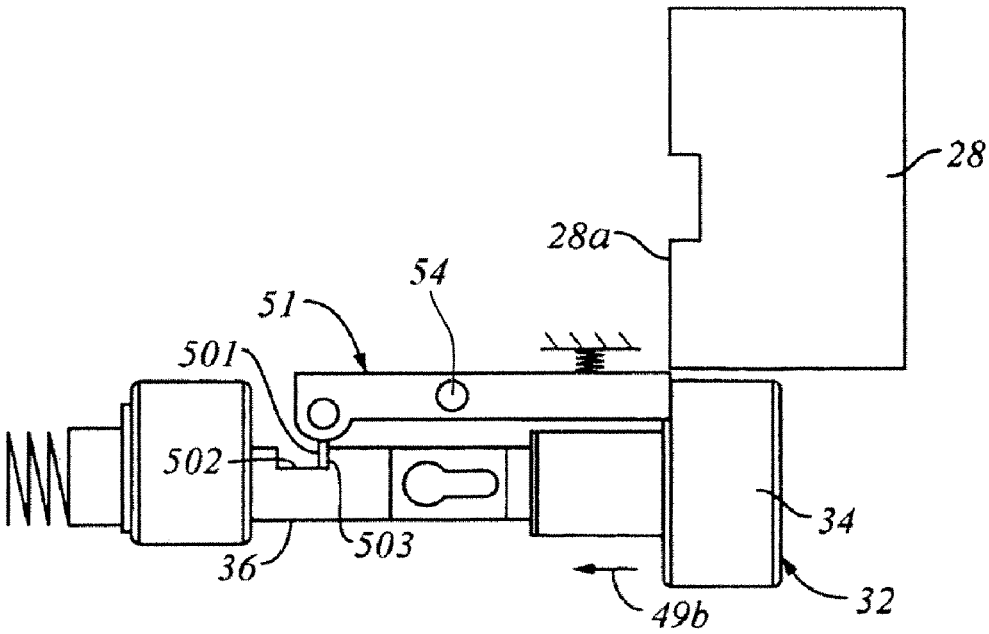
Figure 19A:
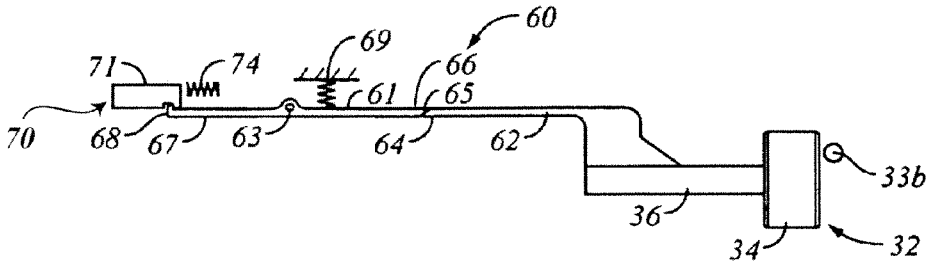
FIGS. 19A, 19B and 19C depict elevational views of a trigger, sear and hammer as may be used in any of the firearm (s) hereof, as for example, those of FIGS. 1-18.
Figure 19B:
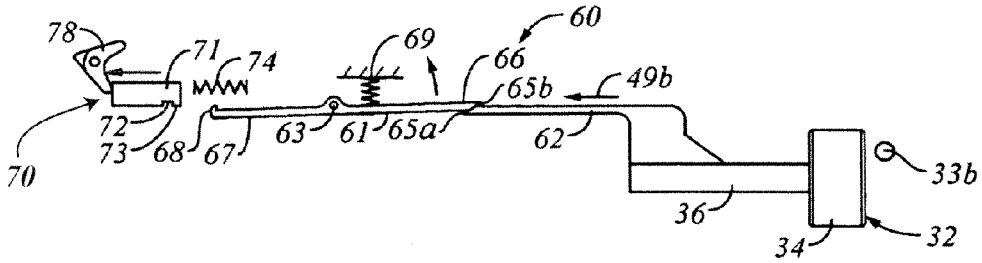
Figure 19C:
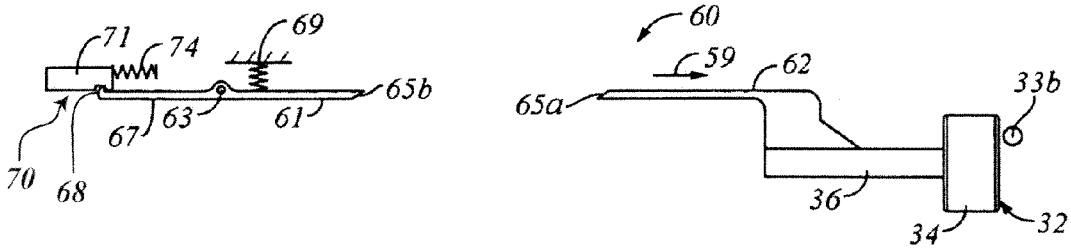

One of various other further alternative embodiments is shown in FIG. 18 wherein the "action release"; e.g., the release of the forwardly movable assembly 15, can be made to occur as part of the pulling of the trigger mechanism 32. This may thus eliminate at least one step that the operator would then have to make during the firing cycle, e.g., the operator would then not have to manipulate the action release knob(s) 54 to achieve the unlocking of the forwardly movable assembly 15 prior to operator movement of the forwardly movable assembly 15. As with many other alternatives herein, such a feature may be in line with certain functionalities of a conventional pump shotgun; and yet, though it may be similar structurally to some conventional setups, it may alternatively and/or additionally be as shown in FIGS. 18A and 18B, wherein a tang 501 may be attached to the bail 51, such tang 501 being coactively operable with a groove 502 formed in the trigger shaft 36. The tang 501 is operable by being engaged by the lip surface 503 of the groove 502 such that the movement of the trigger assembly 30, e.g., trigger mechanism 32 and the trigger shaft 36, in the triggering direction 49*b* (see FIG. 18B) from the at-rest, action locked position (see FIG. 18A) causes such engagement at which point continued rearward movement of the trigger assembly 30 then provides for rotating the action release bail 51 downward into action releasing position, e.g., such that the front surface of the bail 51 disengages with the inner surface 28*a* of the frame member 28. The forwardly movable assembly 15 may thus be released during this trigger pull motion. In one alternative of this setup, a normal trigger motion causes such an engagement and thus provides for this action release, or in a further alternative, the action release motion can be disposed at the end of the trigger movement, or even at a certain selected amount after the completion of the trigger movement. In other words, the action release may not be activated until a certain further movement of the trigger mechanism 32 past that necessary for the triggering of the firearm, and may be thus delayed until after the firing of the firearm. As such, the action release here may begin at the point of the firing, or at some point of continued trigger movement after the firing. To accomplish this, the tang 501 and surface 503 would be positioned to allow the trigger mechanism 32 to travel a little distance past when the sear is released to then allow the surface 503 on the trigger piston shaft 36 to catch the tang 501 on the action release bail 51. The action release knobs 54 may be left in place to continue to allow for manual action release, if desired.

As an overall forwardly placed firearm control group 100, including the trigger assembly 30, forwardly placed firearm control group 100 could be interactively operated as follows. In the simplest form, as for example where there is no manual safety nor action release, the firearm 10 is simply fired by placing a finger into the finger recess 41 in the underside of the forearm 17 and pulling back on the trigger mechanism 32 (see FIGS. 9A-E and 10). However, even so, safety is still highly desired. Thus, in addition, the piston trigger mechanism 32 may be held in "safe" position by a safety interrupter or obstruction as by the obstruction 45*a* as described above, and as such the safety button 43 must be depressed and, held (from either side of the forestock 17) in a "fire" position (either of cutouts 45*b* and 45*c* held in line with keyhole restriction 47) for the trigger mechanism 32 to be depressed (see FIGS. 9A, 12 and 13). Then moreover, if a further action safety, e.g., tang 58 is also provided, the trigger mechanism 32 and pump action lock and release assembly 50 can be interlocked to prevent any firing/triggering movement of the trigger mechanism 32 while the forwardly movable assembly 15 is being cycled (FIG. 16A). Additionally, this same or a similar action safety tang 58 can also be used to prevent any undesired cycling while the forwardly movable assembly 15 is in battery and the trigger mechanism 32 is being depressed/pulled, thus preventing movement forward out of battery (dashed lines in FIG. 16B), and/or also to prevent moving the action 15 back into battery from an open position if the trigger mechanism 32 is depressed (dashed lines in FIG. 16B). The entire forwardly placed firearm control group 100 may thus be interlocked with the position of the forwardly movable assembly 15 such that the firing of the firearm 10 is mechanically disallowed unless the forearm 17 is fully to the rear, with the bolt 14 locked into battery with the breech 16*a*. Thus, even though the trigger mechanism 32 may be moved forward and into a separable relationship relative to the hammer and other firing mechanisms (see description below), reliability and safety are still maintained.

The general benefits for the remainder members (fire safety assembly 40 and pump action lock and release assembly 50) of the forwardly placed firearm control group 100 may be substantially the same as the benefits for the earlier described parts of the forwardly placed firearm control group 100, namely, the trigger assembly 30, first, in that the operator's hand placement may remain the same for and during substantially all usage of the firearm package (either as a combined weapons system 200 or a stand-alone weapon 202, or otherwise), with the forward support and rearward master hands not needing to move during any operation (see FIG. 9C). Moreover, the operation of the secondary weapon 10*a* can be ambidextrous, from whichever forearm support hand the operator chooses to use, even for all of the forwardly placed firearm control group 100 hereof.

In a relatively generic manner, the members of a forwardly placed firearm control group 100 hereof may each be referred to as a fire control assembly, e.g., a fire control assembly 30, 40, and/or 50, each such fire control assembly including a respective fire control depression member, and a fire control rod connected to the depression member. Also, each such fire control depression member may be operably depressible to maneuver the fire control rod to a fire control position to thereby provide firing control of the firing of the firearm. In some embodiments, the fire control assembly may be the trigger assembly 30, whereby the fire control depression member may then be a trigger button 34, and, the fire control rod may be an elongated trigger rod 36 connected to the trigger button 34, and, whereby the trigger button 34 is operably depressible to maneuver the trigger rod 36 between an at-rest, non-firing position and a firing position to fire the firearm and thereby provide firing control of the firing of the firearm.

In other embodiments, a forwardly placed firearm control group 100 may be and/or include a fire safety assembly 40, the fire control depression member of the forwardly placed firearm control group 100 may be or include a safety button 43; and, the fire control rod may be or include a safety cross-bar 44 connected to the safety button 43; and, wherein the safety button 43 is operably depressible to maneuver the safety cross-bar 44 between a safe, non-firing position and a firing position to allow for the firing of the firearm 10 and thereby provide firing control of the firing of the firearm 10. In some of these situations, the fire safety assembly 40 is used with the trigger assembly 30, and the elongated trigger rod 36 may have a restriction 47 and keyhole 48 formed therein, the restriction 47 and keyhole 48 being adapted to receive the safety cross-bar 44 and coact therewith to be disposed alternately in a safe, non-firing position and a firing position to allow for the firing of the firearm.

In still further embodiments, a fire control assembly may be or include the pump action lock and release assembly 50, the fire control depression member may then be an action release knob 54; and the fire control rod may be an action stop and/or release bar 52 connected to the action release knob 54. The action release knob 54 may then be operably depressible to maneuver the action stop and/or release bar 52 between an at-rest, action-locking, firing position and an action releasing, non-firing position wherein the firearm 10 is disallowed from firing when in the action releasing position, and/or when the pump action lock and release assembly 50 is in the at-rest, action-locking and firing position, the firearm 10 is allowed to fire, and/or when the pump action lock and release assembly 50 is in the at-rest, action-locking and firing position, the firearm 10 is allowed to fire, the pump action lock and release assembly 50 thereby providing firing control of the firing of the firearm 10.

Moving the forwardly placed firearm control group 100 to a forward disposition on the firearm 10 may yet include a further challenge to address. The firing mechanisms of many firearms will often include a mechanical connection and consequent activation of the hammer and/or firing pin at or near the rear of the bolt or other breech closure device, and in many conventional firearms, the triggers are mounted on the fixed firearm receiver or other fixed structure (e.g., buttstock), with a usually fixed, generally non-separable mechanical link between the trigger, the sear and the hammer/firing pin. Here however, if the bolt 14 or the like is held substantially stationary (at least relative to the forwardly movable assembly 15), and the trigger assembly 30 is made movable (as part of the forwardly movable assembly 15), then the connection between the moving trigger mechanism 32 and the otherwise one or more other immovable (e.g., non-cyclable) firing mechanisms, generally hereafter identified by the reference numerals 60 (e.g., sear lever 61), 70 and/or 80 (bolt 14 or the like may also be considered a firing mechanism here), may be at the least, inconstant, and usually may produce or even require separation. The challenge may then be to provide separability yet with reliable re-connectability for subsequent firing after the cycling of the forwardly movable assembly 15, here, forward, and back. Note again that any one or more (e.g., one or a combination) of the firing mechanisms 14, 60, 61, 70 and/or 80 may be held substantially stationary relative to the forwardly movable assembly 15.

Hereafter, a separable sear assembly 60 which accomplishes separability and reliable re-connection of these operating parts/elements, is described. As shown in FIGS. 19 and 20, a sear assembly 60 of the invention generally includes a sear lever 61 and sear link 62. The sear lever 61 is simply a mechanical lever that acts against the spring pressure holding the hammer in place, and it is rotatably or pivotally fixed or mounted on or in the frame 12 or a like fixed member of the firearm 10. The sear lever 61 is mounted on a pivot or fulcrum such as on a pivot pin or rod 63, and is pivotable or rotatable thereabout. Pivot pin 63 may be connected to frame 12 at, in and/or through pivot pin aperture(s) 29*a* as depicted more clearly in FIGS. 3A and 4. There may be aligned apertures 29*a* on both sides of frame 12. The sear lever 61 may be disposed in or adjacent a bore 76 formed in the firearm frame 12 and in which the hammer 71 reciprocates (see further description below).

The sear link 62, as introduced above, is operatively and mechanically in contact with and/or attached to the trigger assembly 30 as, for example, being connected to or fixed on the trigger rod 36 of the translationally movable trigger mechanism 32 (though note in some embodiments, the sear link 62 may instead of being a part of the sear assembly 60, may rather be considered a sear linking extension of the trigger mechanism 32 and thus a part of the trigger assembly 30). The sear link 62 has an extended link end 64 which has a link bevel 65*a* which is disposed to alternately separate from and/or come into operative contact with a mating lever bevel 65*b* constructed as the end part of the first extended end 66 of the sear lever 61. These mating bevels 65*a* and 65*b* come together to form a contact 65 between the sear link 62 and the sear lever 61. Contact 65 may alternatively be referred to as a linkage or connection 65 as in a system of interconnected parts that transmit motion, yet not being substantially permanently affixed one to another. More particularly, a mechanical and yet separable linkage 65 may thus be provided from the trigger mechanism 32 and/or trigger assembly 30 to the hammer assembly 70 through the sear link 62 at its link end 64 butted up against the first extended end 66 of the sear lever 61. The respective butted ends 64, 66 are beveled in a mated fashion such that linear motion of the sear link 62 towards the sear lever 61 will cause the free end 66 to ride up at the contact 65 and rise such that the sear lever 61 pivots away from its position retaining the hammer 71 thereby transforming the translational movement into rotational movement. At the safe or rest position, e.g., where the trigger mechanism 32 is blocked from moving forward or back by respectively the forward stop member 33*b* and the safety bar obstruction 45*a*, (e.g., see description above), then, the sear lever bevel 65*b* of the ramped or beveled contact 65 is adjacent to and/or in contact with the sear link bevel 65*a*. This trigger link to the sear lever 61 is a separating sear link to allow for the forward movement of the forearm 17 and the forwardly movable assembly 15 while cycling and charging the firearm 10.

The sear lever 61 then also has a second end 67, the second end including a projecting catch or hook 68. The second end 67 of the sear lever 61 may also be known as a catch arm 67 and may be urged upwardly into a hammer holding position by a sear spring 69, one end of which being mounted on or to the frame 12 shown only schematically or in general outline in FIGS. 19 and 20 of the drawings, with the other end in contact with the upper surface of the first extended end 66 of the sear lever 61. The sear spring 69 urges the catch arm 67 upwards so that the catch or hook 68 projects into a bore 76 in and/or under the frame 12 in which the hammer 71 reciprocates, e.g., moves back and forth. The projecting catch 68, when in the position shown in FIGS. 19A and 19C of the drawings, then engages a sear engaging portion 73 preferably formed as a lip of a notch 72 formed as part of a hammer 71 of a general hammer assembly 70. The hammer 71 is normally urged by a spring or springs 74 to move in the bore 76 towards, in this example, a hammer transfer link 78, which itself is adapted to impact the firing pin 82 of the firing pin assembly 80. However, the hammer 71 is held in check, e.g., retained, against spring pressure, in the cocked position by the sear hook 68, except when the gun is fired, since it is stopped by the sear engaging portion 73 of the notch 72 which is engaged and/or caught and held by the projecting catch 68 of the sear lever 61. Then, when the sear lever 61 is disengaged from the hammer 71, the hammer 71 is propelled under spring pressure into contact with the firing pin assembly 80.

The manner in which the sear lever 61 releases the hammer 71 is by moving the hook 68 on the end of the sear lever 61 off or otherwise away from the hammer's sear notch 72 and sear engaging portion 73 against which the sear lever 61 can be caught. The moving of the hook 68 off such sear engaging portion 73 may be accomplished by the interaction of the bevel contact 65 (and bevels 65*a* and 65*b*) between the ends of the sear lever 61 and the sear link 62. The bevels 65*a* and 65*b* are matched and matingly aligned with each other, providing for any further, continued linear movement of the sear link 62 beyond contact to cause a release motion of the sear lever 61. Then, by applying movement force through the trigger mechanism 32 to and which causes the link end 64 of the sear link 62 to force the sliding movement of the bevels 65*a* and 65*b* which causes the corresponding first extended end 66 of the sear lever 61 to rise which in turn causes the second end 67 of the sear lever 61 with the sear hook 68 to lower and thereby to disengage with the hammer notch 72 and sear engaging portion 73 of the hammer 71 thereby releasing the hammer 71. Moving the trigger mechanism 32 and sear link 62 against the sear lever 61 translates the linear motion of the trigger mechanism 32 into an initially orthogonal motion in the first extended end 66 of the sear lever 61 which is then translated into rotational motion of the sear lever 61 about the axis of pivot pin 63.

n mere contact activation in this way allows for the forwardly placed firearm control group 100, including the trigger assembly 30 and the sear link 62 attached thereto, to be moved away from the sear lever 61 and firing pin 82, as for example, when the forwardly movable assembly 15 of the firearm 10 is moved forward during the cycling, re-loading, re-cocking process, yet still allows for the trigger assembly 30 to operate the sear lever 61, when moved back into the firing position. This linkage between the trigger mechanism 32 and the firing pin 82 are physically pulled apart and then slid back together during the pump cycle. Moreover, this feature of a separating sear assembly 60 allows for the placement and ultimate use of a forwardly placed firearm control group 100 that is forward of the bolt 14, and forward of the breech 16*a* and receiver 18 and forward of the magazine 20 and is integral and moves with the charging mechanism of pump action 21 (FIGS. 1A, 1B and 2), of a manual repeating firearm 10. This feature is also one which may preferably be used in allowing the implementation of a shorter firearm, where the action is cycled using a pump action. And, it provides for operation by the forward support hand without any required change in position of either of the user's hands. And still further, the separating sear link assembly 60 also opens up the area under and in back of the breech 16*a* to allow a new cartridge 19 to feed up and into the chamber 16*c* when the forwardly movable assembly 15 is slid forward. This also provides one more physical barrier to discharge when the breech 16*a* is unlocked in that as soon as the action release is unlocked and the movable part of the firearm starts forward, the surfaces of bevels 65*a*, 65*b* of the sear assembly 60 are separated, so that even were the trigger to be pulled, there would be no discharge. Moreover, as described above, some embodiments also allow for interlocks between the trigger and the action release which also serve to prevent closing of the action (and thus contact between the sear link and sear lever) if the trigger is held depressed when closing the action.

In fuller action with the other described members of the forwardly placed firearm control group 100, particular attention in this part of the overall description will be paid to the function and operation of the trigger assembly 30 and the sear assembly 60 in carrying out these methods or procedures. When the user is ready to activate the gun, the user's support hand finger is placed in the finger recess 41, in a ready position to pull the button 34 (see FIG. 9A). But first, in this embodiment with a fire safety system 40, before the trigger button 34 can be pulled, the safety 42 has to be disengaged by depression of either of the buttons 43 on either side of the forestock 17 which is usually accomplished with the thumb (or perhaps a middle or ring, or conceivably a small or pinkie finger) of the support hand (see FIG. 9D). Then to activate the trigger assembly 30, the trigger mechanism 32, which has initially been disposed in its rest position (shown in FIGS. 10, 11 and 19A and see FIG. 20A for a schematic representation of the at-rest position of the sear, hammer and firing pin assemblies 60, 70 and 80), is pulled back in the direction of arrow 49*b* (FIGS. 10, 11, 19B and 20B). As the trigger mechanism 32 moves back, the link end 64 of the sear link 62 translationally pushes at the contact 65 against the first extended end 66 of the sear lever 61. As the sear lever 61 is not translationally, rather only rotationally movable, the first extended end 66 of the sear lever 61 rides up the ramp of the link bevel 65*a*, causing the sear lever 61 to rotate about the pivot pin 63. As the first extended end 66 rises, the second end 67 is lowered, until such time as the projecting catch 68 is no longer in contact with the sear engaging portion 73 of the hammer 71. When the very tip of the projecting catch 68 drops below the end of the sear engaging portion 73, the hammer 71 is no longer restrained. The hammer spring or springs 74 thus forces the hammer 71 toward the firing mechanisms 70, 80, and the striking face 75 of the hammer 71 strikes the corresponding member of the firing pin assembly 80, preferably the striking lever 78; (striking lever 78 may be a part of either the firing pin assembly 80 or the hammer assembly 70 or both the assembly 80 and the assembly 70). This lever 78 is in turn moved, being rotated about axle 79 to impact or strike the firing pin 82 causing the firing pin 82 to strike the cartridge 19 causing the firing of the cartridge 19 in the barrel chamber 16*c* to discharge the projectile(s) 19*d* disposed therein.

After firing, the pump action lock and release assembly 50 of the forwardly placed firearm control group 100 can then be activated, as for example by manipulation of one of the knobs 54 usually with a thumb (but also potentially with a finger, fore, middle, ring or small) to push the release bar(s) 52 down out of engagement with the inner surface(s) 28*a* of the frame member 28. See FIGS. 9E, 15 and 16. Then, the forwardly movable assembly 15 including all of the forwardly placed firearm control 100 herein, can be slid forward, as along arrow 59 (see FIGS. 1B, 6B and 20C). This provides for cartridge cycling, e.g., unloading and reloading as described above (see e.g., FIGS. 6A and 6B), and as will be reviewed below (see FIG. 20D).

Figure 20A:
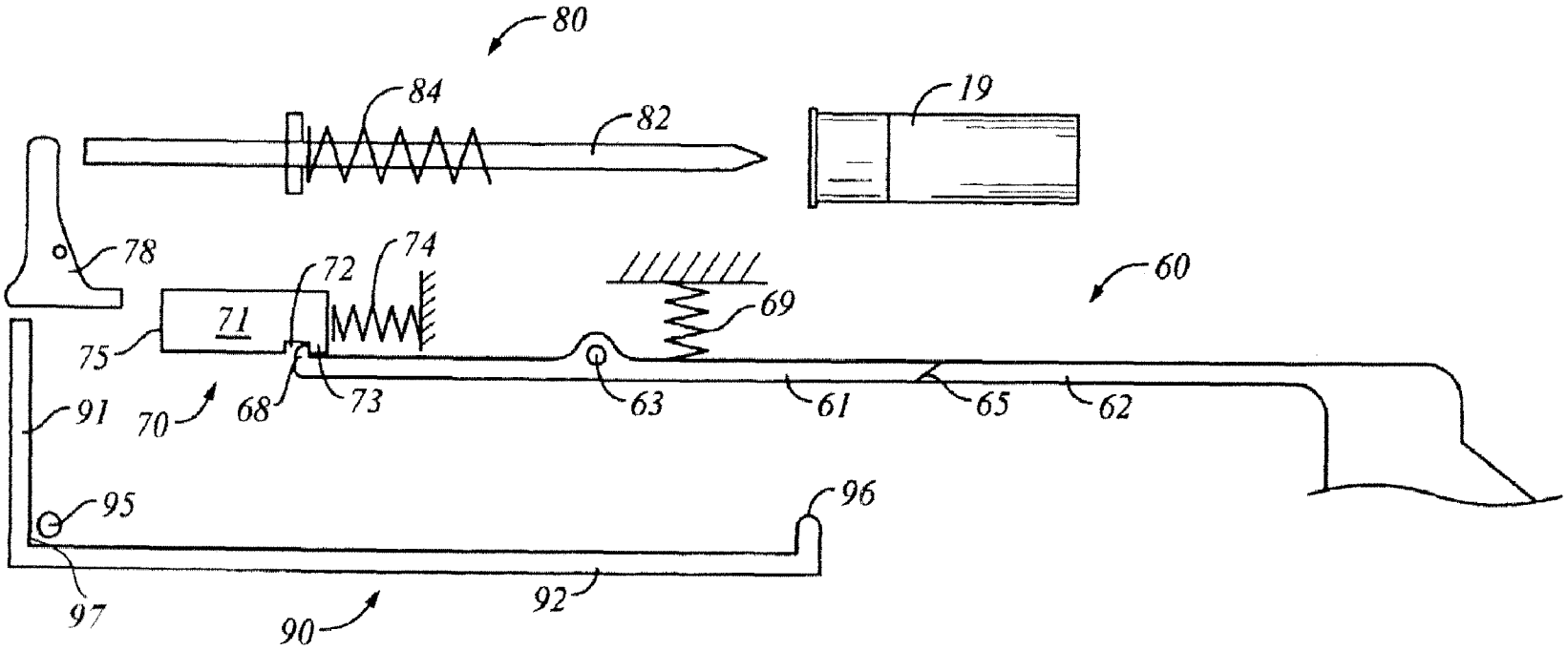
FIGS. 20A, 20B, 20C and 20D depict schematic elevational views of a separating sear in relation to other firearm components of an exemplary firearm according to any of the figures hereof, as for example of FIGS. 1-19.
Figure 20B:
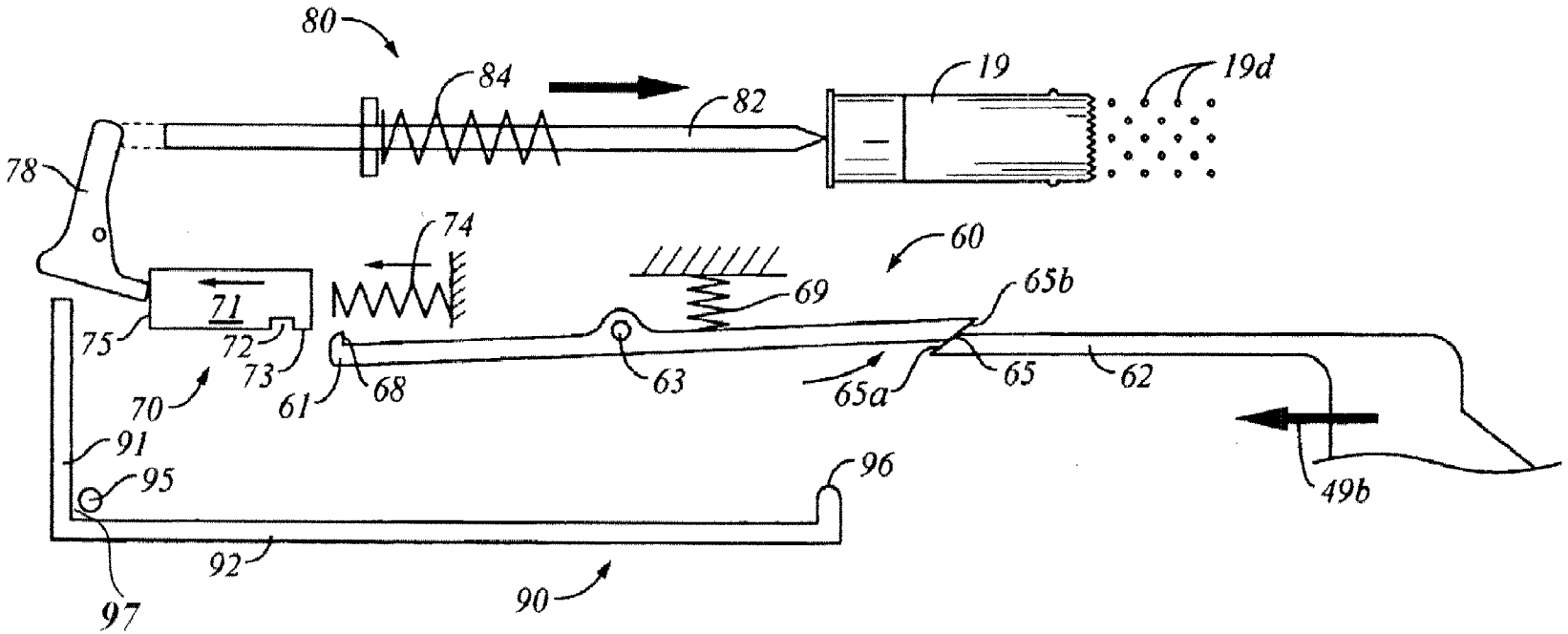
Figure 20C:
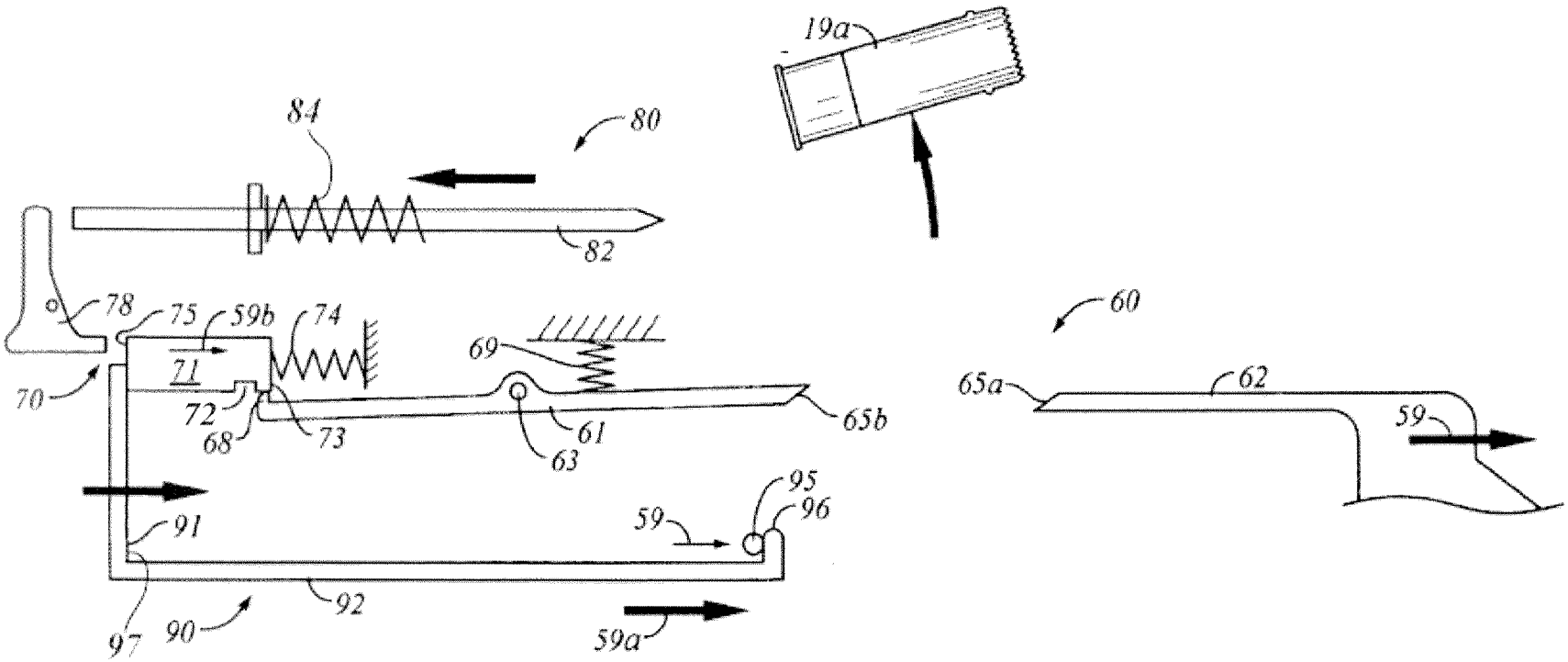
Figure 20D:
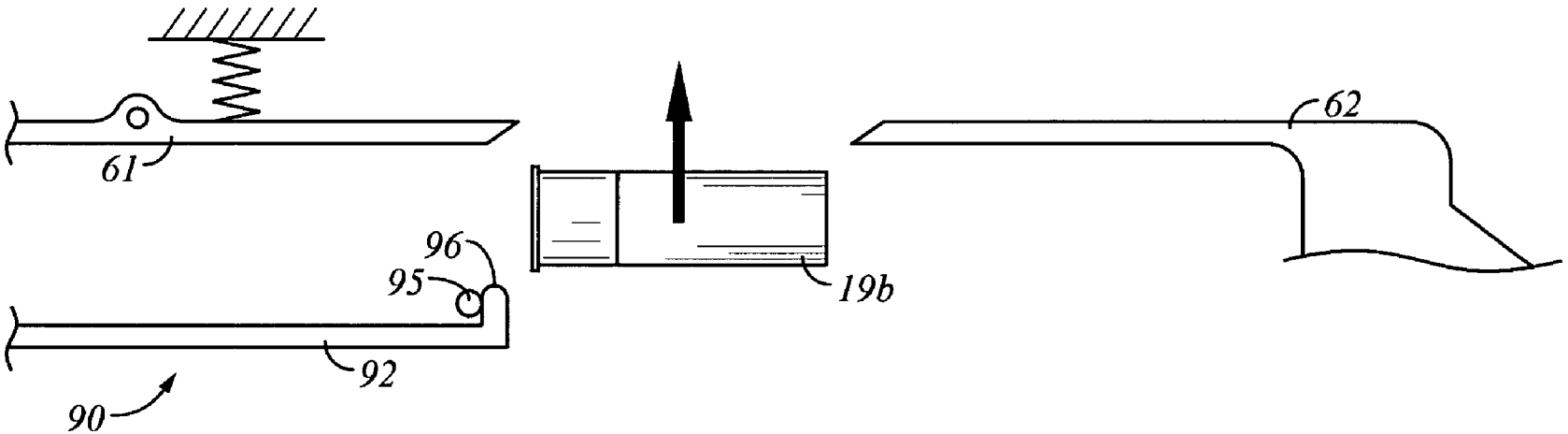

The cocking operation takes place also during the movement of the forwardly placed firearm control group 100 in the cycling of the forwardly movable assembly 15 forward and back. Cocking herein includes moving the hammer 71 back into position against the bias of the spring(s) 74, caught by the hook 68 on the sear lever 61. The cocking of the hammer 71 may be accomplished using the cocking assembly 90 shown in FIGS. 2, 3A, 3B and 20A-D. Most particularly, the cocking bar 91 of the cocking assembly 90 is adapted to engage and move the hammer 71 when the cocking assembly 90 is being pulled forward by the forwardly movable assembly 15. A cocking rod stop pin 95 engages one or more surface(s) or node(s) 96 on the rod(s) 92 and thereby pulls the rod(s) 92 which, being connected to the cocking bar 91, pulls cocking bar 91 forwardly, e.g., arrow 59, see FIG. 20C. Then, the bar 91 engages the face 75 of the hammer 71, and the hammer 71 is thus also consequently moved in the same direction, but which for it is back against the bias of spring(s) 74, until it is engaged by the hook 68 of the sear lever 61. The cocking rod stop pin 95 is fixed in/connected to the forwardly movable assembly 15 and thus moves forward therewith during any forward motion thereof. While the stop pin 95 engages the node 96, it pulls it forwardly as shown in FIG. 20C. Note, while the stop pin 95 is moving from its rearmost position adjacent the cocking bar 91 until the stop pin 95 catches on the node(s) 96, the cocking bar and rods 92 do not move, in other words, they remain stationary with the frame 12 and bolt 14. However, then when pin 95 does catch the node(s) 96, it moves the node(s) 96 and the rods 92 and the bar 91 forwardly to cock the hammer/striker 71. The length of the rods 92 and/or at least the distance to the node(s) 96 may thus be chosen relative to the desired cocking distance that the bar 91 will be desired to travel. Even so, as shown in FIG. 20D the pin 95 and the node(s) 96 may be set to stop their forward movement leaving sufficient space between them and the other parts of the forwardly moving assembly 15 (note, indeed, the pin 95 as connected to the forwardly movable assembly 15 may always thus be pre-disposedly spaced from the remainder parts) which may thereby allow for a new cartridge 19*b* to be fed up therebetween into the chamber 16*c* (note, in an alternative embodiment, there are two spaced apart rods 92 which are sufficiently spaced apart to provide sufficient room therebetween for the cycling of a shell 19 therebetween, and thus need not be pre-disposed with the stop pin 95 behind the magazine opening). The cycling of the forwardly movable assembly 15 then moves back toward the closed battery position, see FIG. 20A, and the firearm 10 is then fully re-loaded, cocked and ready to fire again. Note, a follower 93 (see FIGS. 2 and 3A) may be attached to the rearward end of the frame 12 to provide a rearward closure against or adjacent which the cocking bar 91 and rods 92 come back into place during the closing of the receiver and movement of the action back. The pin 95 is also moved back during this motion, first away from the nodes 96 and thus no longer forces forward movement of the cocking assembly 90, but then also come to rest against and pushes the surface(s) 97 to move the cocking assembly 90 back to its at-rest position, adjacent the follower 93, if used.

Figure 21A:
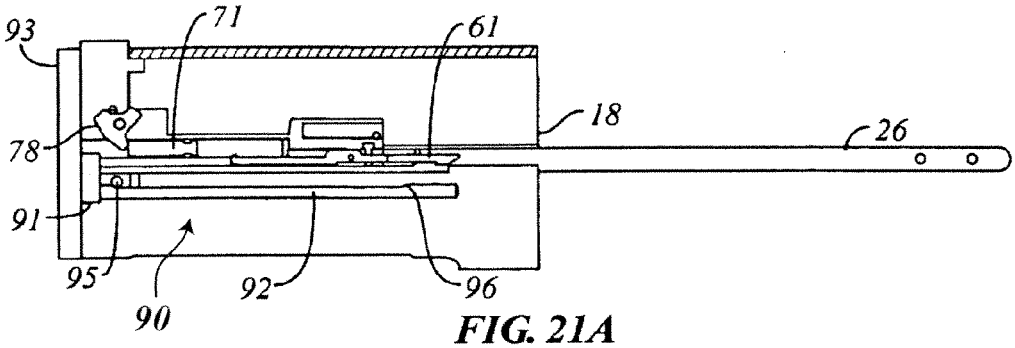
FIGS. 21A, 21B, 21C and 21D depict partially cut-away side elevational views of alternative firing mechanism and cocking assembly combinations which could be components of firearms according hereto.
Figure 21B:
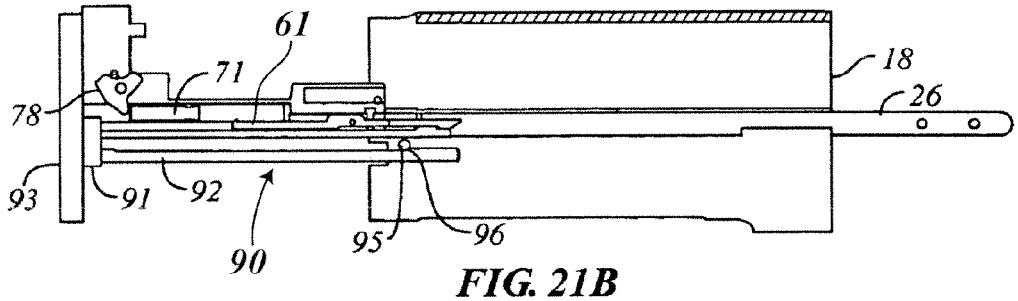
Figure 21C:
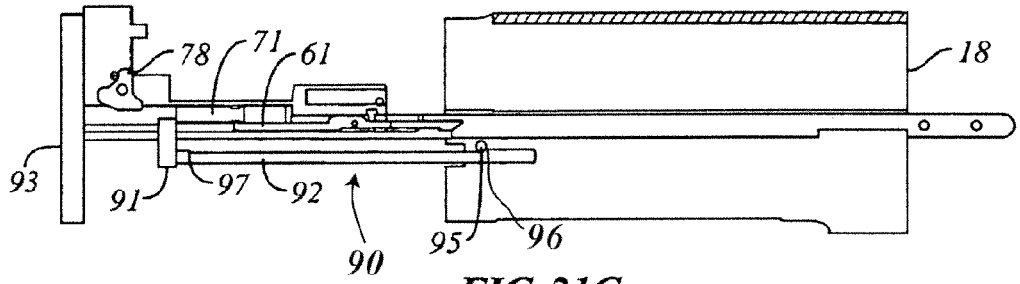
Figure 21D:
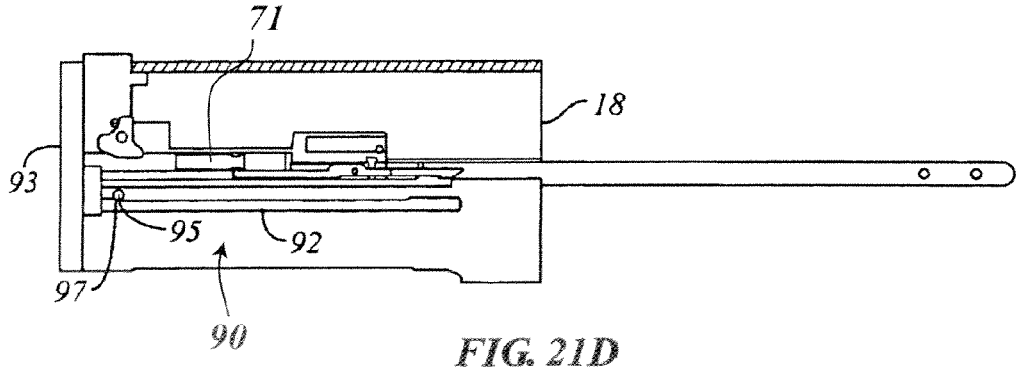

The detailed views of FIGS. 21A-21D show an alternative cocking assembly which operates as described above. Note, the pin 95 which moves the cocking assembly 90 is fixed to or otherwise moves with the moving receiver 18. And, in moving from the closed position of FIG. 21A to the mostly open position of FIG. 21B, the receiver 18 and pin 95 have moved over a relatively large distance prior to picking up the cocking rods 92 by finally engaging the nodes 96. Then, further forward movement, e.g., from FIG. 21B to FIG. 21C, has pin 95 pushing on the nodes 96, and thus moving the cocking assembly 90 such that the cocking bar 91 engages the hammer 71 moving the hammer 71 into position engaging the sear lever 61. Then, lastly, moving back to the fully closed position, FIG. 21D, it can be seen that the pin 95 then moves back to and engages the back rod surface(s) 97 to move the cocking assembly 90 now back away from the hammer 71 until it needs to be re-cocked after firing as shown in FIG. 21A.

The operation of, e.g., method of use of, the firearm 10 in an overall manner, from loading, locking, firing and reloading, and more (e.g., in some embodiments, unloading, ejection, feeding, cocking and the like), will now be described. As a first step in use, assuming an unloaded firearm 10, the user would then first want to load a shell 19 into the chamber 16*c* of the barrel assembly 16. This may be accomplished either manually or substantially automatically if attached to the firearm 10 is a magazine 20 having at least one ready shell 19 disposed therein. If manual operation is desired, the user may manually insert a shell 19 through the ejection aperture 18*a* or if no magazine 20 is attached, then in some embodiments, manually up through the underside opening through which the magazine 20 would normally communicate.

In either situation, the breech 16*a* of the assembly barrel 16 must first be in an open disposition providing open communication into the chamber 16*c*. Thus, if the firearm 10 is closed, the user must open it by grasping the forestock 17 with the forward support hand while supporting the rear end with the back hand (either by holding the shoulder stock 25 of the stand-alone weapon 202 or the stock 25*a* of the primary weapon 201 in a combined weapons system 200), and then by manipulating the forestock 17, the user can move or cycle the forwardly movable assembly 15 forward. This opens the empty space 18*b* between the breech 16*a* and the bolt face 14*a* so that a shell 19 can be received therein. Manual loading can thus proceed as described, or if a magazine loading operation is preferred, the magazine 20 can be connected to the firearm 10. The magazine 20 may in some embodiments be attached whether the firearm 10 is open or closed, or may be restricted to only one or the other positions; however, if open, the forwardly movable assembly 15 would be cycled back to closed position, then to open position where the new cartridge 19 is picked up into the empty space 18*b* between the breech 16*a* and bolt face 14*a*. And then in either case, the forwardly movable assembly 15 is cycled back once again to the closed position, moving the cartridge 19 into the chamber 16*c* and closing the empty space 18*b* between the breech 16*a* and the bolt face 14*a* until empty space 18*b* is eliminated and the bolt face 14*a* can be locked against the breech 16*a* locking it closed.

Note, the automated loading from a magazine 20 may take any of many forms including, for example having a spring loaded magazine (see schematic springs 20*b* in FIGS. 6A and 6B), and/or a depending tang connected to the bolt 14 or frame floor 23 to catch the next cartridge 19 in/from the magazine 20 as by catching the rim or lip thereof during the cycling forward of the forwardly movable assembly 15. Then, the next cartridge 19 may be sufficiently moved or angled toward the chamber 16*c* such that the ensuing rearward cycling may sufficiently capture the next cartridge 19 within the chamber 16*c*. Alternatively, levers or other mechanical devices (not directly or specifically shown) may be used to maneuver the next cartridge 19 into the empty space 18*b* between the breech 16*a* and the bolt face 14*a* during the cycling of the forwardly movable assembly 15. Similarly, the unloading and ejection process(es) may make use of one or more levers, tangs or other such mechanical devices (not directly or specifically shown) to pull the spent cartridge 19 from the chamber 16*c* and pushing it out through the ejection aperture 18*a* during the cycling process of the forwardly movable assembly 15 first forward, then back. Typically, the unloading and ejection process(es) will take place during the initial cycling of the forwardly movable assembly 15 forward, so that the loading process may take place during the return of the forwardly movable assembly 15 back to the closing position. If a tang is used to engage the lip or rim of the next cartridge 19 in/from the magazine 20, it may do so at or near the end of the forward cycle at or just after the ejection of the prior shell 19.

Then, when the firearm 10 is loaded and ready to use, the bolt 14 is in battery (FIGS. 1A and 6A), and the firing mechanism(s), e.g., the firing pin 82 and/or hammer 71 and/or sear lever 61 is/are cocked, then the user grasps the forestock 17, and one or more fingers, usually the index or fore finger and/or the middle finger are inserted into the opening 41 defined in the underside of the forestock 17 (FIGS. 9A-9D). The finger or fingers then engage the trigger button 34. Note that the trigger assembly 30 of the invention allows the user to use not only one finger on the trigger button 34, but may also allow for two or more. In turn, this may allow for better control and manipulation of the trigger mechanism 32, as well as steadier operation of the firearm 10 itself, when fired by the user; steadier because the support hand is either in its substantially normal support position, or at least in a comfortable steadying position (FIGS. 9A-9D). At this point, when the firearm 10 is ready to use, the bolt 14 is in battery (FIGS. 1A and 6A), and the firing pin 82 is cocked, and the sear link 62 is positioned such that the force of the trigger mechanism 32 will be transferred along the sear link 62 to the sear lever 61 as described above. Next, when the user is ready to fire the weapon, the trigger mechanism 32 is pulled backward, or away from the trigger stop member 33*b* of the trigger frame 33. As described above and repeated briefly herein, the trigger mechanism 32 is pulled backwards, and translates backwardly against the action of the trigger spring 39 which is therefore compressed by the pulling action on the trigger mechanism 32. Further, as the trigger mechanism 32 translates backward against the trigger spring 39, the sear link 62 moves backward therewith and the link bevel 65*a* of the sear link 62 acts upon the lever bevel 65*b* of sear lever 61 to cause the rising of the first extended end 66 of the sear lever 61. The lever bevel 65*b* of the sear lever 61 riding over the link bevel 65*a* causes the sear lever 61 to rotate as described above, about the connection of pivot pin 63. Then, the catch arm 67 lowers against the action of the sear spring 69. Eventually, yet within a very short period, the sear lever 61 will rotate to the point where catch 68 is moved to be disposed outside of the notch 72 of the hammer 71, thereby providing for the hammer 71 to be forced to move backward by the action of the spring (s) 74. The movement of the hammer 71 sets in motion the firing of the firing pin assembly 80, and then the firing mechanism, e.g., firing pin 82 is released which ultimately fires the projectile(s) from the cartridge 19.

After firing, when the button 34 of the trigger mechanism 32 is released by the user, the trigger mechanism 32 will be returned to its rest position as shown in FIGS. 10, 11, 19A and 20A by the action of the spring 39. As the trigger mechanism 32 returns to its rest position, the lever bevel 65*b* of the sear lever 61 will be lowered as the sear lever 61 pivots about pivot pin 63, and the sear link 62 will itself be moved with the trigger mechanism 32 forwardly to its corresponding at-rest position by the action of the spring 39.

Then, also after firing the firearm 10 is re-charged, e.g., the firearm 10 is cycled for reloading of a new cartridge 19 into the chamber 16*c* of the barrel assembly 16 of the firearm 10. During this cycling, the linkage/connection 65 of the sear assembly 60 separates until the forwardly movable assembly action 15 is fully cycled from closed, to fully open position and then back to closed position and the bolt 14 is back in battery. During movement of the forwardly movable assembly 15 from its closed position (as shown for example in FIGS. 1A, 6A, 19A and 20A) to the full open position (as shown for example in FIGS. 1B, 6B, 19C and 20D), the cocking assembly 90 moves from the closed position and moves within the slot or bore 76 in which the hammer 71 reciprocates. As the cocking assembly 90 moves within the slot or bore 76, it engages and slides the hammer 71 back against the spring 74 bias until it engages the hook 68 of the sear lever 61, substantially automatically recocking the hammer 71. The catch 68 will once more project into the bore 76 to form an abutment for the hammer 71 to prevent the firing until such time as the trigger mechanism 32 is again pulled, as described.

The firearm 10 may, as shown and described herein, incorporate the use of a replaceable box magazine 20 filled with one or more cartridges 19, thereby making it easier to rapidly reload and select alternate munitions, such as less-than-lethal rounds. A magazine lever 20*a* is shown in FIGS. 1A-3B and may be used to aid in locking the magazine 20 in place and unlocking for removal and replacement. Since the barrel assembly 16 as shown removes any intermediate staging area for rounds 19, then each shells 19 may be directly fed from the magazine 20 to the breech chamber 16*c*. Note, optional magazine structures may be substituted herein, as for example, a magazine assembly such as those of the Saiga design (like the Russian AK models) in that the magazine will move straight in and straight out of the receiver instead of requiring a rocking motion.

Standard, conventional shotguns cycle cartridges by moving the bolt to the rear and back. In the present design, the bolt 14 is held stationary and the receiver 18 and barrel assembly

16 move forward, allowing the receiver 18 to be shortened and the overall firearm thereby shortened, or the conserved length from the receiver may be added to the barrel so it may be lengthened. Keeping the barrel longer provides more time for the powder to burn and more energy to be applied, making the firearm more effective. Often, for two firearms of the same overall length, one of which being a firearm 10 of the present invention and the other being of the prior art, the barrel on the firearm 10 of the present invention can be longer than that of the prior art firearm by substantially the same amount that the receiver has been reduced from that of the prior art firearm.

Thus, disclosed herein are manually operated, repeating, magazine fed firearms that unlike all other repeating firearms, retain the bolt to the rear while moving the bulk of the firearm forward to charge and prepare the firearm for subsequent firings. Exemplary benefits may include a reduction of the receiver length to approximately or in some cases almost one-half of the typical length, and/or maximizing the barrel length available (within a given overall weapon length), and/or placing the magazine feed as far to the rear as possible, and/or leaving the operator's forearm area open for the support hand. The support hand may then be used to manipulate and fire the secondary weapon while the hand position on the primary weapon is unchanged. Thus, what is provided is a repeating firearm with a short overall length while maximizing barrel length which also provides for comfortable forward placement of the forward support arm, particularly when in use in an underslung configuration with another firearm. These firearms also allow for the use of a box fed magazine feed, which may contribute to an allowance for the fire controls to be placed forward of the bolt and receiver, which may allow for minimizing overall length. This may be accomplished from the reversing of the conventional approach by holding the bolt and bolt carrier system essentially stationary while moving the remainder of the firearm.

Moreover, neither the mounting of the firearm 10, often a shotgun, or the operation of the firearm 10, should interfere with the operation of the primary weapon. Moving one hand from the main firing position to and from the main box magazine to use as a "handle" while firing the shotgun weapon is not required or desirable. Safety controls, and the firing of either of the weapons may thus here be accomplished without moving either of the operator's hands from the ready position. Firing and/or charging (e.g., re-loading) the firearm 10 may be accomplished using either hand. The firearm 10 may be semi-automatic, yet preferably with a breech and bolt that is as short as possible, and a barrel length that is as long as possible, yet still within overall desirable operable length requirements. Overall length of the weapon may in many cases be less than approximately 15 inches, but in some cases it may be up to but typically not longer than 21 inches, though both longer and shorter embodiments are available. The action may be adapted to be operable with various gun types, as for example shotguns, and as one particularly preferred embodiment, may be made to operate over a range of available 12 gauge rounds. In such an embodiment, it may be desired that as a minimum the action may be adapted to be chambered for and operate with 2¼ and 3 inch, 12 gauge breaching rounds. The action may also be adapted to be fed using existing, readily available box magazines. Field stripping and removal of the firearm 10 should be accomplished with minimal effort and preferably require no tools. Sighting the firearm 10 should be compatible with the primary weapon sights, or be provided with a secondary sight system for effective preferable distances, and in the case of many shotguns, an effective distance may be of approximately 15 yards. However, sights may not be necessary, because, e.g., when used as a door breacher, or breaching weapon, the distance to the target is often only about 6 to about 10 inches, so a sighting mechanism for that purpose is not needed.

The firearm 10 hereof may be a shotgun for many uses, including for example, for use in executing forced entries through doors. The firearm 10, particularly in its short barreled configuration, may have a desirable use by law enforcement, security teams, and the military. This weapon is particularly well suited for entry teams when the addition of a large bore weapon is needed in addition to the primary weapon, thus eliminating the need to carry (and change between) two separate weapons. In a longer barrel version, this would be suitable for sport use where it is combined with a rifle (such as what may be referred to in some embodiments as an assault rifle) to provide both rifle and shotgun capability in the field. The resulting configuration may provide commercial embodiments which may include firearms of many types and/or other like devices. The resulting device may also be lighter in weight, due for example to the reduced length and/or easier to use than previous firearms for the same reason, among others.

There are many alternative structures which may be substituted for one or more of the structures and/or methods herein. One which has been introduced above is the alternative structure of the magazine 120 of FIGS. 7A and 7B. Substantially this embodiment of an alternative magazine 120 can be like those tubular magazines on conventional shotguns. Here, the shells 19 are shown as they may be stored in substantial linear fashion within the magazine 120 with, in FIG. 7A, a spent shell 19*a* loaded in the chamber of the barrel assembly 16 and then, as shown in FIG. 7B, when the barrel assembly 16 is cycled forwardly, the spent shell 19*a* is ejected and the new shell 19*b* in line is lifted into the empty space 18*b* which has opened between the bolt 14 and the breech 16*a* of the barrel assembly 16 in order to be next loaded in the barrel chamber. The empty space 18*b* may be simultaneously and/or otherwise viewed as the receiver chamber 18*b* even though a receiver structure 18 is not shown. Other shells 19*c* are shown in the magazine awaiting their turn. A different set of springs 120*b* and 120*c* are shown schematically in FIGS. 7A and 7B for the purpose of biasing and moving the shells to the desired locations. Alternative means for moving these shells may be used as for example, but not for limitation, levers or other mechanical structures (e.g., two tubes, or externalized trigger and/or action release assemblies from the tube shown and described hereinabove).

Figure 22A:
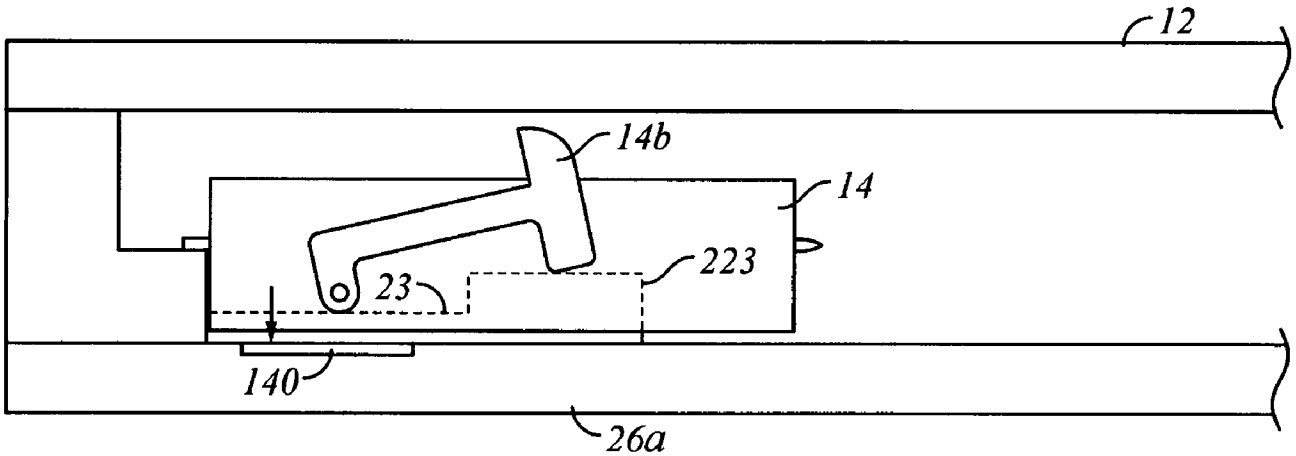
FIGS. 22A, 22B, 22C and 22D depict isometric and elevational views of alternative frame and bolt combinations which could be components of firearms according hereto.
Figure 22B:
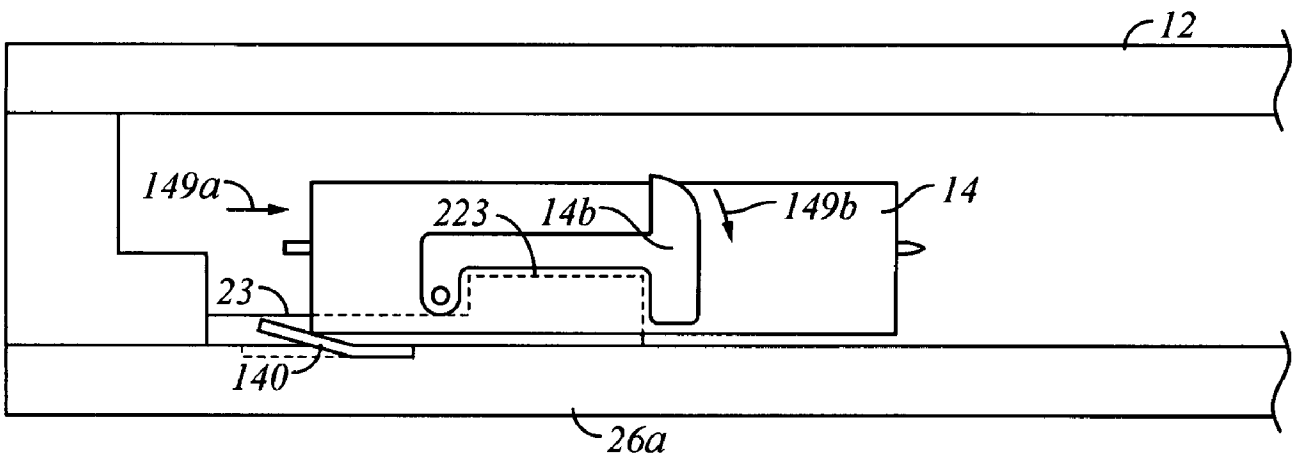
Figure 22C:
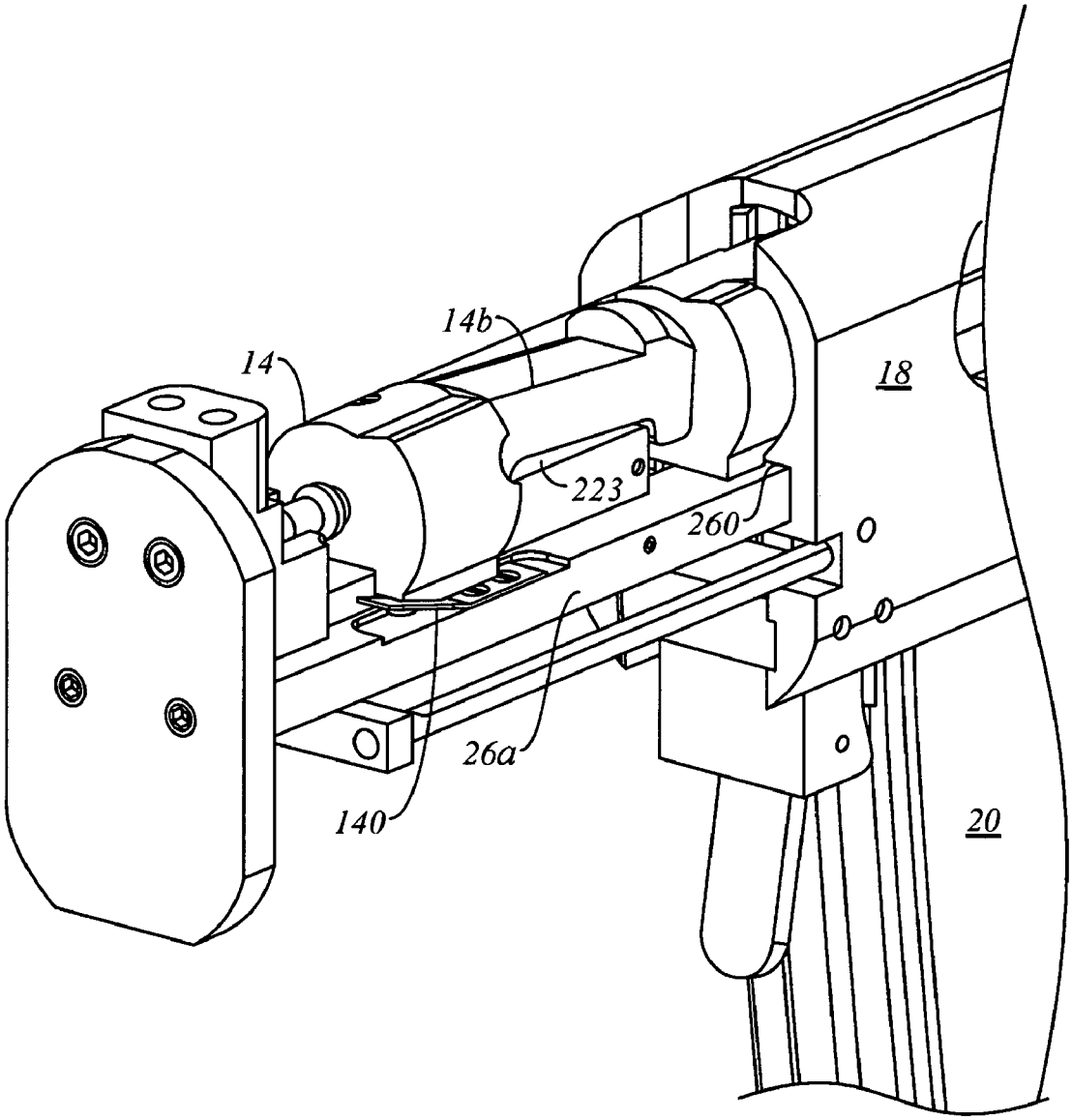

In some of the above-described embodiments, the bolt 14 or other breech closure device (see below) may be a substantially fixed-in-place member relative to the frame 12. However, as another alternative structure, as shown in the depictions of FIGS. 22A through 22C, the bolt 14 may be provided with some restrained movement relative to the frame 12 for a purpose such as facilitating locking and unlocking of a bolt lug 14*b*, if used, relative to the barrel assembly 16 or receiver 18. In viewing bolts or other breech closure devices of prior art weapons, a problem which may be encountered is that when cycling such a weapon, the bolt lug would be substantially always biased into an up or out and locked position, but held down by constant interaction with an internal receiver or barrel surface until cycling was complete and the bolt lug is lined up with the receiving barrel or receiver recess or lug cutout. Then, the bolt lug can move up into the recess or cutout and lock the bolt in place, in battery, for firing. However, such biasing in the up and locked position when unrestrained by a catching receiver or barrel inner surface, e.g., as it would be when the current bolt 14 would be outside of the receiver 18 (see, e.g., FIG. 1B) might be undesirable in some situations, as for example, if such interferes during re-entry of the bolt into the receiver, thereby blocking re-entry and preventing cycle completion. Thus, application of such conventional bolts appear as though they may be difficult in a firearm where the bolt effectively exits the rear of the receiver during cycling.

Figure 22D:
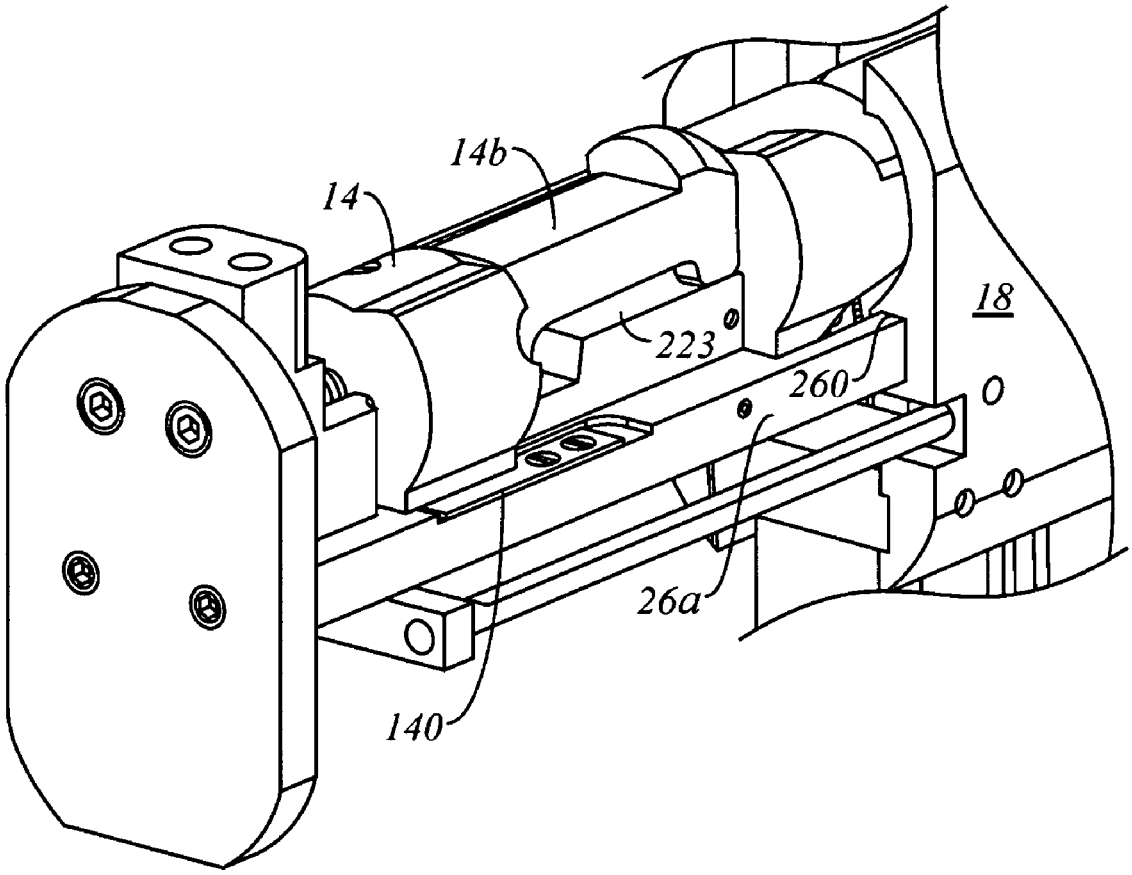

Moreover, in many bolt lug interfaces with an interlocking barrel cutout, the bolt lug, and thus usually also the bolt, must travel forward a slight distance (typically approximately ⅜ of an inch) to disengage from the recess in the barrel extension and allow the bolt lug's foot to clear and allow for movement of the bolt away from the barrel breech and allow for emptying and re-loading. In the alternative embodiment of FIGS. 22A-22D, a moving bolt 14 is shown with a bolt lug 14*b* whereby the bolt 14 is disposed to be movable a relatively short distance relative to the stationary frame 12. In the view of FIG. 22A, the bolt lug 14*b* is in up position disposed to be locked into a receiving barrel cutout, in battery against the breech of the barrel. A spring inside the bolt 14 can interact with the frame 12 to bias the bolt 14 into the position shown in FIG. 22A. Then, however, in moving from the bolt locking position of FIG. 22A to the cycling position of FIG. 22B, the bolt 14 is shown moved forward slightly (see arrow 149*a* in FIG. 22B), and the bolt lug 14*b* rotated slightly (see arrow 149*b* in FIG. 22B) and dropped off a raised surface 223 on the supporting base 23 of the frame 12. The bolt 14 and bolt lug 14*b* are thus in position to allow cycling of the forwardly movable assembly 15 forward and back. The movement forward, indicated by arrow 149*a*, of the bolt 14 can in this embodiment be achieved by, e.g., the installation of a bolt moving spring 140 which can catch a surface of the bolt 14, preferably the lower rear surface which forces the bolt 14 forward. Such a spring 140 would thus be disposed to overcome the internal bolt spring biasing the bolt 14 back and thereby biasing the bolt lug 14*b* to rise. Activation and deactivation of the spring 140 may be caused by interaction with a lip 260 of the receiver 18 riding on the rail 26*a*; see FIGS. 22C and 22D. Thus, when the receiver 18 is moved forwardly a sufficient distance, the lip 260 then disengages from the spring 140 thereby activating the spring 140 to move the bolt 14 from the rear position of FIG. 22A to the cycling position of FIG. 22B. Then, on the rearward travel of the receiver 18 during the closing of cycling action, the lip 260 again catches the moving spring 140, pushing it downward so that it disengages from the bolt 14, thereby allowing the internal bolt spring to force the bolt 14 back to the locking position of FIG. 22A. Installation of the bolt moving spring 140 thereby prevents the bolt 14 from moving to the rear until the bolt lug 14*b* has cleared the opening of the receiver 18.

Figure 23A:
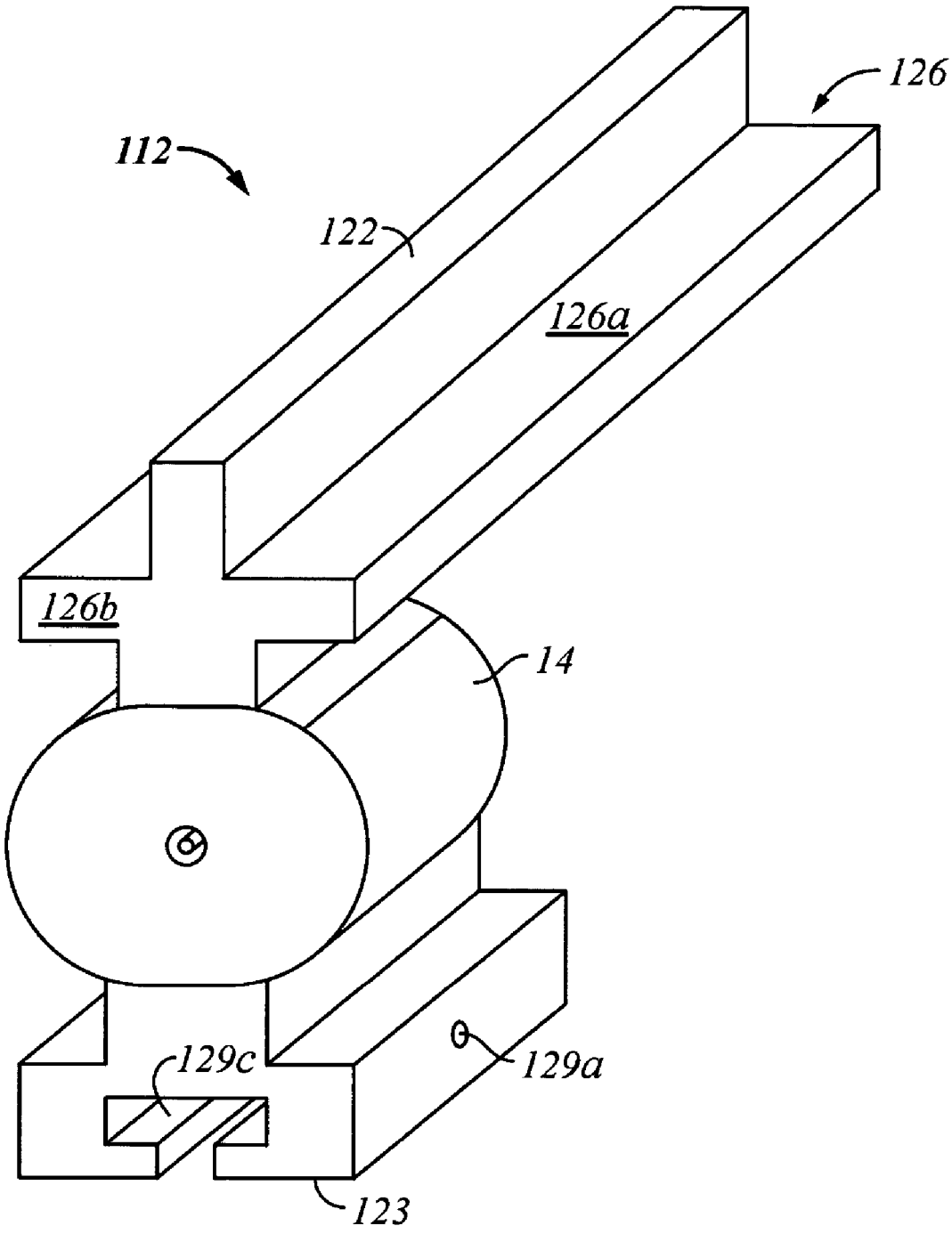
FIGS. 23A, 23B, 23C, 23D and 23E depict isometric and elevational views of alternative frames which could be respective components of firearms according hereto.
Figure 23B:
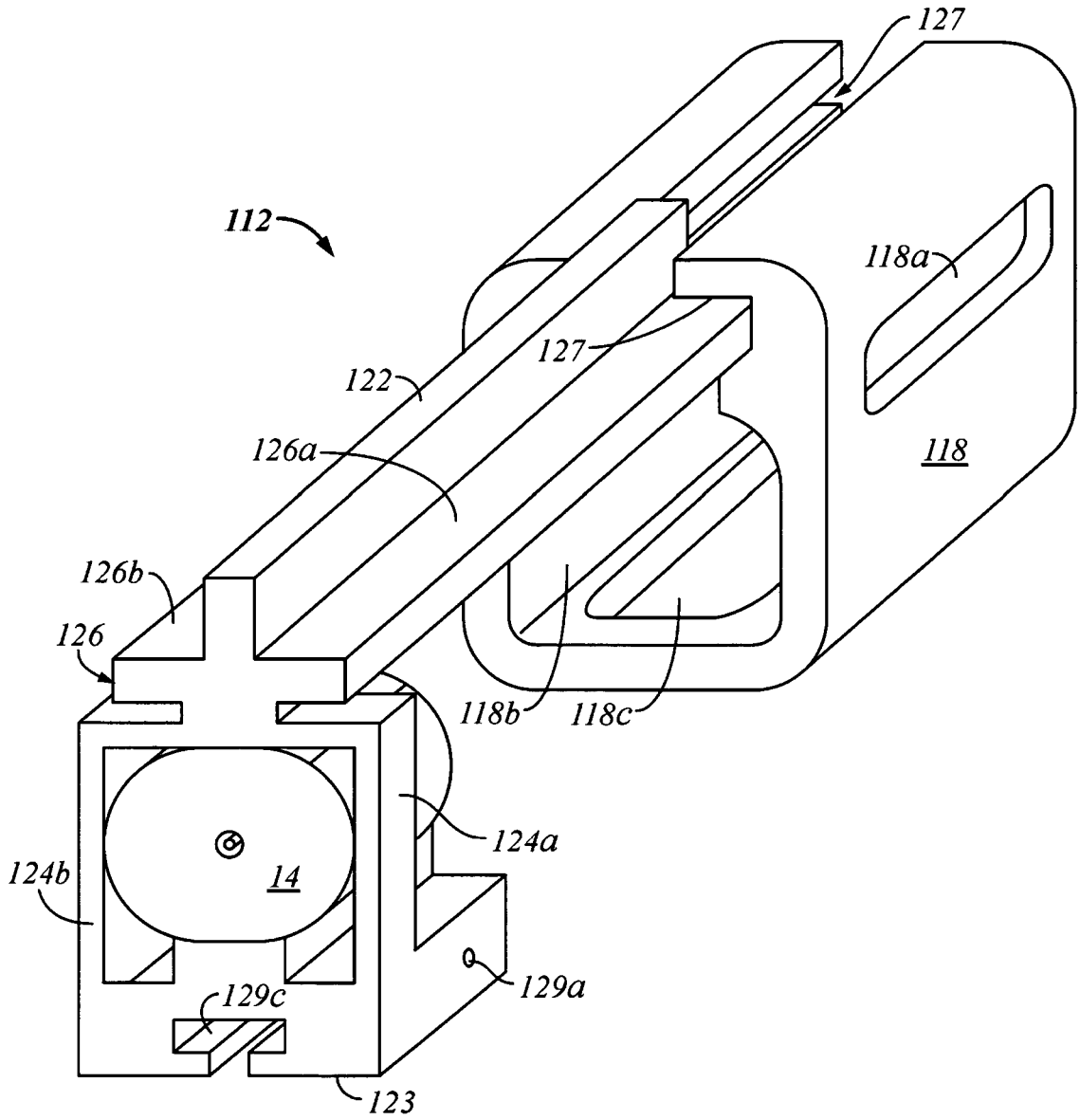

Other of various alternative structures which may be included and/or used herein are alternative frames or frame structures 112 as shown in FIGS. 23A and 23B. In such alternatives, support structure or guide rails 126 including guide rails 126*a* and 126*b* are in an upper position more nearly directly connected to a top bar or rail 122. A connection to the bolt 14 may as shown here, also come from the top, or it may still come from the bottom, e.g., from a bottom member, such as a base or floor 123. Not directly shown are a back bar or support 24 and/or a frame member 28 which may or alternatively may not be included. As before, these relatively vertical sorts of supports may connect to the top bar 122 and/or to the base 123 and/or may connect these together. A further alternative of this is shown in FIG. 23B where there are two arms 124*a* and 124*b* used to connect the base 123 to the top bar 122. This latter example might then better accommodate a bolt lug on the top of the bolt 14. The supporting base or floor 123 may still be disposed at the rear of the frame structure 112 also for use in the cartridge loading process wherein it may be used to retain the shells in the magazine (see FIGS. 6A and 7A) until the magazine is moved forward with a movable assembly thereby allowing for a cartridge to be fed upward to the barrel. A frontal support may have an inverted U or similar shape as before and may be used to provide a stop for the receiver structure 18 or 118, as well as a structure for the action release lock as above.

Figure 23C:
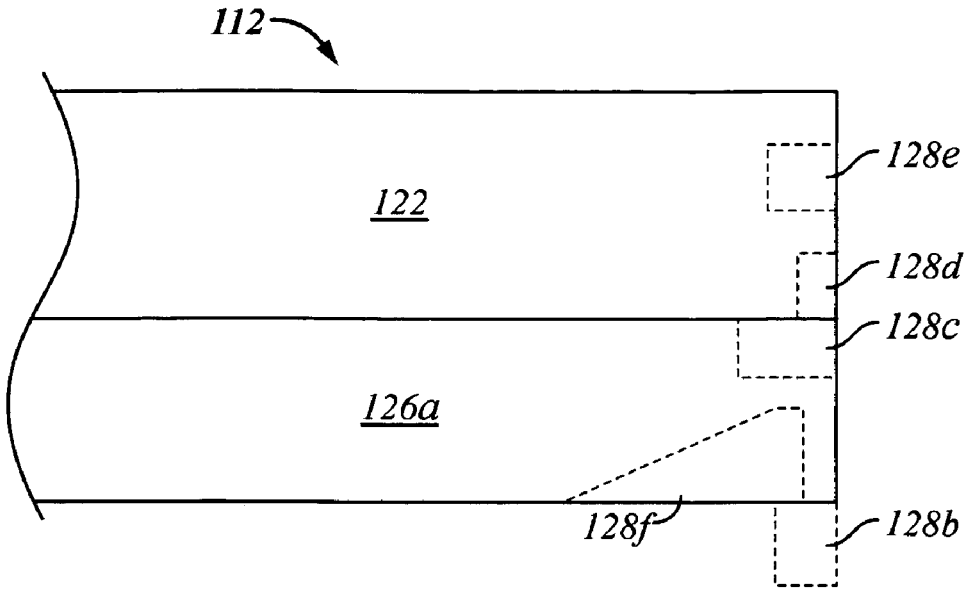

An alternative to vertically disposed or depending structures such as the frame member 28 may be provided in either recesses, grooves or other indentations, or nodular or other extensions from the support structure or guide rails 26, 126 or the top rails 22, 122. Examples of extensions are shown as dashed line additions 128*b*, 128*c*, 128*d* and 128*e* in FIG. 23C, and an indentation is shown as 128*f*. Thus, the receivers 18, 118 need not come to abut against inner surfaces 28*a* (FIG. 4B), but may rather come to rest against nodules or extensions (128*b*, 128*c*, 128*d* and 128*e*) from the support structure or guide rails 26, 126 or the top rails 22, 122. Similarly, the receivers 18, 118 or other structure may have a biased (e.g., spring-activated) extension apparatus which is received in the stop groove or indentation (128*f*) formed in the support structure or guide rails 26, 126 or the top rails 22, 122. The action release and/or other mechanical elements may similarly engage alternative stop structures such as these indentations or extensions.

In the embodiment of FIG. 23A, the support/guide rails 126*a*, 126*b* are spaced above all of the operative parts and thereby allow for movement of, the operative parts (e.g., the separating sear description below), and/or allow for movement of cartridges 19 up from below for loading in the receiver and barrel as described further below. Even so, other points and/or specifics of connection may also be provided in/on the frame 112 (see below), as for example of a pivotal linkage point/axis 129*a* for the rotating sear lever 61 and/or slide groove 129*c* for the cooperating hammer 71, as above. Similarly, sliding grooves 127 defined in the alternative receiver structure or receiver 118 (see FIG. 23B) for receiving and cooperating with the guide rails 126*a*, 126*b*, are also connection parts or mechanisms, the operations of which are as described above, except for the alternative location thereof as upper members, above the chamber 118*b* herein.

Figure 23D:
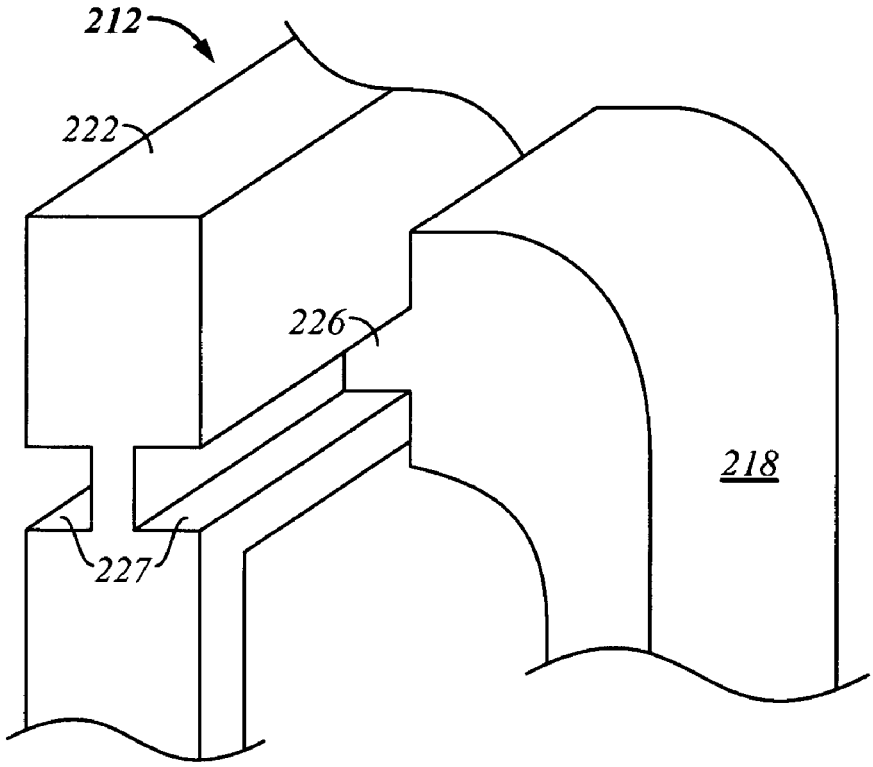

As in the primary embodiment, see FIG. 11B above, the bolt 14 or other breech closure device (see below) may here be made substantially stationary by being affixed to the internal part of the alternative frame structure 112 shown separately in FIG. 23, and the substantial remainder of the presently disclosed firearm 10, including the external receiver structure 18 or 118, magazine 20 or 120 and barrel assembly 16 may here also be joined and all move with and/or as the movable pump elements or forwardly movable assembly 15. The frame structure 112 may thus provide a structure for retaining or holding the firearm bolt 14 in a substantially rearward position relative to the positions of substantially all of the other parts of the firearm 10 and particularly relative to the forwardly movable assembly 15 while the forwardly movable assembly 15 is cycled forward. The frame structure 112 may also be considered as set or disposed to support the forwardly movable assembly 15 during all phases of operation, e.g., when not moving (either fully open or fully closed), as well as during its transition phases, e.g., during the forward and return sliding movements, as for example when the receiver 18 or 118 is moved backward to, over and ultimately around and encloses the bolt 14, see FIGS. 1A, 6A and 6B. The frame structure 112 continues to support the forwardly movable assembly 15 while the firearm 10 is in battery and, that the frame structure 112 provides or acts as a substantially stable platform and guide to keep the barrel assembly 16 and other movable pump elements or forwardly movable assemblies 15 aligned with the bolt 14 as the forwardly movable assembly 15 is cycled. The forwardly movable assembly 15 may thus be adapted to slide on the firearm frame structure 112 with respect to the bolt 14. Alternatively, from the opposite view, the frame structure 112 may be adapted to have the forwardly movable assembly 15 slide thereon, or both of these elements may be adapted to work together. A further alternative for either the primary embodiment (FIGS. 4A and 4B) or the latter (FIGS. 23A-23C) is that the guide rail slots or grooves 27 or 127 may be formed as shown in FIG. 23D as grooves 227 defined in and/or as a part of the frames 12, 112, here 212, wherein the guide rails 126*a*, 126*b* may instead be formed as rails 226 in and extend from the receivers 18, 118, 218. The support structure 126 may then be thought of as the supporting lips of each of the grooves 27, 127, 227.

Note, the ejection aperture 18*a* or 118*a* of any of the embodiments hereof and the communication space (see e.g., the space 118*c* identified in FIG. 23B, which may also be indicative of a similar opening 18*c* in the primary described embodiment of a receiver 18, above, see FIG. 4B) of and from the magazine 20 or 120 may each be disposed in alternative locations, e.g., the ejection aperture 18*a* or 118*a* can be on the right side as shown, or on the left, or potentially in some embodiments, top or bottom or at some other clock position depending upon the locations of other operable elements. For example, the magazine 20 as shown communicates from and through an opening in the bottom of the forwardly movable assembly 15; however, it could be that such communication could be from either side, or from above depending upon the location of the ejection aperture 18*a* and the frame attachment part of top bar 22. The guide rails 26, 126 may also alternatively be disposed at other locations as at either or both sides. Also, these may not necessarily be made in mirrored pairs, but rather may appear either one as a single guide rail and/or as a single support member.

Figure 23E:
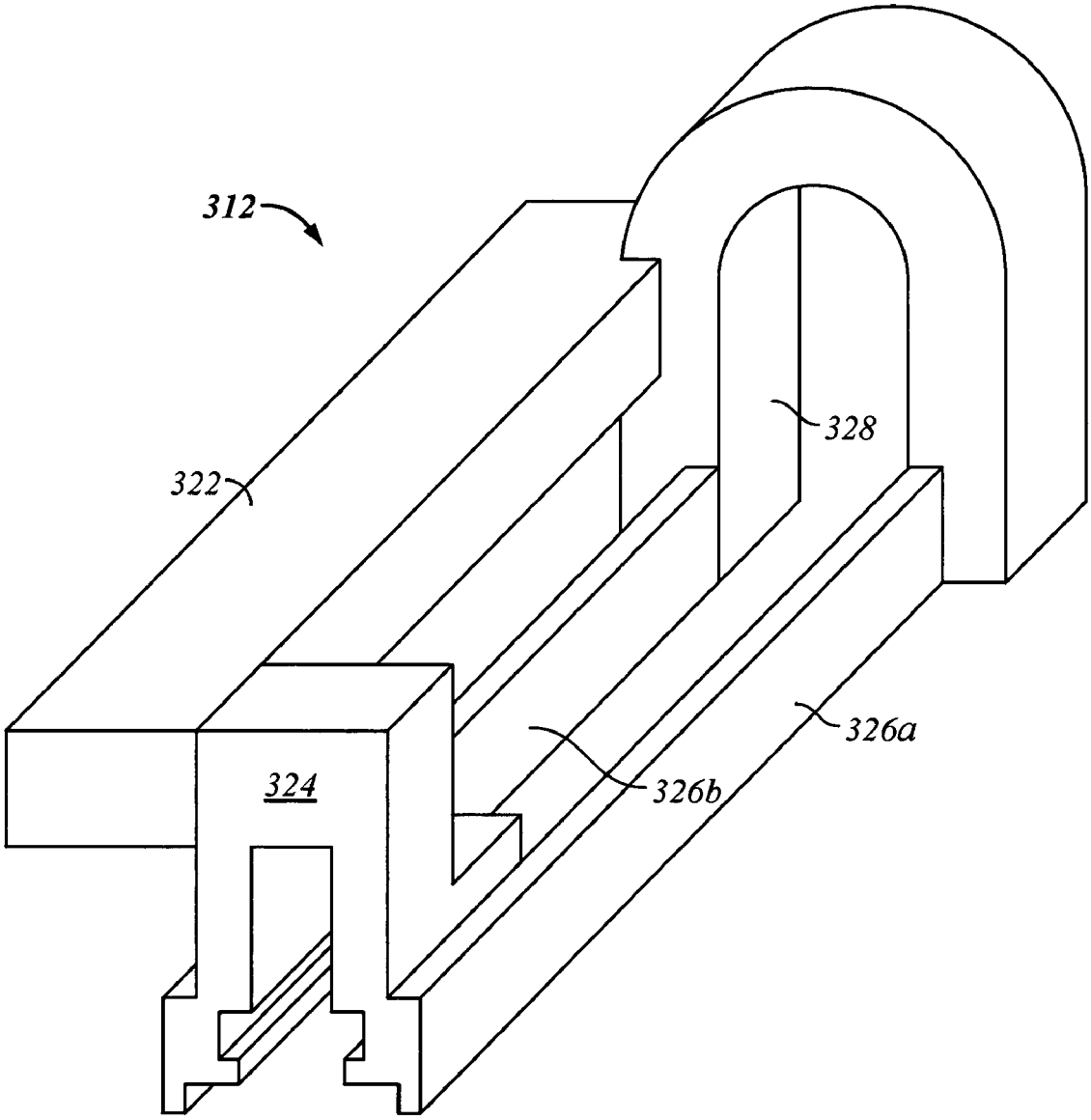

A further alternative frame 312 is shown in FIG. 23E wherein the "top" bar 322 is no longer on top, but rather shown disposed on a side, yet still connected to the other frame components, here back support 324 and front support 328. This embodiment may be used in various circumstances, but, since the "top" bar 322 is one useful structure for attachment of the overall firearm 10 to another member or support structure, side bar 322 may prove most useful in connecting to a side support of any particularly desirable sort. This alternative example is intended to demonstrate further that the frames 12, 112, 212, 312 (and the like) may be defined in a large variety of shapes. The rails 326*a*, 326*b* are again shown in a lower disposition to demonstrate further the interchangeability of alternative structural embodiments.

Figure 24:
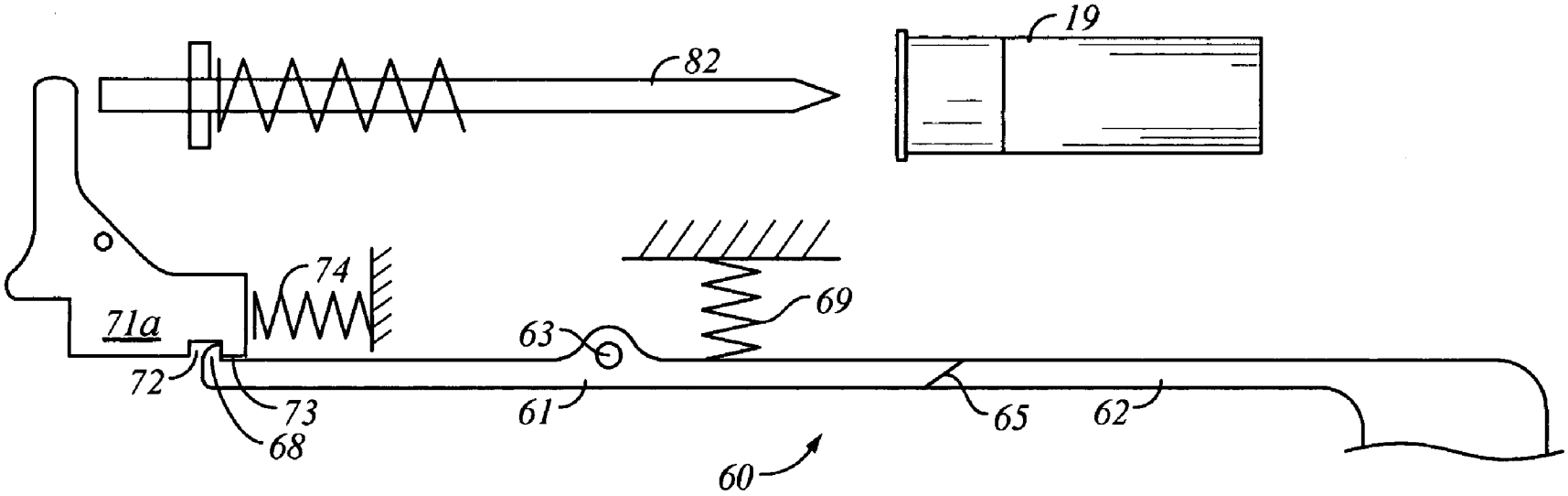
FIG. 24 is yet another elevational view of the trigger, sear and hammer together with other elements of an alternative set of firing mechanisms with a rotatably movable hammer.

Still further alternative embodiments are possible. For another example, see FIG. 24 wherein an alternative hammer 71*a* is shown as it might interact with a sear assembly 60. Such an alternative may provide for a rotating hammer 71*a* which provides a more direct impact on a firing pin 82 or other cartridge-striking member. The interaction with the sear assembly 60 may be substantially the same as described above, as for example, wherein the sear lever 61 is caused to rotate as before such that the hook 68 thereof disengages from the sear engaging portion 73 of the notch 72 or other caught surface or other feature of the hammer 71*a*. The spring 74 can then force the hammer rotation to impact the firing pin 82 which fires the shell 19. Other alternatives such as this may also appear, as for example, wherein a hammer is made to include the firing pin, e.g., such that the hammer and firing pin are one element which is adapted to strike the shell directly, the hammer thus itself being a shell or cartridge-striking member. As a result, reference to a combination of a hammer and a firing pin herein may include structurally combined or connected hammer/firing pin devices, as well as separate hammer and separate firing pin mechanisms which may nonetheless be operable together. Similarly, other references to a combination of devices include either or both the separate devices operable together or the structurally connected combination devices operable as a singular device.

Note further that the mechanically operative elements hereof may also have alternative structures and/or methods of use. In particular, it may first be understood that each of the various mechanisms may be used in the detailed preferred embodiments described hereinabove, or each and/or various combinations hereof may be used with other otherwise conventional or unconventional elements. For a first example, the bolt as referred to throughout may be considered a firing mechanism and further may instead of being a bolt may be any other sort of breech closure or blocking device, which though optionally movable for a certain purpose, it may often alternatively or additionally be retained in a relative stationary position on or by the frame or like substantially stationary member or assembly relative to the forwardly movable assembly or elements. In particular, the forward movability may be effected for the purpose of opening a space between the breech of the barrel and the breech closing device, whether a bolt or otherwise, in order to effectuate spent cartridge removal from the barrel and/or to load or reload a fresh cartridge therein. Then, the return, rearward movement of the forwardly movable assembly can rejoin the breech of the barrel with the breech closure device, whether a bolt or otherwise. Alternatively or additionally thereto, one or more other firing mechanisms (a bolt or other breech closure or blocking device is considered herein as a firing mechanism due to its operability during the firing process, e.g., in closing the breech to retain the shell or cartridge and/or the explosively created gases within the barrel, and/or in accepting recoil from the barrel, and/or in holding or being operative with other firing mechanisms such as the firing pin, if used) may be retained by the frame or like stationary assembly during forward movement of the forwardly movable assembly or element(s) to similarly open room therebetween for unloading and reloading.

Similarly, other alternative structures and/or mechanisms may include the forwardly movable assembly alternatively being more minimally inclusive of a barrel alone or with the receiver; and, some sort of a movable hand support structure to which the barrel alone or with the receiver, or the receiver alone is connected, the movable hand support structure being grippable and/or gripped by an operator of the firearm such that the forwardly movable assembly is adapted to be cycled forward by the operator upon gripping the movable hand support structure and manually maneuvering the hand support structure linearly or translationally forwardly. Moreover, such an example may be disposed such that as the movable hand support structure is cycled forwardly, the barrel is moved therewith linearly or translationally forwardly; and, as the forward sliding assembly is moved forwardly, the firearm bolt or other breech closing device and/or the cartridge-striking member is/are held stationary relative thereto. As such, the barrel and hand structure may be made movable in a pump action fashion similar to conventional pump action firearms, and/or they may be made movable relative to and thus directly supported by and slidable on the rail or rails of a frame such as those shown and described herein. This would then include support structure which has grooves formed therein attached to the hand support and/or barrel. This may or may not include the receiver therewith. Similarly, the receiver may be made movable with or without, e.g., separately from the barrel and/or the hand structure and/or the magazine. For various reasons, perhaps the magazine could similarly be separately movable in some alternative embodiments.

For another example, the push button trigger assembly hereof may be incorporated onto a conventional firearm in either a forward location or at a rearward, more conventional location. Such a trigger may be operated by either hand, whether in a support location or as the master hand in a more traditional location. Further, such a trigger assembly may be used without a safety of any kind, or may incorporate the safety assembly hereof whether in a forward or rearward disposition. Similarly, the trigger assembly may also be used with or without the action release assembly, also with or without the safety assembly hereof. And, the safety and action release are similarly interchangeably useful. Thus, each of these herein described forward controls may be used together, alone or in various combinations, and they may be forwardly placed or rearwardly placed and operated by the master or the support hand. Moreover, each of these may similarly be used or not, with various combinations of the frame structure and/or with or without the forwardly movable assembly.

As to the variations of mechanical elements, examples further include the use of a conventional lever trigger assembly with the safety, action release and/or sear assembly hereof. Alternatively, a more conventional sear assembly may be used with the trigger hereof, or the trigger can alternatively be either the sear lever itself, or it can be mechanically linked to the trigger through pins, cams, levers, etc. Similarly, various alternative parts or part types may be incorporated herein, as for example, wherein the trigger or safety or action release depression member may alternatively be a knob, button, lever, handle, switch, toggle or other such devices, and such a depression member may be caused to move by any of various methods involving pushing, pressing, impelling, forcing, thrusting, driving or other such methods usually manually by hand/finger manipulation by a user/operator, or by other means, e.g., automated, non-manual means. Other alternative structural parts or shapes of parts may be used, as for example for any one or more springs which may be substituted for other spring types or other motive means. As to alternative shapes, examples may include the trigger frame, it may be tubular or cylindrical or of other elongated shapes allowing for linear types allowing for translational movement of a trigger mechanism therein, inter alia, and/or the cross-section hereof may be circular, rectangular, square, triangular or of other shapes. Moreover, alternative manufacturing techniques and structures are also intended herewithin, as for example, though nuts and bolts or screws have been shown for some junctures herein, other means such as welding, or machining or molding or other forming techniques may be used. Similarly, the materials used herein are subject to substitutions for substantial equivalents in the circumstances. For example, metal or substantially rigid plastic materials may be used for many of the parts hereof, and substitutions may be made where appropriate for maintaining the operability hereof.

The foregoing description has been presented for purposes of illustration and description. It is not intended to be exhaustive or to limit the invention to the precise forms disclosed. Thus, as this description has only intended to set forth exemplary embodiments of the present invention, it is anticipated that suitable obvious modifications can be made thereto which will nonetheless remain within the scope of the present invention. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A firearm fire control assembly within a firearm comprising:

a fire control assembly forwardly positioned and disposed within a forestock of the firearm including:

a safety assembly including:

a safety fire control depression member; and a safety fire control rod having a portion thereof extending through a portion of a trigger fire control rod of a trigger assembly; and at least an action release assembly including:

at least one action fire control depression member including at least an action release knob; and at least one action fire control rod of the action release assembly operably connected to the action release knob, the at least one action fire control rod comprising an action release bar connected to the action release knob, the action release knob being operably depressible to maneuver the action release bar between an at-rest position, a firing position, and an action releasing and non-firing position preventing the firearm from firing when in the action releasing and non-firing position, the at least one fire control depression member being adapted to be operably engaged by a user's forwardly placed support hand when the support hand is in a forwardly placed support hand position, and being operably depressible to maneuver the at least one action fire control rod to a fire control position to thereby provide firing control of the firearm.

2. The firearm fire control assembly according to claim 1, wherein the fire control assembly is shrouded within the forestock.

3. The firearm fire control assembly according to claim 1, wherein the fire control assembly is shrouded within an externally accessible shrouded portion of the forestock of the firearm, and is adapted to be operably engaged by a digit of a user's forwardly placed support hand when the digit is inserted in the shrouded portion of the forestock of the firearm.

4. The firearm fire control assembly according to claim 1, wherein the fire control assembly is adapted to operably be engaged ambidextrously.

5. The firearm fire control assembly according to claim 1, wherein:

the fire control assembly includes at least a trigger assembly including:

a trigger fire control depression member comprising at least a trigger button; and the trigger fire control rod through which the safety fire control rod extends, the trigger fire control rod comprising at least an elongated trigger rod connected to the trigger button;

the trigger button being operably depressible to maneuver the trigger rod between an at-rest position, a non-firing position, and a firing position to fire the firearm and thereby provide firing control of the firearm.

6. The firearm fire control assembly according to claim 1, wherein:

the fire control assembly includes at least a trigger assembly comprising:

a trigger fire control depression member comprising at least a trigger button; and the trigger fire control rod through which the safety fire control rod extends, the trigger fire control rod comprising at least an elongated trigger rod connected to the trigger button, the trigger fire control rod being adapted to be moved translationally by the trigger button connected thereto, the elongated trigger rod being adapted to engage a sear assembly for the activation of a firearm hammer and firing pin, thereby providing firing control of the firearm.

7. The firearm fire control assembly according to claim 1, wherein:

the safety assembly further comprises:

at least a safety button connected to the safety fire control depression member; and wherein the safety fire control rod comprises at least a safety bar connected to the safety button, the safety button being operably depressible to maneuver the safety bar between a safe, non-firing position and a firing position to allow for the firing of the firearm, thereby providing firing control of the firearm.

8. The firearm fire control assembly according to claim 7, wherein the safety assembly further comprises at least one safety detent to hold the at least a safety bar of the safety assembly in at least one of a fire position and a safe position.

9. The firearm fire control assembly according to claim 1, wherein:

the fire control assembly includes:

at least the trigger assembly, the trigger assembly comprising:

at least one trigger fire control depression member comprising a trigger button and a trigger stop member; and a trigger fire control rod comprising an elongated trigger rod connected to the trigger button, the trigger button being operably depressible to maneuver the trigger rod between an at-rest position, a non-firing position, and a firing position to fire the firearm, thereby providing firing control of the firearm; and the safety assembly further comprising:

a safety button connected to the safety fire control rod, the safety button being operably depressible to maneuver the safety fire control rod between a safe, non-firing position and a firing position to allow for the firing of the firearm, thereby providing firing control of the firearm.

10. The firearm fire control assembly according to claim 9, wherein:

the safety button of the safety assembly is operably depressible to maneuver the safety fire control rod of the safety assembly between the safe, non-firing position and the firing position to allow for the firing of the firearm and thereby provide firing control of the firearm; and wherein the elongated trigger rod of the trigger assembly has a key slot formed therein, the key slot being adapted to receive the safety fire control rod of the safety assembly and coact therewith to be disposed alternately in the safe, non-firing position and the firing position to allow for firing of the firearm.

11. The firearm fire control assembly according to claim 1, further comprising:

an action release tang located on a portion of the action release bar wherein the action release bar connected to the action release tang, the action release tang being operably engageable by a movable trigger mechanism to maneuver the action release bar between an at-rest, firing position and an action releasing, non-firing position, the firearm being disallowed from firing when in the action releasing position, the action release assembly thereby providing firing control of the firearm.

12. The firearm fire control assembly according to claim 1, further comprising at least one among a plurality of firing mechanisms including a firing pin, a hammer, a hammer spring, a hammer cocking bar, a hammer transfer link, a rotatable sear lever, a member of a sear assembly and a trigger member of a trigger assembly.

13. The firearm fire control assembly according to claim 1, wherein the fire control assembly is disposed on either one or both of an underside and a side of the forestock of the firearm.

14. The firearm fire control assembly according to claim 1, wherein the fire control assembly is accessible from either one or both of an underneath and a side of the forestock.

15. The firearm fire control assembly according to claim 1, wherein the fire control assembly is accessible from either one or both of an underneath and a side of the forestock and accessible via a shrouded recess adapted to have inserted therein a digit of a user's support hand.

16. The firearm fire control assembly according to claim 1, further comprising:

a forwardly movable firearm assembly forming part of the forestock connected to the fire control assembly, the forwardly movable assembly being adapted to be moved forward by an operator upon gripping a movable hand support structure and maneuvering the hand support structure forwardly, a firearm barrel and a receiver moving therewith, at least one firing mechanism of a plurality of firing mechanisms being held substantially stationary when the forwardly movable assembly is moved forward, comprising:

a movable hand support structure forming part of the forestock to which at least one of the firearm barrel and the receiver is connected, the firearm barrel and the receiver being movable therewith, the movable hand support structure being adapted to be gripped by an operator of the firearm, the fire control assembly being disposed in the movable hand support structure.

17. The firearm fire control assembly according to claim 16, wherein the at least one firing mechanism of a plurality of the firing mechanisms is at least one part of a substantially stationary assembly, the at least one firing mechanism remaining movable in and during the firing of the firearm.

18. The firearm fire control assembly according to claim 16, wherein the forwardly movable firearm assembly further includes a magazine, the magazine being adapted to move forwardly away from at least one of the firing mechanisms with the movable hand support structure, the barrel and the receiver as the forwardly movable assembly is moved forwardly.

19. The firearm fire control assembly according to claim 1, wherein the fire control assembly is operably supported by a firearm frame, the firearm frame supporting a firearm barrel and at least one firing mechanism of a plurality of firing mechanisms in operative relationship each with the other, the firearm frame comprising:

at least one elongated support structure discrete from a barrel and a receiver, the elongated support structure being adapted to support at least one of the firearm barrel and the receiver; and a firing mechanism support structure connected to the at least one elongated support structure, the firing mechanism support structure being adapted to have the firing mechanism operably connected thereto, the fire control assembly being forwardly disposed and supported by the elongated support structure.

20. A firearm fire control assembly adapted to be disposed in a forwardly-placed operative relationship within a firearm, the firearm including:

a barrel and a receiver in a forward assembly either or both of which are connected to a forestock; and firing mechanisms including:

a combination of a firing pin and a firearm hammer adapted to engage and fire a cartridge within the firearm;

a sear assembly to alternately engage and disengage the combination of the firearm hammer and the firing pin; and a trigger assembly including a translationally-movable trigger mechanism which is operable to engage the sear assembly and to cause firing of the firearm hammer and the firing pin to thereby fire the firearm; and the firearm fire control assembly being forwardly positioned and disposed within the forestock of the firearm comprising:

at least one fire control depression member including at least a trigger button;

at least one fire control rod operably connected to the depression member including at least an elongated trigger rod connected to the trigger button, the trigger rod having an aperture therein;

the fire control depression member being adapted to be operably engaged by an operator's forwardly-placed hand when the hand is in a forwardly-placed support hand position and being operably depressible to maneuver the fire control rod to a fire control position thereby providing firing control of the firearm;

at least a trigger assembly; and the trigger assembly being adapted to have the elongated trigger rod move translationally to engage the sear assembly for the activation of the firearm hammer and the firing pin thereby providing firing control of the firearm; and a safety assembly including:

a safety fire control depression member; and a safety fire control rod having a portion thereof extending through the aperture in a portion of a trigger rod.

21. A firearm fire control assembly comprising:

a fire control assembly located in a forestock of a firearm including:

a safety assembly including:

a safety fire control depression member; and a safety fire control rod having a portion thereof extending through a key slot in a portion of a trigger fire control rod of a trigger assembly; and an action release assembly including:

at least one action fire control rod; and at least one action fire control depression member operably connected to the action fire control rod, the at least one action fire control depression member being adapted to be engaged by a user's support hand when the support hand is on the forestock and being depressible for moving the at least one action fire control rod to a fire control position, thereby providing firing control of the firearm.

22. The firearm fire control assembly according to claim 21, wherein the fire control assembly is shrouded by the forestock.

23. The firearm fire control assembly according to claim 21, wherein the fire control assembly is shrouded within the forestock of the firearm and adapted to be externally accessible to and operably engaged by a digit of a user's forwardly placed support hand when the user's digit is inserted through the forestock of the firearm.

24. The firearm fire control assembly according to claim 21, wherein the fire control assembly may be operatively engaged by either hand of a user.

25. The firearm fire control assembly according to claim 21, wherein:

the fire control assembly includes a trigger assembly including:

a trigger fire control depression member including at least a trigger button; and a trigger fire control rod including at least an elongated trigger rod connected to the trigger button, the trigger button depressible to move the trigger rod between a non-firing position and a firing position, thereby providing firing control of the firearm.

26. The firearm fire control assembly according to claim 21, wherein:

the fire control assembly includes a trigger assembly including:

a trigger fire control depression member including a trigger button; and a trigger fire control rod including at least an elongated trigger rod connected to the trigger button, the trigger fire control rod adapted to be moved translationally by the trigger button connected thereto, the elongated trigger rod adapted to engage a sear assembly for activation of a firearm hammer and a firing pin, thereby providing firing control of the firearm.

27. The firearm fire control assembly according to claim 21, wherein:

the fire control assembly includes a safety assembly including:

a safety fire control depression member including a safety button; and a safety fire control rod comprising a safety bar connected to the safety button, the safety button being depressible for moving the safety bar between a safe, non-firing position and a firing position to allow firing of the firearm, thereby providing firing control of the firearm.

28. The firearm fire control assembly according to claim 27, wherein the safety assembly further comprises at least one safety detent to hold the safety assembly in at least one of a fire position and a safe position.

29. The firearm fire control assembly according to claim 21, wherein:

the fire control assembly includes a trigger assembly including:

a trigger fire control depression member including a trigger button; and a trigger fire control rod including an elongated trigger rod connected to the trigger button, the trigger button being depressible to maneuver the trigger rod between an at-rest, non-firing position and a firing position to fire the firearm and thereby providing firing control of the firearm;

the safety fire control rod comprising a safety bar connected to a safety button, the safety button being depressible to maneuver the safety bar between a safe, non-firing position and a firing position to allow for the firing of the firearm, thereby providing firing control of the firearm.

30. The firearm fire control assembly according to claim 29, wherein:

the safety button is depressible for moving the safety bar between the safe, non-firing position and the firing position to allow for the firing of the firearm, thereby providing firing control of the firearm; and wherein the elongated trigger rod having a key slot formed therein is adapted to receive a portion of the safety bar therein.

31. The firearm fire control assembly according to claim 21, wherein:

the action fire control depression member includes an action release knob; and the action fire control rod includes an action release bar connected to the action release knob, the action release knob being depressible to maneuver the action release bar between an at-rest, firing position and an action releasing, non-firing position and preventing the firearm from firing when in the action releasing position, the action release assembly thereby providing firing control of the firearm.

* * * * *

UNITED STATES PATENT AND TRADEMARK OFFICE

CERTIFICATE OF CORRECTION

PATENT NO. : 7,634,959 B2
APPLICATION NO. : 10/937219
DATED : December 22, 2009
INVENTOR(S) : Steven J. Frickey It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 669 days.

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,634,959 B2
APPLICATION NO. : 10/937219
DATED : December 22, 2009
INVENTOR(S) : Steven J. Frickey It is certified that error appears in the above-identified patent and that said Letters Patent is hereby corrected as shown below:

In the specification:

| | | |
|---|---|---|
| COLUMN 7, | LINE 51, | change "sub-part" to --subpart-- |
| COLUMN 8, | LINE 62, | change "level **61**," to --lever **61**,-- |
| COLUMN 15, | LINE 22, | change "(is/are)" to --is/are-- |
| COLUMN 17, | LINE 30, | change "assembly system **50**" to --assembly **50**-- |
| COLUMN 20, | LINE 64, | change "action **15**" to --forwardly movable assembly **15**-- |
| COLUMN 24, | LINE 7, | change "n mere" to --By providing mere-- |
| COLUMN 25, | LINE 11, | change "lever **78**;" to --lever **78**-- |
| COLUMN 26, | LINE 54, | change "assembly barrel **16**" to --barrel assembly **16**-- |
| COLUMN 28, | LINE 34, | change "action **15**" to --**15**-- |
| COLUMN 32, | LINE 47, | change "FIG. **23**," to --FIG. **23**B,-- |

Signed and Sealed this
First Day of October, 2013

Teresa Stanek Rea
*Deputy Director of the United States Patent and Trademark Office*